United States Patent [19]

Orr et al.

[11] Patent Number: 4,768,767

[45] Date of Patent: Sep. 6, 1988

[54] SHEET DISTRIBUTING METHOD AND APPARATUS

[75] Inventors: Kenneth A. Orr, Reading; Warren S. Funk, Chalfont, both of Pa.

[73] Assignee: R. Funk & Co., Doylestown, Pa.

[21] Appl. No.: 19,070

[22] Filed: Feb. 26, 1987

[51] Int. Cl.[4] ..... B65H 39/02

[52] U.S. Cl. ..... 270/58; 271/259; 271/263; 364/478; 493/14; 493/28

[58] Field of Search ..... 270/58, 56; 364/138, 364/471, 478; 493/14, 25, 27, 28

[56] References Cited

U.S. PATENT DOCUMENTS

| | | | |
|---|---|---|---|
| 3,902,708 | 9/1975 | Wise et al. | 270/58 |
| 4,026,543 | 5/1977 | Leclere | 271/259 |
| 4,121,820 | 10/1978 | Forster et al. | 271/259 |
| 4,127,266 | 11/1978 | Williams | 271/263 |
| 4,302,198 | 11/1981 | Kawada | 493/14 |
| 4,341,462 | 7/1982 | Ogura | 271/259 |
| 4,439,865 | 3/1984 | Kikuchi et al. | 270/58 X |
| 4,462,587 | 7/1984 | Graef et al. | 271/263 |
| 4,471,954 | 9/1984 | Bourg | 270/58 |
| 4,504,961 | 3/1985 | Horiguchi | 271/263 |
| 4,517,650 | 5/1985 | Gomes et al. | 364/478 |
| 4,527,791 | 7/1985 | Piotroski | 270/58 |
| 4,547,846 | 10/1985 | Gottlieb | 364/138 |
| 4,547,856 | 10/1985 | Piotroski et al. | 364/478 |
| 4,608,704 | 8/1986 | Sherman, III et al. | 271/259 |

*Primary Examiner*—Eugene H. Eickholt

*Attorney, Agent, or Firm*—Albert L. Free

[57] ABSTRACT

A collator control system capable of stack, collect and collate operations, which automatically finds an appropriate set of empty bins for the desired mode of operation and provides indications of when the bins have been filled. The system operates on sheets of paper, some of which may be unfolded and others of which may be folded one or more times.

15 Claims, 10 Drawing Sheets

FIG. 3
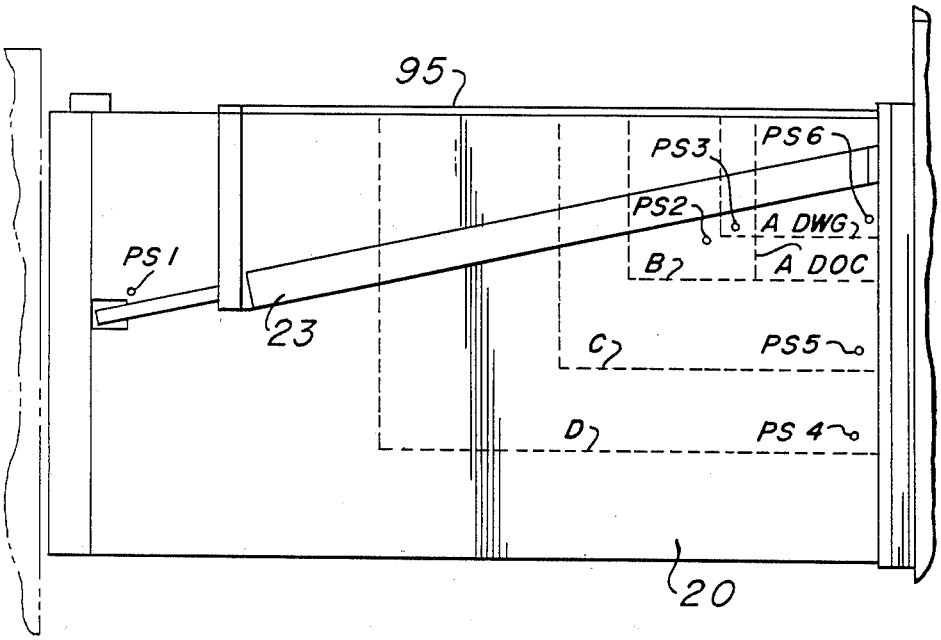
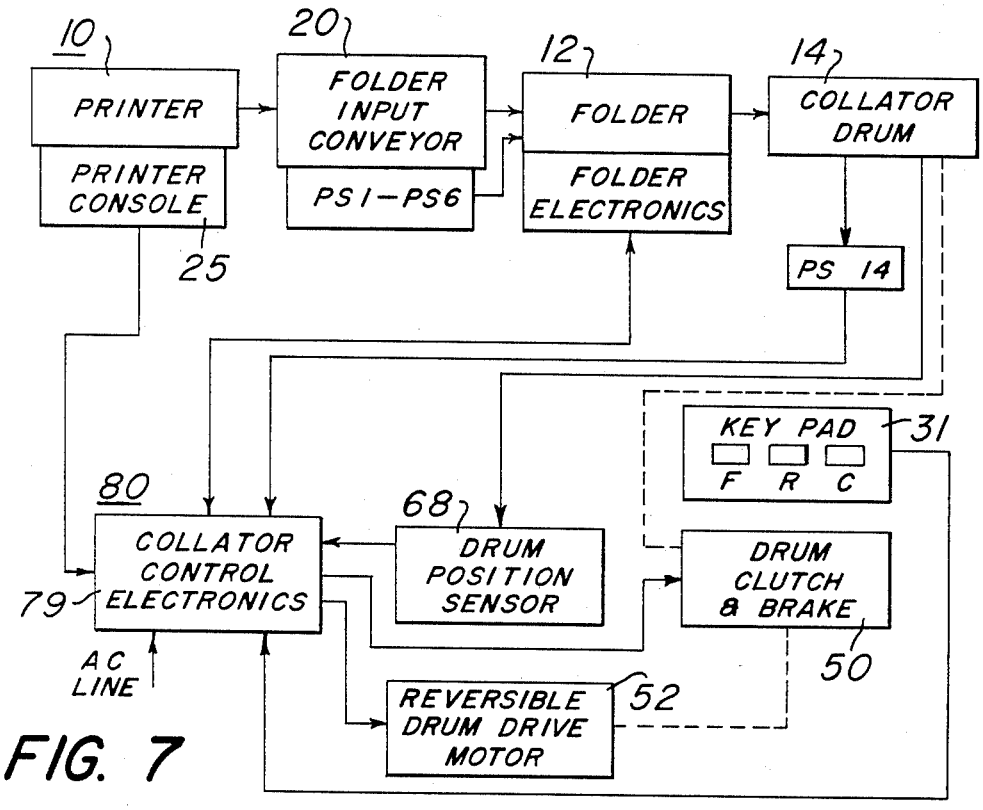
FIG. 7

```
                    ** MEMORY MAP **
                         TOP

        FFH | GENERAL PURPOSE      | 81-KEYPAD/MISC. FLAGS, B7-MONI
        CEH | ----------------     |       B0-2ND PASS IN KEYPAD SUB.
            | MODE 5-SPECIAL       |       B1-MOTOR SUB. FROM KEYPAD
            |   LOCATIONS          |       B2-PREVIOUS, 2ND SET BIN
        99H | ----------------     | 7C-MESSAGE FLAGS:
        98H |                      |       B6-COLL. RUNNING
            |                      |       B5-SPECIAL
GENERAL     |                      |       B4-QTY ERROR #2
 R.A.M.     | 64 LOCATIONS         |       B3-QTY ERROR #1
        5AH | ----------------     |       B2-COUNT ERROR
        59H |                      | BIN 25 B1-END OF JOB
  25        |      BIN             |       B0-ALL BINS FULL
LOCATIONS   |    WEIGHT            | (OFFH INDICATES FULL BIN)
            |    VALUES            |
        41H | ----------------     | BIN 1
        40H |                      |
        3FH |      COLL.           | 83-FLAG3:
            |    MESSAGES          |       B0-RESUME XMIT
        30H | ----------------     |       B1-REALLY RESUME
        2FH |                      |       B2-JOB IN PROGRESS
            |    PRINTER           |       B3-STORED PROGRAM
            |   MESSAGES           |       B4-B7 OF BUFFED DATA
        20H | ----------------     |          WHILE J.I.P.
        1FH | R7'=                 |       B5-1ST BUFFERED COLLATE
            | R6'=COLL XMIT PTR    |       B6-2ND BUFFERED COLLATE
            | R5'=PRINT RCVR PTR   | R4':  B7-NOCAN SUB. CALLED
            | R4'=COMM. STATUS     | B7- 1,TRANSMIT ECHO ERROR
            | R3'=MESS.BUFF. REG   | B6- 1,CHAR. ECHOED COMPLETE
            | R2'=MODE REG.        | B5-
            | R1'=                 | B4- 1,COLL. ORIGINATED MESS.
        18H | R0'=                 | B3- 1,XMIT IN PROGRESS
            | ----------------     | B2-
        17H |                      | B1- 1,FLAG IN INT.
            |      STACK           | B0- 1,PRINTER ORIGINATED MESS.
        08H | ----------------     |
        07H | R7=ACT. PRINT CNT.   |
            | R6=BIN COUNT         |
            | R5=COUNT 1 PRINT     | R2:
            | R4=GIVEN PRINT CNT   | B7- 1,MODE 5 FLAG
            | R3=                  | B6- 1,CLEAR KEY (BINS EMPTY)
            | R2=FLAG REG.         | B5- 1,RESET        "    "
            | R1=                  | B4- 1,END OF JOB MESS.
        00H | R0=                  | B3- 1,PRESENT BIN FULL
            | ----------------     | B2- 1,COLLATOR STOPPED
                                   | B1- 1,MESSAGE TO SEND
                                   | B0- 1,MOTOR IN REV. DIR.
                          R4 IN SPECIAL MODE=BIN NO.
```

FIG. 11

SHEET DISTRIBUTING METHOD AND APPARATUS

RELATION TO OTHER APPLICATIONS

The subject matter of this application may be used in the type of system disclosed and claimed in copending application Ser. No. 884,475 of Robert S. Ott, filed July 11, 1986 now U.S. Pat. No. 4,701,155 and of common assignee herewith, applicable portions of which are included herein by reference.

FIELD OF THE INVENTION

The present invention relates to methods and apparatus for distributing sheets of material, for example machine-copied prints on a flexible sheet of paper or the like, including the sorting, stacking, collating etc. of printed sheets.

BACKGROUND OF THE INVENTION

It is often desirable to distribute printed sheets in various predetermined ways, for example to form stacks of prints of predetermined content, or to collate such prints into appropriate sets. For example, the pages of a book, or a packet of engineering drawings or maps, may be printed and sorted or collated into the desired book or packet form.

One such application in connection with which this invention will be described involves the distributing of such prints into separate bins of a print-receiving apparatus which is designated herein as a collator, although it may be used for purposes other than what is sometimes thought of as collation.

The above-identified patent application discloses a system in which prints from a printer are conveyed in a series train to an automatic folder which folds each sheet in any of a variety of desired ways, and delivers the folded sheets in sequence into the appropriate bins of a rotating collator. Typically such collator is rotated by a clutch and brake mechanism which advances it one step at a time, so that the open slit-like mouths of the bins move successively into arrested positions for receiving the successive prints. It will be appreciated that if a bin of the collator becomes too full it will not receive additional sheets, and what amounts to a "jam" will be produced if operation is continued.

In the case of ordinary unfolded sheets the problem of predicting over-filling is not so severe, because the thickness and geometry of such a sheet is substantially constant, known, and predictable. However, when some or all of the sheets are folded, and may be folded in different ways and different numbers of times, the problem is much more severe; a few multiply-folded sheets, for example, will clearly fill much more space than many more simple unfolded sheets. Accordingly, mere counting of the sheets is not adequate to determine how much space they will require. Measuring the effective thicknesses of the various packets after they have been folded and before they reach the collator is also a difficult, unreliable and costly procedure.

In distinguishing the various folded sheets from each other, the term "panel" is used herein to describe each overlapping layer in a sheet; that is, a single unfolded sheet contains one panel; a sheet folded once contains two overlapping panels; a sheet folded in half, and then folded in half again, contains four overlapping panels; and so on. In this connection, it is noted that a twice-folded sheet of four overlapping panels, for example, generally is in effect thicker than four single unfolded sheets superimposed on each other. In some cases, different parts of a sheet will be folded a different number of times; for example, a sheet may be folded only along one edge region. In such cases the number of panels in the sheet is considered to be the maximum number of overlapping panels present at any location on the sheet, since this is ordinarily what determines the amount of lateral space which it takes up.

In the apparatus of the copending application referred to above, immediately successive sheets may be folded in widely different ways, so that the problem of avoiding overloading of one or more bins is especially severe.

Accordingly, an object of this invention is to provide a new and useful method and apparatus for distributing sheets into a plurality of bins.

Another object is to provide such method and apparatus suitable for preventing overloading of said bins by said sheets.

A further object is to provide such method and apparatus which is adapted to the distribution of sheets at least some of which are folded.

It is also an object to provide such method and apparatus in which different sheets are differently folded, and overloading of said bins is nevertheless prevented.

SUMMARY OF THE INVENTION

These and other objects of the invention are achieved by the provision of a method and apparatus for distributing sheets in which the number of superimposed panels in each sheet is sensed and signals produced which indicate the total effective thickness of all sheets fed to each bin in a first set of one or more bins. When all but one bin is full and the effective thickness for the remaining bin exceeds a predetermined value, a bin-full signal is produced and, preferably, a bin-switching means is then actuated for switching the feeding of said sheets from the first set of bins to a second set of bins exclusive of the one bin. Preferably, the second set of bins is exclusive of the entire first set of bins.

In a preferred embodiment, said apparatus comprises means for assigning differing weighted values to said sheets depending on the number of panels in them, this weighted value being larger for sheets having larger numbers of panels, and the bin-switching means comprises means producing said switching when the sum of said values for the sheets delivered to any bin exceeds a predetermined value. Preferably the number of panels in a sheet is determined by detecting its lateral size, each size of sheet having a known predetermined number of panels when it is delivered to the collator. With this system, switching of the feeding of sheets away from a substantially filled bin is accomplished automatically, despite the feeding of successive sheets having randomly differing numbers of panels.

Preferably also, the system detects the entry of each sheet into the collator, and in response thereto checks the electronic system to determine whether the collector drum should be moved, and where to, e.g. whether a bin is full and if so what bins should not be filled, all such checking and collator drum movement as well as any alarms or other suitable actions being accomplished prior to the arrival of the next sheet.

In one preferred form of the invention, if the number of bins in the first set being filled is N (e.g. 8), and the total number of bins originally available is at least 2N (e.g. 25), then the apparatus operates to feed sheets into the first set of bins until at least one is substantially full, or the assembling of the first complete set of prints has been completed and another job requested, at which time it stops filling of the first set of N bins, determines that a number N of other bins is available, and begins to fill the other set of N bins with sheets thus avoiding over-filling of a bin in the first set.

BRIEF DESCRIPTION OF FIGURES

These and other objects and features of the invention will be more readily understood from a consideration of the following description, taken with the accompanying drawings, in which:

FIG. 3 is an enlarged plan view of the inlet to the folder, showing an arrangement of photosensors for sensing the sizes of the sheets being fed to the folder;

FIG. 7 is a schematic functional block diagram of the system of FIG. 1;

FIG. 11 shows a memory map for the electronics controlling the operation of the collator.

DETAILED DESCRIPTION OF SPECIFIC EMBODIMENTS

Figure 1:
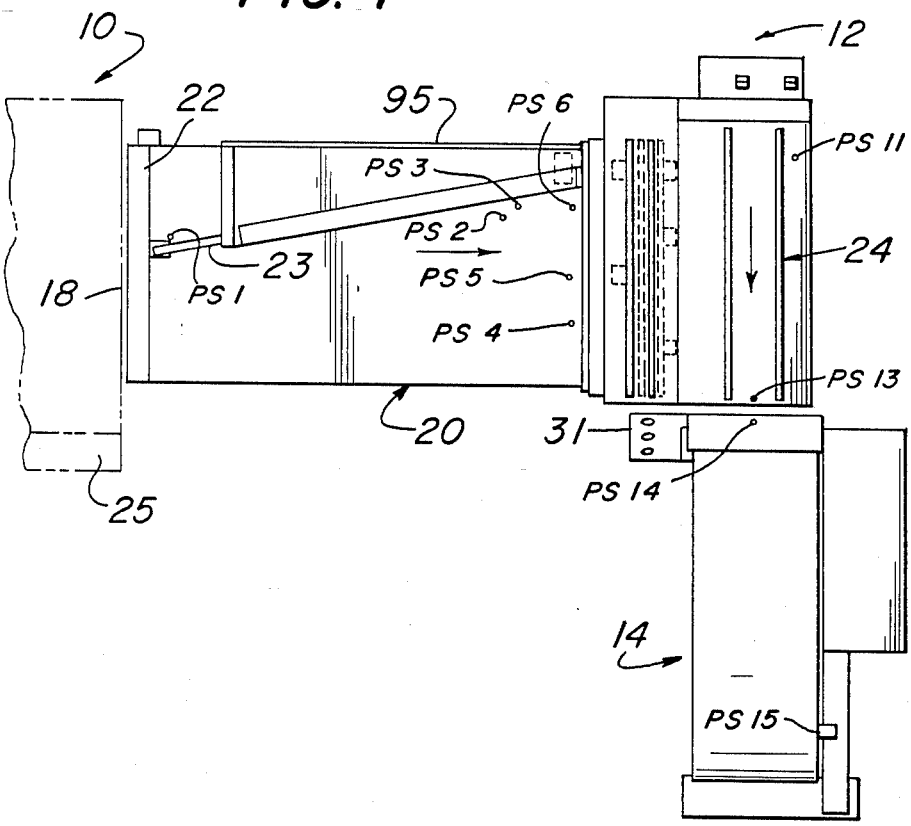
FIG. 1 is a schematic top plan view of a folder-collator system to which the present invention may be applied.
Figure 2:
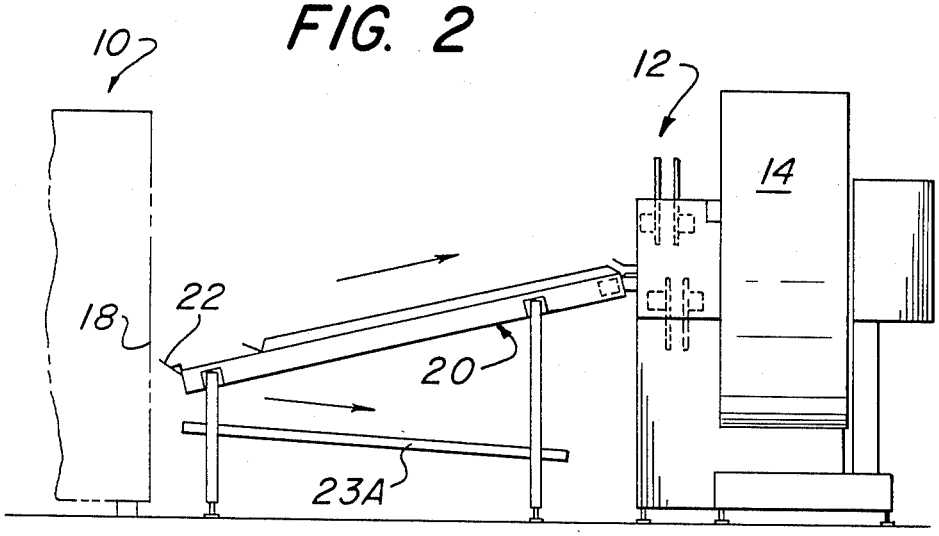
FIG. 2 is a side elevational view of the system of FIG. 1.

Referring now to the embodiments of the invention shown specifically in the drawings by way of example only, and without thereby in any way limiting the scope of the invention, FIGS. 1 and 2 are the same as those correspondingly numbered and described in the above-identified copending application, the description of which is included herein by reference. Referring to the system shown generally therein, a printer 10, which may be a microfilm-enlarger printer as an example, supplies prints to a folder 12, which folds them appropriately and delivers them to the input of a collator 14. The output 18 of the printer delivers the prints one at a time in a series train onto an input conveyor 20 for delivery to the input to the folder. A solenoid-operable diverter 22 is provided to enable diversion of the prints to a table 23A beneath the conveyor in the event of a jam-up. The prints slide along the top of a conventional table in the conveyor in response to frictional engagement by the top conveyor belt 23, which extends diagonally so as to urge one side of the prints against a suitable guide wall 95 so they will all be properly aligned.

The folder delivers its folded and unfolded prints upward onto an upper conveyor 24, which moves transversely to the motion of the input conveyor to deliver the prints to the collator. An electrical printer control station 25 is provided at the printer to enable the operator to designate the type of folding which he desires, and a cabinet 30 may be provided at the folder to contain the electronics for controlling the folding action. A keypad 31 having three push buttons is provided at the collator, two buttons to enable manual control of forward or reverse operation of the collator drum, and a third button for clearing of the collator circuitry after the sheets have been removed from the collator. A photosensor PS14 is positioned adjacent the inlet to the collator to detect the entering sheets, as also described in more detail hereinafter.

The system includes means for sensing how many overlapping panels are provided in each sheet by the folder. In this example this is preferably done by taking advantage of the fact that, for any general type of folding indicated by the printer circuit 25, the number of panels produced in the sheet depends upon its size. That is, in the ordinary engineering folding of prints, A-size prints are not folded at all, B-size prints are folded in half once, C-size prints are folded once along a direction parallel to the leading edge of the sheet (parallel-fold) and after that are folded once again in the crosswise direction (cross-fold). D-size sheets are parallel-folded three times and cross-folded once. It is therefore known that A-size prints have one panel, B-size prints have two panels, C-size prints have four panels and D-size prints have eight panels.

The manner in which the sizes of the prints are sensed is shown in FIG. 3, which is the same as FIG. 14 of the above-identified application. This enlarged top plan view of the input conveyor to the folder shows the typical locations of photosensors PS1, PS2, PS3, PS4, PS5 and PS6. From this it can readily be seen that an A-size print in the so-called document orientation reaches the position shown in which it covers PS6 while covering no other photocell. When an A-size in the drawing orientation (long dimension along the conveyor) covers PS6, it also covers PS3. When a B-size print is present, PS2, PS3 and PS6 are all covered, and no others, while for a C-size print PS5 is additionally covered. Similarly, when a D-size print reaches PS6, all of the five photosensors are covered.

In this example, the photosensors are located below the input conveyor table and view the undersides of the prints by "looking" upward through appropriate openings in the table; to this end, the photosensors are preferably so-called reflection-type photosensors in which a beam of light from an LED is directed upwardly toward the prints and, if the print is present, reflection of the light arrives back at the detector element of the photosensor to indicate the presence of the paper. Such devices are well known and commercially available and need not be described in detail.

It will therefore be appreciated that the combination of photosensors PS2–PS6 provides an unambiguous indication of the size of the print, and hence of the number of panels it contains after it passes through the folder. This information is utilized, in accordance with the present invention, to attach a weighted value to each sheet depending upon the number of panels which it contains, this value representing in effect the amount of lateral space which is occupied by the print in a bin of the collator.

The folder 12 may be as described in detail in the above-identified copending application Table I below contains suitable representative weighting values for each of the differently sized prints, namely, A, B, C and D. The best values in any particular case are best obtained experimentally for that particular application of the invention. As an example, the weighted value for a once-folded sheet is more than twice that for a single unfolded sheet because, due to the thickness in the region of the fold, it requires more lateral space than two unfolded sheets one upon the other. For other types of folds, and other types of material, these weighting values may be quite different, and can be determined experimentally for any particular application. While the folder shown in the figures is capable of producing a wide variety of types of folds, those listed above are representative and all of the other possibilities therefore need not be described in detail.

TABLE I

A-size print: 1
B-size print: 2
C-size print: 5
D-size print: 7

Figure 4:
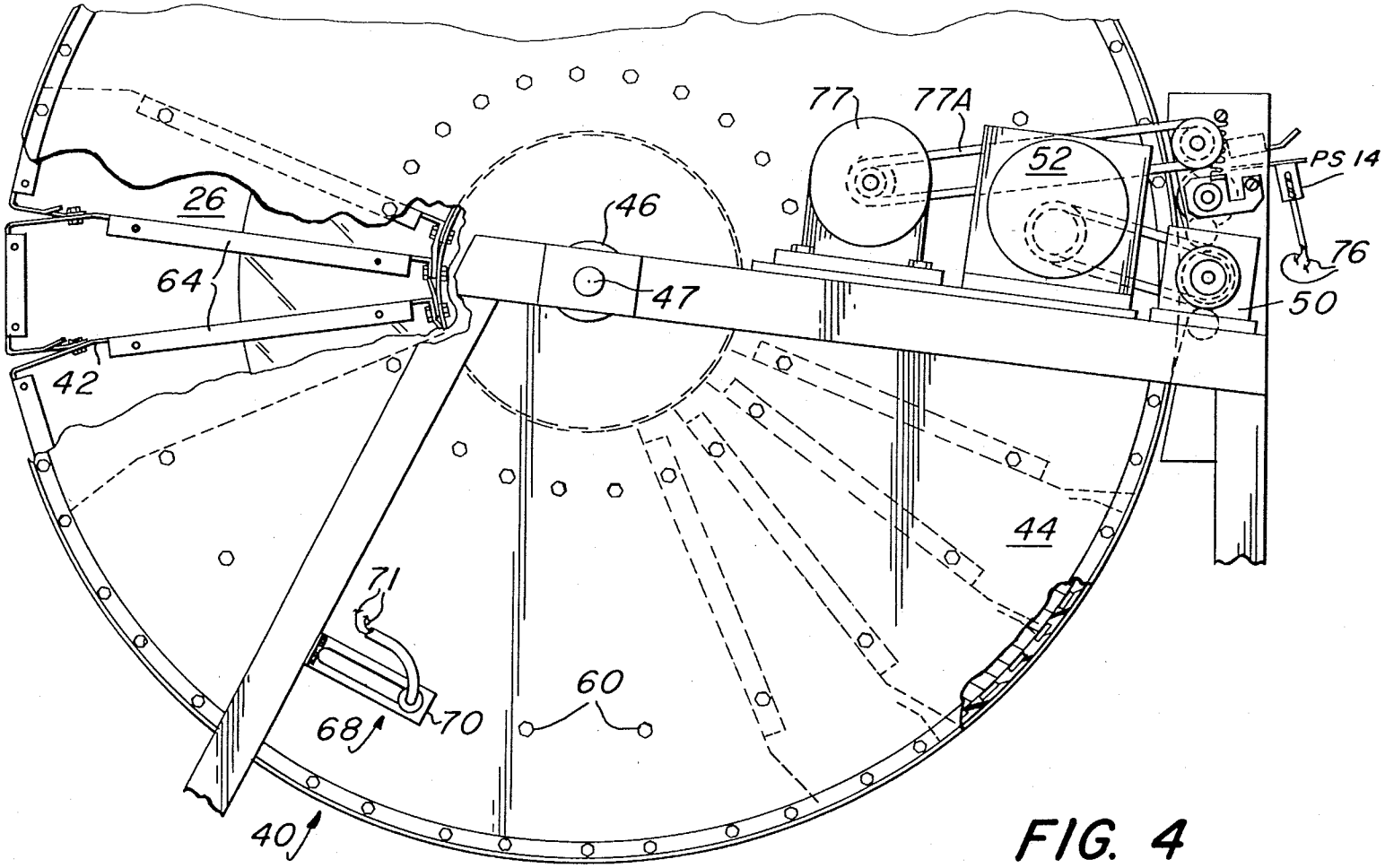
FIG. 4 is a fragmentary side view of the collator drum of the system of FIG. 1, as viewed from the right.
Figure 5:
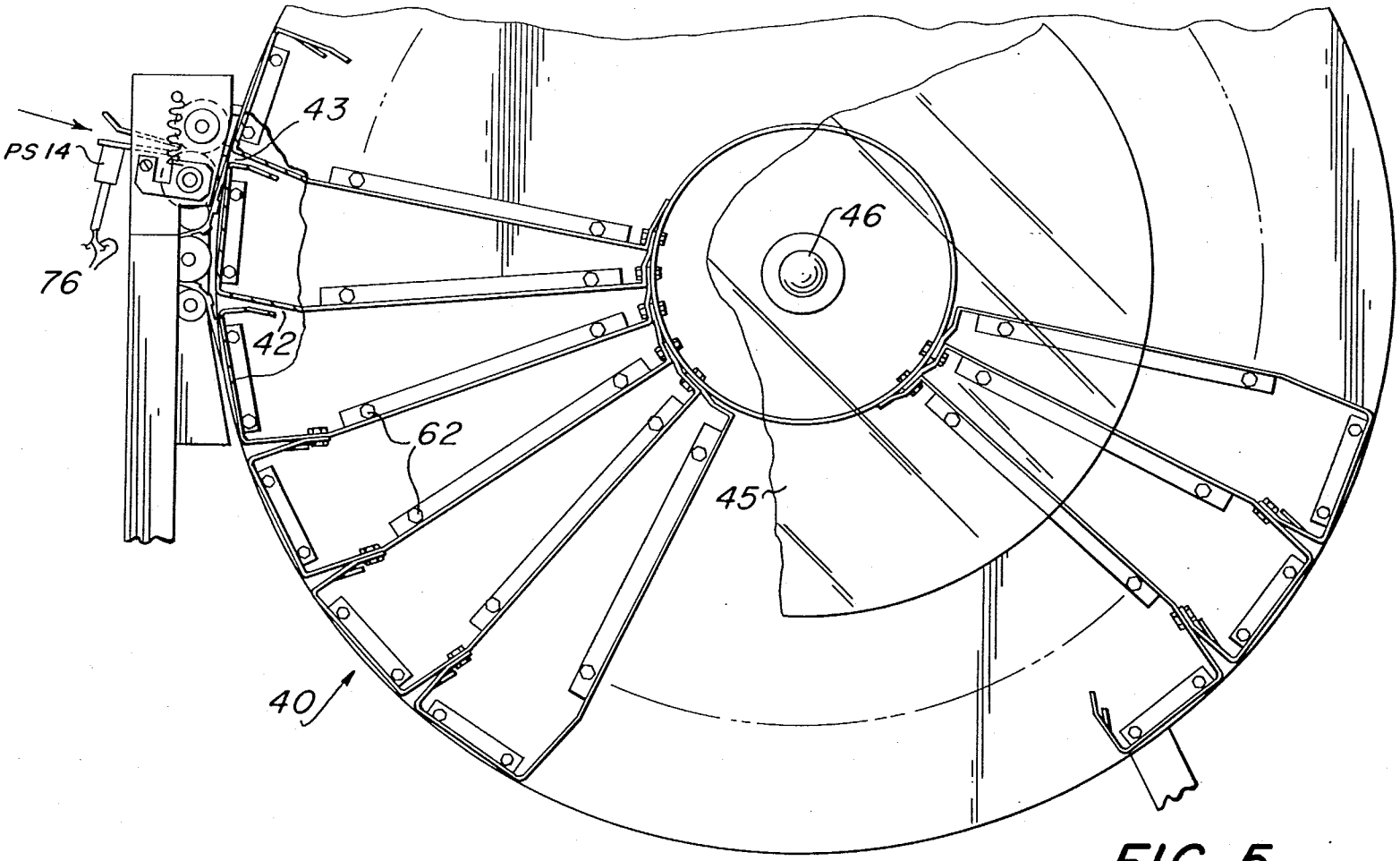
FIG. 5 is a similar view of the drum, but as viewed from the left.
Figure 6:
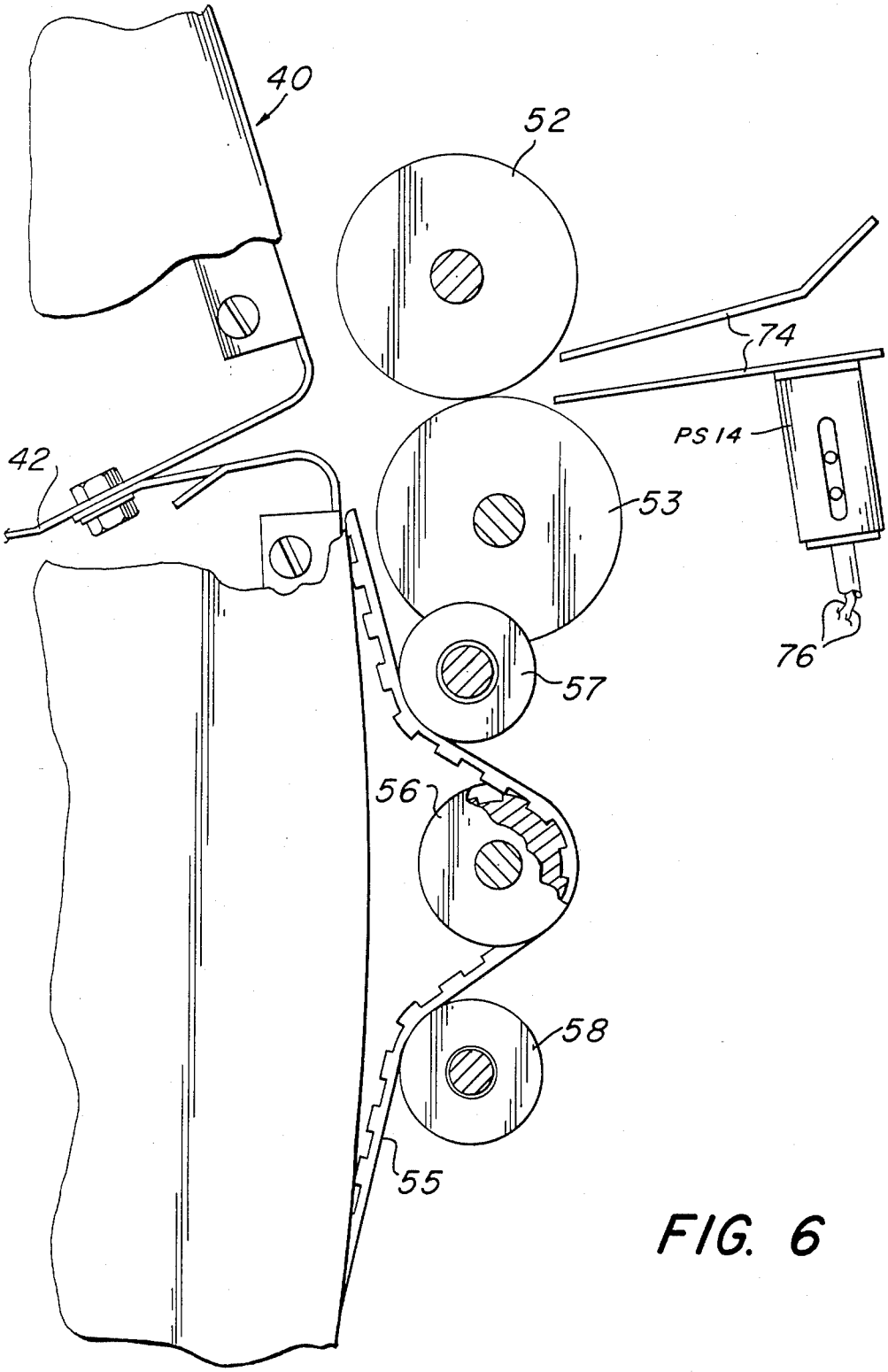
FIG. 6 is a further enlarged view of the paper-input feed portion of the apparatus shown in FIG. 5.

FIGS. 4, 5 and 6 show the presently preferred form of the collator mechanism in more detail. It will be seen that it comprises a circular drum 40 divided into 25 radial sector-shaped bins such as 26 by partitions such as 42 extending radially from the axis of the drum. The peripheral faces of the bins provide horizontally extending slits such as 43 through which the successive prints, folded or unfolded, slide into the interior of the bins from the upper conveyor 24 of the folder 12. The rear side of the collator drum is closed by a plate 44, and a removable plastic disc 45 covers the other side of the drum when in use; it is lifted off when the collated or sorted sheets are to be removed. A single magnet arrangement 46 at the center of the disc enables rapid and easy removal and replacement of the cover.

In this example, the collator is rotated on axle 47, one bin width at a time; i.e. with the 25 bins used in this example it is rotated in steps of approximately 15°. Rather than accomplishing this by a stepping motor and gears, it is preferred to utilize a solenoid-operated brake-and-clutch unit 50 of conventional form, whereby the drive motor 52 for rotating the drum 40 is connected through the clutch with the brake off when rotation is to take effect, and is rapidly arrested by opening of the clutch and application of the brake when it is to be stopped preparatory to receiving prints from the folder output. FIG. 6 shows in more detail the roller 52,53 for moving the sheets into the collator, as well as the circumferential belt 55, drive sprocket wheel 56 and idler rollers 57,58 for turning the drum in response to the drum motor. Arresting of the drum at the appropriate position is in this preferred embodiment accomplished by use of sensing means which sense when the collator has rotated to a desired next position and then arresting it as mentioned above.

To this end, a plurality of nuts such as 60 screwed to the ends of bolts such as 62 are provided on rear plate 44, in a circle concentric with the axis of the drum, one such nut and bolt for each bin; preferably each nut and bolt is secured to a flange such as 64, at one side of each bin. A commercial magnetic proximating sensor unit 68 is positioned adjacent the path of the nuts, and is held fixed by bracket 70. Accordingly, each time a nut associated with a bin moves into the appropriate position for receiving a print, the sensor 68 produces a signal on leads 71 which is supplied to the control system for the drum, which in turn supplies an appropriate signal to open the clutch and apply the brake as described above, at the appropriate time to arrest the drum with the appropriate slot such as 43 aligned with the incoming sheet from the folder. Other means of controlling the stepping action of the collator drive may of course be employed instead.

In addition, a reflective type of paper-sensing photosensor PS14 is positioned adjacent to the paper-input guides 74 which guide the sheets into the collator, which produces an output signal on leads 76 when a sheet is entering the collator. FIG. 4 shows also the conveyor drive motor and belt 77,77A.

The collator has no fixed reference or home position in this embodiment, from which to count the bins. Instead, upon start-up and initialization of the control system, the bin which is currently facing the folder output becomes, in effect, bin #1 for the duration of the subsequent operations.

Basically, the control system presently to be described in more detail preferably provides a counter for each bin; for example, upon initialization bin #1 is associated with one of the counters which is then designated counter #1, and so forth for the other 24 bins and counters. Each counter maintains a running count of the weighted number of panels of prints contained in its associated bin. Each counter up-counts from its previous count by an appropriate amount in response to signals from the size sensor, acting through the weighting system. The counts accumulated in each counter are periodically compared with a fixed stored count indicative of the level to which any bin can safely be filled, and when one such count reaches the stored count level, action is taken to prevent the collator from exposing that bin to further accumulation of prints.

FIG. 7 shows in schematic block form the overall disposition of the collator control system. The collator control electronics 79 are disposed primarily on a collator circuit board unit 80 the physical arrangement of which is shown schematically in more detail in FIG. 8. As shown, it comprises the board 81 supporting an Intel 8040 MCU (micro-controller unit) 82 supplied with operating data from an E-PROM 83, in response to READ instructions from the MCU. The E-PROM is preferably a type INTEL 2764 (8K by 8), utilizing assembly language. An INTEL 8251A UART (Universal Asynchronous Receiver Transmitter) allows exchange of serial data between the printer and the collator. The MCU communicates with Transistor 1 to control the drum clutch and with Transister 2 to control the drum brake.

In addition, the circuit board supports an alarm buzzer 86 and a drum-motor reversing relay 87, as well as a motor-controlling TRIAC 88, all controlled by the MCU. A line transformer 90 supplies 220 volt AC power to a power supply 91, which in turn supplies a voltage regulator 92 to produce a regulated 5 volt DC supply voltage for the electronics; two large capacitors 94,95 for the power supply are also mounted on the board.

Figure 8:
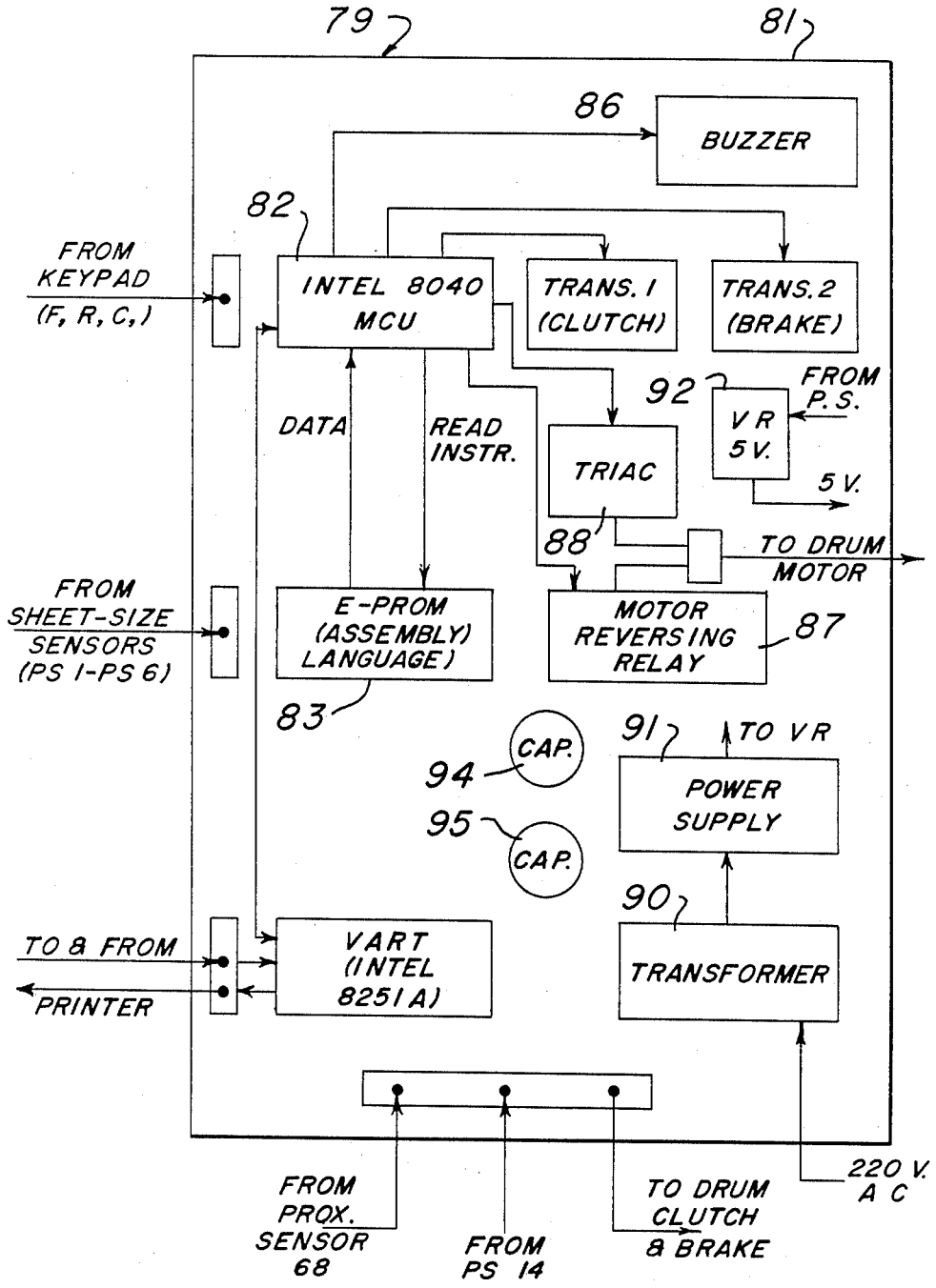
FIG. 8 is a schematic block diagram showing the physical arrangement of the collator electronics for the system of FIG. 1.

FIGS. 7 and 8 show the inputs to and outputs from the collator circuit board unit. The printer 10 has associated with it a printer console 25 which includes manually-operated controls and communicates with the collator circuit board unit bidirectionally. The photocells PS1–PS6 associated with the folder input conveyor act as sheet-size sensors supplying sheet-size information to the circuit board unit. The collator keypad 31 also supplies input signals to the circuit board, as does the drum position sensor comprising the proximity sensor 68 and the nut assembly described above. Bidirectional communication is also provided between the folder electronics and the collator control electronics, which also supplies control outputs to the drum drive motor and the drum clutch and brake.

Figure 9:
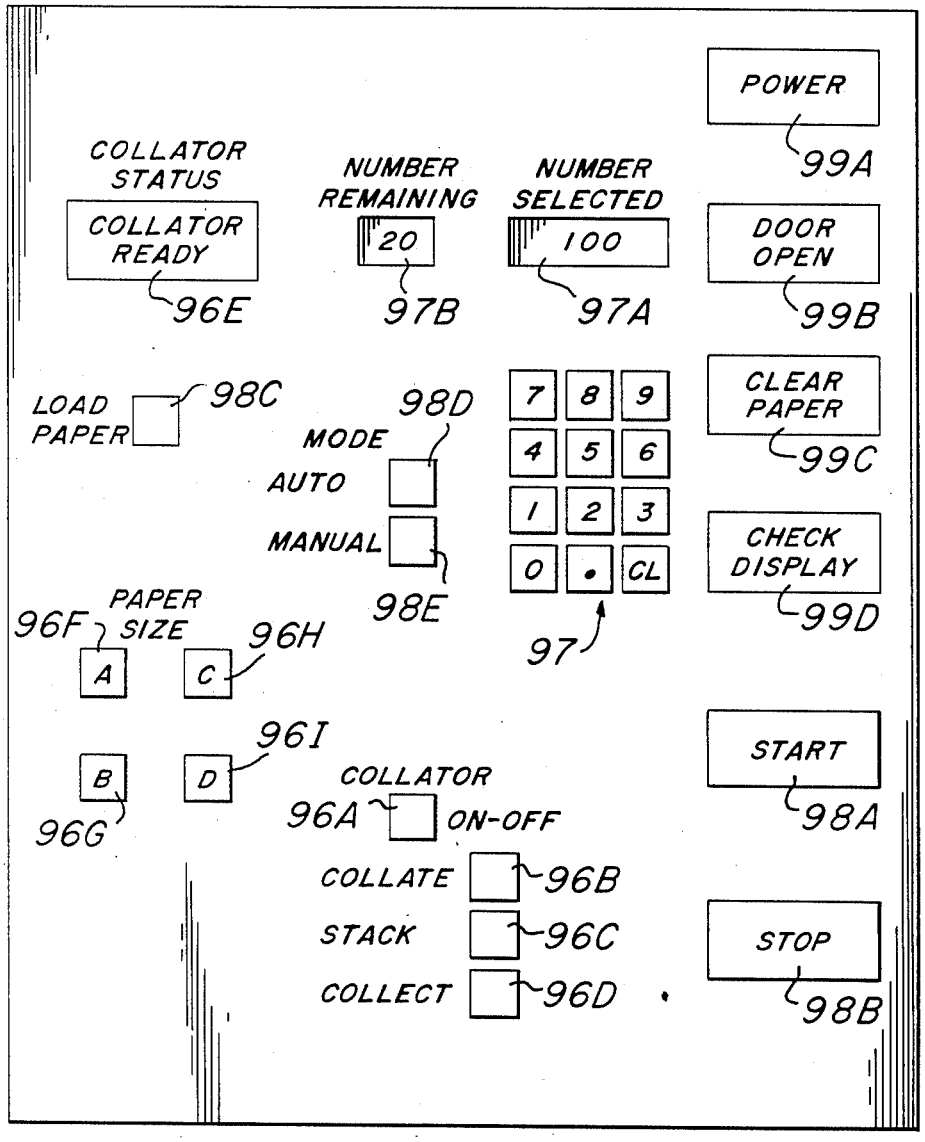
FIG. 9 is a plan view of a printer control panel suitable for use in the system of FIG. 1 to control the collator operation.

FIG. 9 shows one preferred arrangement of the printer console, in so far as it relates especially to the collator operations. Turning on and off of the collator is controlled by push button 96A, and the seleotion of collate, stack or collect modes is made by means of push buttons 96B, 96C and 96D. The collator status display 96E displays messages COLLATOR READY, or BINS READY, COLLATOR ERROR MESSAGES or COLLATOR JAM, as appropriate. This LCD also displays printer and folder status as well. The paper size to be folded and collated is indicated by operation of pushbutton switches 96F, 96G, 96H or 96I. In the collate mode, the number of sets to be collated is specified by using the keypad 97 to enter the number of sets. Displays 97A and 97B indicate, respectively, the number of sets to be collated in the particular job, and the number of sheets of the set then being collated still remaining to be supplied to the collator on that job. Miscellaneous controls comprise the folder stop and start buttons 98A, 98B, the LOAD PAPER button 98C which tells the system that the operator is going to load sheets into the printer, the AUTOMATIC-MANUAL buttons 98D, 98E which by operation of 98D can switch the printer to a mode in which punch cards are read to instruct the machine automatically with respect to number of sheets, sheet size, collator mode, etc.; this is not part of the apparatus needed for operation according to the present invention. Another set of lamp displays 99A through 99D indicate, by lighting up, that power is on, or that a door accessing the folder mechanism is open, or that one should clear paper from a jam, or that the operator should check the display 96E for an appropriate message.

Figure 10:
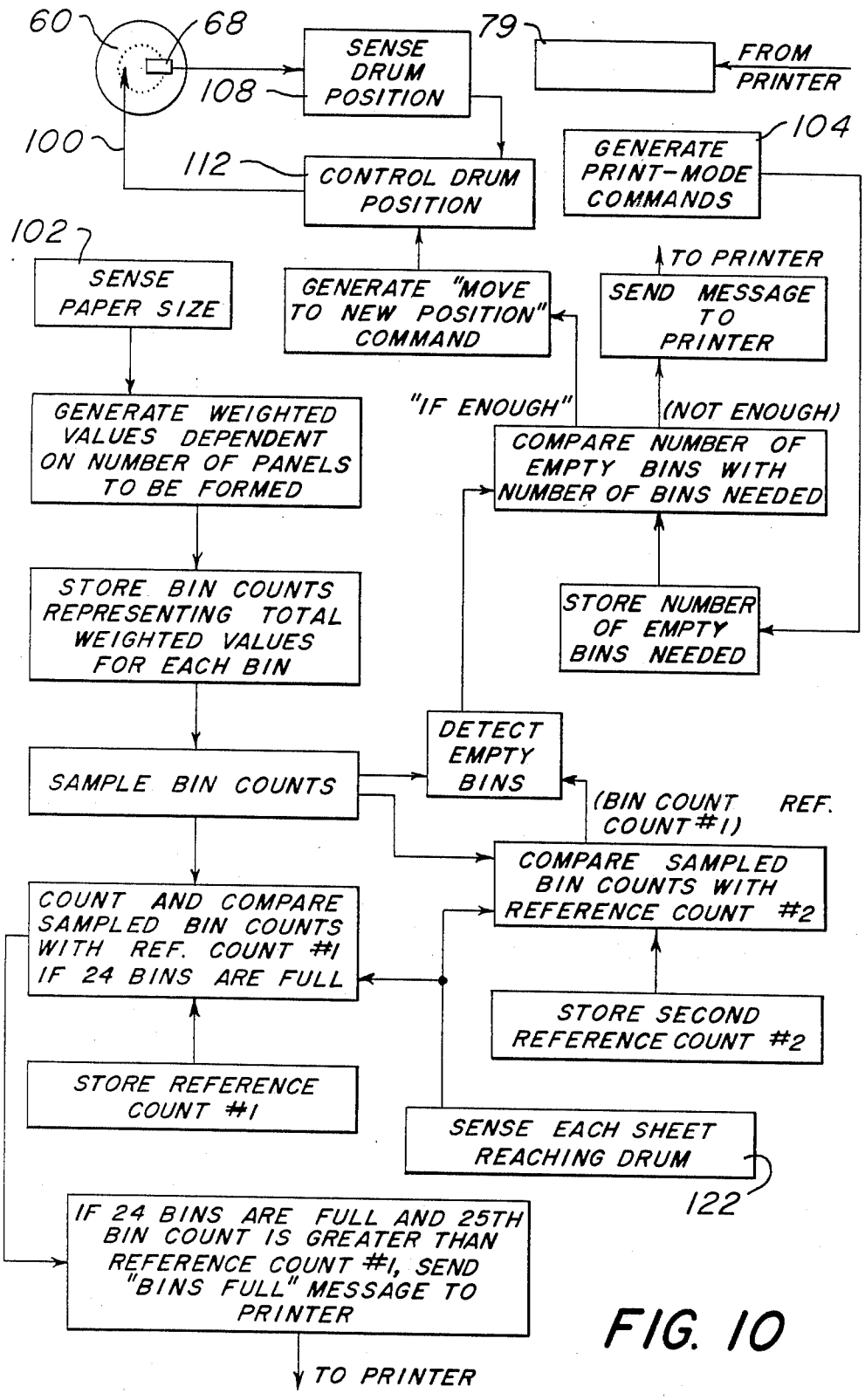
FIG. 10 is a flow diagram illustrating the method of operation of the system of FIG. 1 as it relates to the collator.

A broad flow diagram of the control system for the collator is shown in FIG. 10, which is also equivalently a "hardwire" block diagram, although in this embodiment system operation is preferably implemented and controlled by software in an E-PROM.

Turning now to FIG. 10, the collator drum is represented at 40, with its ring of nuts 60 and its proximity sensor unit 68; control of the direction and extent of motion is indicated by the line 100 shown schematically as acting on the axle of the drum. The previously-described paper size sensor provides the SENSE PAPER SIZE step shown at 102, the printer control panel provides the GENERATE PRINT-MODE COMMAND step shown at 104, and the SENSE DRUM POSITION 108 step is provided by suitable conventional electronics responsive to the output of the sensor unit 68. The CONTROL DRUM POSITION 112 function is performed by the clutch, brake, motor and motor reverse units and associated electronics, responsive to the GENERATE PRINT-MODE COMMAND, SENSE DRUM POSITION, and GENERATE MOVE TO NEW POSITION COMMAND steps to be described hereinafter.

As shown, the result of SENSE PAPER SIZE enables the step indicated as GENERATE WEIGHTED VALUES DEPENDENT ON NO. OF PANELS TO BE FORMED. These weighted values may be as given in Table I above. From these values, the step labelled STORE BIN COUNTS REPRESENTING TOTAL WEIGHTED VALUES FOR EACH BIN is enabled. These stored bin counts are sampled, as indicated by the step labelled SAMPLE BIN COUNTS, and the result of the sampling is used to COMPARE SAMPLED BIN COUNTS WITH REF COUNT #1. The latter reference count is stored for this purpose, as indicated by the step STORE FIRST REFERENCE COUNT #1.

The first reference count #1 is a value such that a bin will be cearly full when it has been supplied with sheets having a total weighted value equal to or slightly greater than the first reference count #1. As shown in FIG. 10, a step is provided designated IF A BIN COUNT IS GREATER THAN REF. COUNT #1, SEND "BINS FULL" SIGNAL TO PRINTER (24 bins are full, 25th bin almost full). This enables the printer to produce a BINS-FULL indication as by lighting a lamp, or sounding an alarm.

In this embodiment of the invention, the occurrence of such a BIN-FULL signal does not mean that the last, 25th bin in question is completely full; there is still some room in the bin for further sheets. In a typical case, there will still be room for three more D size drawing prints, as a margin for safety against over-filling and resultant jamming and destruction of later-arriving sheets.

In this preferred embodiment the remainder of the process shown in FIG. 10 serves to detect the condition of complete fullness of a bin, to provide indications of when this occurs, to search for an available set of empty bins, and to switch the distribution of sheets from the original set of empty bins to a new set of bins if they are available. If such a new set of empty bins is not available, a signal so indicating is sent to the printer.

Referring again to FIG. 10 then, the procedure shown is to STORE SECOND REFERENCE COUNT #2, which count #2 may for example exceed Count #1 by 27 (the weighted bin value for three D-size prints). The next step is COMPARE SAMPLED BIN COUNT WITH REF. COUNT #2; when and if a weighted bin count exceeds reference count #2, a DETECT EMPTY BINS step is performed, acting on the samples resulting from the SAMPLE BIN COUNTS step. The number of available empty bins thus detected is compared with the number needed, by the step designated COMPARE NO. OF EMPTY BINS WITH NO. OF BINS NEEDED; the latter number is obtained by a step designated STORE NO. OF EMPTY BINS NEEDED, which storage is accomplished in response to the print-mode command.

If the number of empty bins is less than the number needed for the collator mode being performed (number of prints exceeds available space in collator), then a SEND MESSAGE TO PRINTER step is performed (Status 5 message), to so notify the printer, which may respond by producing a distinctive visual and/or audible alarm or by automatically shutting off the printer.

If an empty set of bins of sufficient number is detected, then the step GENERATE MOVE TO NEW POSITION command is issued to control the drum position so that it presents a new empty set of bins to receive further distribution of the overflow of sheets which are beyond the capacity of the original set of bins. This operation will repeat if the second set of bins becomes completely filled, and so on until there is no longer a large enough empty set available and the SEND MESSAGE TO PRINTER step so informs the printer.

While the invention may be embodied in relatively simple apparatus and using a relatively simple program, the following will describe a specific embodiment which has actually been constructed. First there will be described the communication modes used in the preferred system and the status messages sent between printer console and collator electronics, then the operation of the programmed system, and finally a specific assembly-language program for the system will be provided.

COMMUNICATIONS MODES

The system operates in any selected one of five different primary communications modes which affect and determine the manner in which the sheets are distributed to the collator, as follows:

MODES OF COMMUNICATION

MODE 1—COLLATE At the printer, the operator operates pushbuttons to select the COLLATE mode, the number of prints to be collated and the number of sets of prints desired. This causes reset of the counters, loads the "number of sets" into a register, and starts the collate action. The first print is distributed to the bin first presented, the next to the next adjacent bin, and so on until the number of sets of prints selected at the printer control panel has been reached (25 maximum in this example). The drum is then indexed automatically in the opposite direction, step by step, placing a second print in each bin until it has returned to its original position. This scanning back and forth continues until an END OF JOB signal from the printer is produced by information inserted at the printer control panel as to how many sheets were to be collated.

MODE 2—STACK At the printer, the operator selects this mode and the number of prints desired per set. This resets the counters, loads the "number of prints per set" into a register, and starts the STACK operation. The system then operates to place the selected number of consecutive prints in the originally-presented bin, then indexes to the next bin, distributes the same number of prints to that bin, and so on until the preselected number of prints/set has been placed in an specified number of bins and an END OF JOB message has been generated and distribution terminated.

MODE 3—COLLECT The operator selects this mode and the total number of prints to be collected, which information is immediately transmitted to the collator electronics. This resets the counters, loads the "total number of prints" into a register, and starts the COLLECT operation. All prints are delivered to the initially-presented bin until it is substantially full, or the selected number of prints, as indicated by the END OF JOB signal, has been received, whichever occurs first. The collator drum will index to the next bin if the manual pushbutton at the collator keypad is operated, or if a FULL BIN, FULL COUNT or END OF JOB message is generated.

MODE 5—SPECIAL By operating a manual input (not shown) at the printer console, the operator may indicate which bin is to receive a print; for this purpose the bins may be visually identified, as by marking them with numbers. The resultant manually-generated data identifying the selected bin are entered into a FIFO (first-in, first-out) buffer at the collator, each print is received by the collator, and its identifying data is removed from the buffer and sent back to the printer as a STATUS 7 message. The printer sends an END OF JOB message to the collator to complete performance of the SPECIAL mode. At this time a STATUS 3 message (END OF JOB) message is sent to the printer. The collator will align Bin #1 with the fOlder paper exit for operator reference of bin locations.

MODE 10—FILL THE BIN This is similar to COLLECT mode, except that it ignores any END OF JOB message, and continues to fill each bin, moving to the next bin when the present bin has been filled. This continues until all bins are full or some other mode is selected. This is the default mode, occurring after a reset, or upon power-up of the system, or when the collator completes all other jobs.

In the preferred embodiment, the collator electronics also checks, when possible, to see that the actual number of prints reaching the collator drum on a specific printing job is the same as the total number of prints produced by the printer for that job. The collator electronics then checks to determine if an END OF JOB message was received; if so, the collator electronics will signal the printer with a STATUS 3 message (END OF JOB) and turn on an alarm buzzer for two seconds, for example, indicating that the job is completed.

The collator will automatically index to the next available empty bin when a job is complete. The inception of a new COLLECT, STACK or COLLATE mode causes automatic indexing to the next empty bin, if the current bin is not empty; as mentioned above, in the COLLATE mode the system checks to see that enough empty bins are available to receive the number of sets of prints which are to be collated.

When completing one mode and beginning another, the collator will treat the bins utilized in the previous mode as "full" bins (i.e. not empty) and as not available to receive additional sheets even though they are not necessarily full physically. However, when the sheets have been removed from the collator by the operator. it will be desirable to use these same bins again. This is enabled by the operator operating the CLEAR button at the collator keypad when the prints have been removed; or, a RESET (MODE 9) message from the printer to the collator will allow all bins to become available to the sheets from the printer.

In addition, there are four other modes, namely modes 4, 7, 8 and 9, which do not directly determine the handling of the sheets by the collator, but enable certain support functions, and which are as follows:

MODE 4—CONTINUE This serves to reset the "collator stopped" bit. More particularly, this mode resets the COLLATOR STOPPED bit B2 in register R2, sets the transmit bit B1 in register R2 and sets bit B6 in the "status" register to indicate COLLATOR RUNNING.

MODE 7—COUNT ONE PRINT This is produced by the printer to indicate that a print is being sent by the printer. A count total is accumulated in a register R5 to keep track of any prints remaining in the portion of the system preceding the collator drum. The contents of the register R5 may then be used as a count checker.

MODE 8—END OF JOB This is sent by the printer immediately after the printer starts its last set of prints of the current job—for example, if the command is "STACK 2", it sends a message when 2 prints are yet to be sent. It is used as a means of terminating one of modes 1–3 or 5. Bit 4 in register R2 is set to signal the collator that the END OF JOB signal has been sent to the collator.

MODE 9—RESET (same as POWER-ON RESET) This occurs in response to turning on of the power for the complete equipment. It clears counters, defines the currently-presented bin as bin #1, and enables the FILL THE BIN MODE 10.

STATUS MESSAGES, COLLATOR TO PRINTER

In the preferred embodiment, any change of status will produce a status message to the printer containing all appropriate information. For example, if a count error occurs at the end of a job, the message will contain STATUS 0 (i.e. COLLATOR STOPPED), STATUS 3 (END OF JOB), and STATUS 4 (COUNT ERROR).

The nine status messages are as follows:

STATUS 0—COLLATOR STOPPED This status is produced no matter why the collator is stopped, as by occurrence of an error condition (such as BINS FULL, JAM or other).

STATUS 1—READY (Bins Empty) This status is set when an operator empties the bins and pushes the CLEAR pushbutton at the collator keypad. It is also set by a RESET MODE 9 message from the printer. The register R2, bit B6 is cleared as soon as a print is received at the collator.

STATUS 2—25 BINS FULL This status is set when the collator determines that there is no empty bin left. It is discussed in more detail at the end of this list of statuses.

STATUS 3—END OF JOB This status is set when the actual number of prints received at the collator drum equals the desired number of prints pertaining to that job and an END OF JOB message has been received from the printer. This status is cleared by sending it to the printer, or by reset (MODE 9).

STATUS 5—QUANTITY ERROR 1 This status is set when the number of prints sent by the printer in MODES 1, 2 or 3 exceeds the available space in the collator or is larger than a predetermined reference quantity. This status is not retained; it causes a message to be sent to the printer, and the printer message which caused the error is obviated or ignored.

STATUS 6—QUANTITY ERROR 2 This status is set if the message representing the number of prints sent by the printer is not a valid ASCII number. This status is not retained; it causes a message to be sent to the printer and causes the message which contained the error to be ignored.

STATUS 7—SPECIAL This status is set to produce a response from the collator indicating that a print sent in the SPECIAL MODE 5 has been received by the collator.

STATUS 8 Not used.

STATUS 9—COLLATOR RUNNING In the absence of any other appropriate status information, this message indicates that the collator system is functioning properly.

Regarding STATUS 2—BINS FULL, if all bins are full a momentary audible alarm is produced and the collator stopped. The occurrence of a BINS-FULL condition in the COLLATE MODE causes the collator automatically to check the bin-count registers for a set of consecutive empty bins large enough in number to receive the number of sets being collated.

Before the collator is completely full, it will monitor the remaining bin space, as well as monitoring the number of prints present in the system pipeline between the printer and the input to the collator drum by comparing the COUNT 1 PRINT total with a count of prints which have entered the collator drum. When the number of prints in the pipeline is sufficient to completely fill the collator, the collator sends a STATUS 2—BINS FULL and a STATUS 0—COLLATOR STOPPED message to the printer; the buzzer alarm will then go on for two seconds. The collator assumes that each print in the pipeline is of maximum thickness, e.g. a D-size print in this embodiment.

COLLATOR MEMORY MAP

FIG. 11 is as schematic memory map showing the address locations, in the MCU RAM, of the stored bytes and bits relating to the principal operations performed by the preferred program listed in detail at the end of this specification. In that drawing, the 8-bit byte locations are specified in the left-hand column by hexadecimal numbers extending from 00 at the bottom to FF at the top. The lowermost group of locations 00H to 07H are for the bytes R0 to R7. R0 and R1 are general purpose registers; R2 (at 02H) is the flag register, the eight bits of which represent the bit information indicated at the right thereof. R3 (at 03H) is another general purpose register. R4 (at 04H) is the GIVEN PRINT COUNT register.

R5 (at 05H) is the register for COUNT 1 PRINT, i.e. the accumulated count of prints leaving the printer. R6 (at 06H) contains the BIN COUNT (the numbers assigned to the bins, i.e. 1 to 25). R7 (at 07H) contains the ACTUAL PRINT COUNT, i.e. the number of prints reaching the collator during the job.

As noted in FIG. 11, when operating in SPECIAL MODE 5, R4 contains the numbers of the bin to which a print is to be supplied.

Memory looations 08H to 17H are the memory storage bytes for the sub-routines and interrupt routine for the microcontroller INTERNAL STACK.

The next set of memory locations 18H to 1FH contains the following: R0′ and R1′ are general-purpose registers; R2′ is the MODE register, storing the number of the selected mode; R3′ is the MESSAGE BUFFER REGISTER; R4′ is the COMMUNICATIONS STATUS REGISTER; R5′ is the PRINT RECEIVER POINTER register; R6′ is the COLLATOR TRANSMIT pointer register; and R7′ is another general purpose register.

R4′ of this group of memory location registers contains the eight bits of information identified at the right of R4′ in FIG. 11, as follows: B0 indicates a PRINTER ORIGINATED MESSAGE, indicating that such message exists; B1 represents FLAG IN INTERRUPT; B2 is not used; B3 represents TRANSMIT IN PROGRESS; B4 represents COLLATOR ORIGINATED MESSAGE; B5 is not used; B6 represents CHARACTER ECHOED COMPLETE; and B7 represents TRANSMIT ECHO ERROR. These bits of R4′ are primarily for conventional housekeeping with respect to handling of serial communications between collator and printer.

Bytes 20H to 30H are for the storage of printer-originated messages, and bytes 30H to 40H for the storage of collator-originated messages.

41H to 59H include 25 locations for the weighted bin values for bins 1–25 respectively.

5AH to 9AH comprise 64 locations used for general RAM, including a byte at 7CH where the following message flags are located: B0=BINS FULL, indicating that there are no empty bins available; B1=END OF JOB. B3 is QUANTITY ERROR #1, B4 is QUANTITY ERROR #2, and B6 is COLLATOR RUNNING, all explained elsewhere herein. B5 is a SPECIAL bit indicating that a STATUS 7 message to printer is required.

Locations 9BH to CEH inclusive are locations for information used in MODE 5—SPECIAL.

DETAILS OF PROGRAMMED OPERATIONS

The preferred programming for the system responds to two basic events; the first is a message or messages from the printer electronics requesting action by the collator electronics. The handling of such requests is designated as MODE HANDLING. The other basic event is a signal indicating that a sheet is entering the collator from the folder, which triggers the action in response to the printer request, except for the Default MODE 10 which occurs automatically upon power-up of the equipment. When a printing job is initiated, an empty bin confronts the folder output, so that no special action is necessary for this first sheet. However, when the first sheet enters the collator, PS14 provides a signal indicating this and, if necessary, initiates action to position the collator drum properly to receive the next sheet, and so on for subsequent sheets. This action, triggered by each sheet entering the collator drum, is designated as MODE APPLICATION.

Figure 12:
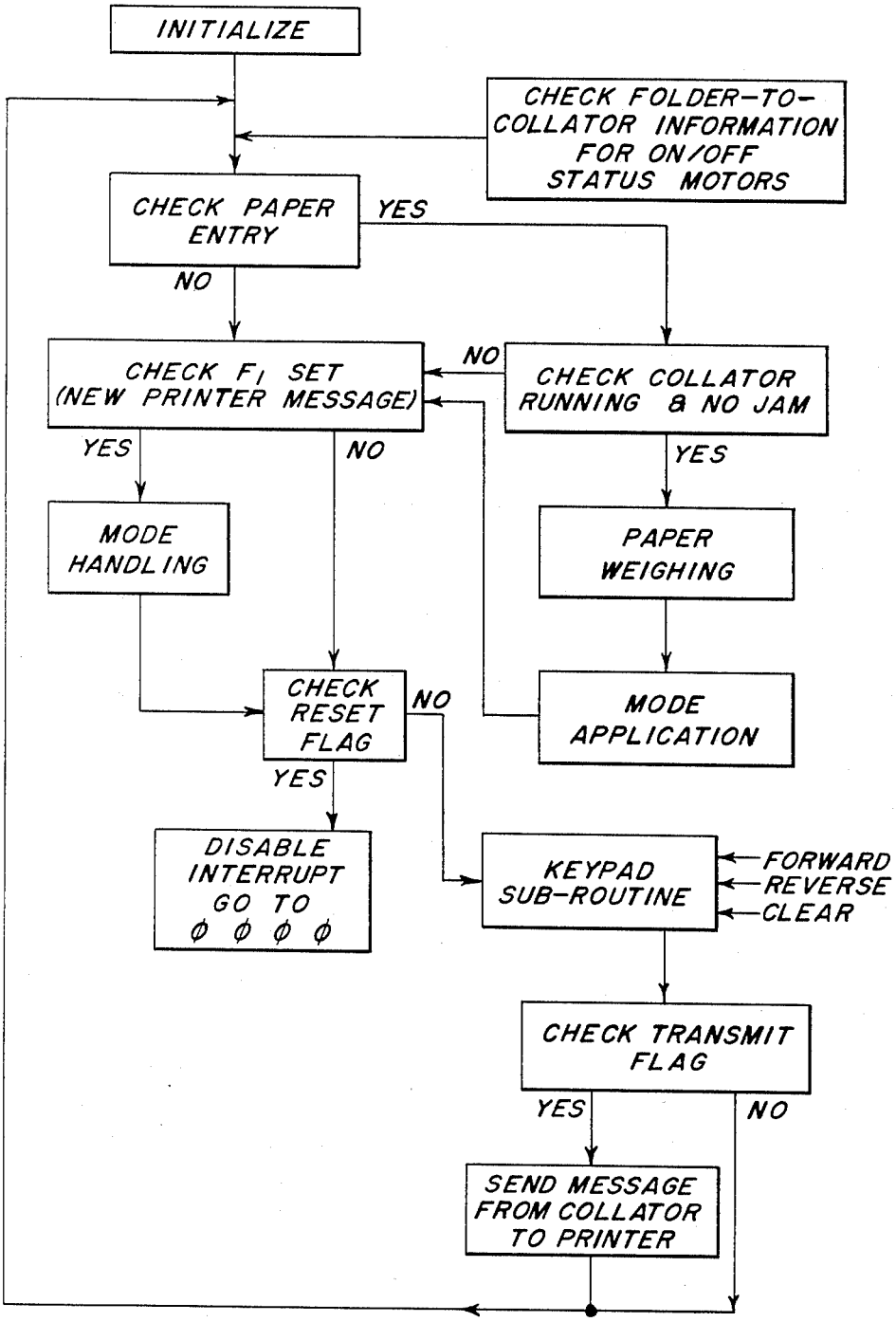
FIG. 12 is a flow diagram for the main loop of the preferred program for the collator electronics.

Before considering the MODE HANDLING and MODE APPLICATION operations per se, the main programmed loop will be considered briefly; it does not do any real, physical or detailed work. Basically, it is as shown in the flow diagram of FIG. 12.

As will be seen from that Figure, following initialization the system operates to check whether its motor should be on or off and then checks paper entry into the drum. If the result is a YES, the system checks whether the collator is running and there is no paper jam; if "YES", the system enters the MODE APPLICATION cycle, described in detail hereinafter; at the end of MODE APPLICATION the system returns to CHECK F1 SET. If the collator is not running or there is a jam, the system goes directly to CHECK Fl SET, and does not enter MODE APPLICATION.

If CHECK PAPER ENTRY shows no sheet at the entrance to the collator drum (a NO), the system goes directly to CHECK F1 SET, which is a flag internal to the MCU but available to the programmer, indicating a new message from the printer. If this flag is set, the system enters its MODE HANDLING sequence, described hereinafter. When MODE HANDLING is complete, the system checks for a RESET flag (Bit 5, R2 at 01H of the collator memory map). If the F1 flag is not set, the system bypasses MODE HANDLING and goes directly to CHECK RESET FLAG.

If the RESET flag is set, the system disables its interrupt and jumps directly to the very beginning of the program, prior to INITIALIZATION, and the cycle repeats. However, if the RESET flag is not set, the system calls up a keypad sub-routine, which determines whether Forward, Reverse or Clear buttons have been depressed at the collator keypad and performs the selected function, if any.

The system then proceeds to determine whether the TRANSMIT flag is set. If not, the program goes to the beginning of the main loop, just prior to CHECK PAPER ENTRY; if the TRANSMIT flag is set, a message stored in a buffer will be sent from collator to printer, after which the system returns to CHECK MOTOR STATUS.

MODE APPLICATION—"NON-PAPER" MODES

The MODE APPLICATION process responds to MODE 4—CONTINUE, MODE 7—COUNT ONE PRINT, MODE 8—END OF JOB and MODE 9—RESET, which do not directly determine how the sheets are distributed into the collator; for this reason they are designated as "non-paper" modes and operate as follows:

MODE 4—CONTINUE resets the "collator stopped" bit, B2, in register R2, sets the transmit bit B1, in register R2, and sets bit B6 in the "status" register to indicate the "collator is running". No other pointers or registers are altered.

MODE 7—COUNT ONE PRINT is sent from the printer every time a print of any size leaves the printer. Therefore, the collator uses a register, specifically R5 at 05H of the memory map, to count the number of "COUNT ONE PRINT" messages received pertaining to a specific mode (paper mode). R5 is then used as a count checker.

MODE 8—END OF JOB message is sent from the printer after however many "COUNT ONE PRINT" messages have been sent from the printer. It is used as a means of termination of one of the paper application modes as described later. Bit B4 in register R2 (at 02H) is set to signal the collator that the "END OF JOB" message has been sent to the collator.

MODE 9—RESET message also sets a bit in this same register R2, specifically B5. This flag is looked at only in the main loop routine. No other pointers or registers are altered.

The so-called "paper" MODES 1, 2, 3 and 5 which directly control the nature of the distribution of the sheets to the collator drum operate generally as follows:

MODE 1—COLLATE also receives the number of sets of prints in its message from the printer, representing the number of sets to be formed. The collator system software first checks to see if the number of sets of prints is greater than 25. If it is greater than 25 an error exists since there are only 25 possible bins in which to place paper. Bit B4 of the "STATUS" register (at 7CH) is then set to indicate a "QUANTITY TWO ERROR", as is bit B6 ("COLLATOR RUNNING"): the default mode 10 is in operation and bit B1 in register R2 is set to "TRANSMIT MESSAGE". If the number of sets of prints is 25 or less, the system software then checks to see if there is a set of consecutive empty bins equal to the number of sets of prints received in the message. If this cannot be done, bit B3 of the "STATUS" register is set indicating a "QUANTITY ONE ERROR" and so is B6. Again bit B1 in register R2 is set, and the default mode 10 is placed in operation. If there are a set of consecutive empty bins available equal to the number of sets of prints, the software will enable the collator drum clutch to advance the collator drum in the forward direction until the first empty bin of the set is aligned with the drum slot or paper opening and then will disable the clutch and enable the brake. Several registers are then reset, namely: R5—COUNT ONE PRINT and R7—ACTUAL PRINT COUNT.

Some registers are preset, namely:

R2—Bit B6, BINS EMPTY, remains as it was, all other bits are reset.

FLAGS—(same as "STATUS" register), Bit B6, "COLLATOR RUNNING", set, all other bits reset.

R6—equals BIN COUNT or number

R4—equals number of sets of prints

R2'—(' indicates register bank 1, RB1) equals the mode (Fill Bin, Collate, Stack, Collect or Special—in this case, Collate).

MODE 2—STACK receives the number of prints/-set in its message from the printer. The first topic to be addressed by the collator system software is the availability of 1 empty bin. If 1 empty bin cannot be found, bits B6 and B3 in the "STATUS" register are set indicating "COLLATOR RUNNING" and "QUANTITY ONE ERROR", respectively. Also bit B1 of register R2 is set to "TRANSMIT MESSAGE", and mode 10 is placed in operation. If an empty bin is available, the software enables the clutch and advances the collator in the forward direction until the slot or paper opening is aligned with the first available empty bin. The clutch is then disabled and the brake enabled. The registers affected in MODE 1—COLLATE are also affected in MODE 2—STACK in the exact same fashion, except that R4 now represents prints per set.

MODE 3—COLLECT receives the total number of prints to be printed, instead of the number of prints/sets, in its message as compared to MODE 2. However, as far as MODE HANDLING is concerned, MODE 3 is identical to MODE 2 except that the "total number of prints" is placed in register R4.

MODE 5—SPECIAL is unique in that a specific bin number is sent within the message from the printer (as paper enters the collator the software will reposition the collator to the next bin specified in the special message). MODE HANDLING of the SPECIAL mode begins by checking to see if the bin number specified in the message is less than or equal to 25, since there are only 25 bins on the collator. A value greater than 25 results in a "QUANTITY TWO ERROR", bit B4 being set along with B5, and "SPECIAL" being set in the "STATUS" register. Also, bit B1 of register R2 is set to "TRANSMIT MESSAGE". If the bin number is valid, a check is then made to determine whether or not the bin is full. If the bin is full, bits B6 "COLLATOR RUNNING", and B3 "QUANTITY ONE ERROR" are set in the "STATUS" register. Also, bit B1 of register R2 is set to indicate "TRANSMIT MESSAGE". If the specified bin is not full, the collator system software then determines whether or not this is the first message in MODE 5. If it is, two pointers are set equal to each other. These pointers are utilized to keep track of consecutive MODE 5 messages. In all likelihood there will exist many more MODE 5 messages than there will MODE 5 prints in the collator. For this reason, one of the two pointers will point to the last bin number sent in the MODE 5 messages while the other pointer will point to the bin number in which the collator has received print while in MODE 5. This rationale makes it clear that one pointer will be incremented each time a MODE 5 message is received while the other pointer is incremented each time a MODE 5 print is received (until the job is completed). If this message is the first or only MODE 5 message and the bin is not full, the software will determine the shortest distance to rotate the collator to align the desired bin number and move the collator in the correct direction to the desired bin number; this also occurs with subsequent special messages. Bit B7 of register R2 is set to indicate "MODE 5". Also bit B0 of the "STATUS" register is reset ("BINS FULL") since a bin was found not to be full. No other pointers or registers are altered.

MODE 10—FILL THE BIN is the default mode which is in operation on power-up, and after error conditions described above are found, and after all other jobs are completed.

MODE APPLICATION—"PAPER" MODES

Prior to describing the various "paper" modes in detail, some data manipulation which has to be performed by the collator system software will be described. Once paper enters the collator the weighted value of the paper is added to the total weight of the specific bin. This weighted value of the bin is then compared to a predetermined value which is exactly 3 D size prints less than a full bin if 24 bins are full; otherwise this weighted value of the bin is compared to a second predetermined value which represents a full bin.

MODE 1—COLLATE starts by determining whether or not the motor direction is forward or reverse. If the direction is forward then "DIRECTION COUNTER" register, initially cleared to zero, is incremented. A comparison is then made between the "DIRECTION COUNTER" register and R4, which contains the number of sets of prints. If these two registers are not equal the bin number register R6 is incremented and the motor moves the collator one bin position in the forward direction before returning to the main loop. If the "DIRECTION COUNTER" register and R4 are found to be equal then R7, actual print count register, is reset to zero, the "MULTIPLE" register is incremented, initially cleared to zero, a check is then made to determine if an "END OF JOB" message has been received. If it has, a comparison is made to determine if the total number of prints received by the collator pertaining to the COLLATE mode is equal to the expected number of prints to be received. If this is also true, then the alarm buzzer is turned on for two seconds, the "DIRECTION COUNTER" and "MULTIPLE" registers are reset, and all used bins are recognized as full bins.

Following the same scenario but with the "END OF JOB" message not received, the determination is then made to see if the bin is full. If it is not full, the motor direction is opposite of what it was previously. and then a return is made to the main loop. If the bin was found to be full, the "DIRECTION COUNTER" register is reset and a search is made to find a second set of bins.

If the motor direction was found to be reverse (implies that collator has already received a set of prints due to initialization routine which places motor in forward direction), then a check is made to determine if the "DIRECTION COUNTER" register is equal to zero. If it is not equal to zero (starting bin in collate mode), then R6, bin number register, is decremented and the collator reversed one bin position. If "DIRECTION COUNTER" register is equal to zero then the flow follows the same as if the "DIRECTION COUNTER" register had equalled R4 above.

MODE 2—STACK application software is only utilized when the "ACTUAL PRINT COUNT" register, R7, becomes equal to the "GIVEN PRINTS/SET COUNT" register R4. R7 is then reset and the "MULTIPLE" register is incremented. A check is then made to determine if an "END OF JOB" message has been received. If it has been received, a check is then made to determine if R4 times the "MULTIPLE" register will equal the total number of prints expected to be received by the collator for stack mode. If this comparison is not equal, the collator will move in the forward direction to the first available empty bin. A return to the main loop is then performed. If all the prints expected to be received by the collator were in fact received, then the job is considered to be finished. The alarm buzzer goes on for two seconds, the "MULTIPLE" register is reset to zero, bits B1 of register R2 are set to transmit a message, and the bins used are considered to be full and a return to the main loop is performed.

MODE 3—COLLECT is very similar to STACK and uses the exact same software routines. The significant difference here is that the collator does not expect the "MULTIPLE" register to ever become greater than one, due to the definition of COLLECT. Therefore, there exists no need for the collator to search for additional empty bins unless the bin becomes physically full.

MODE 5—SPECIAL must first prepare to transmit a message to the printer indicating that a "SPECIAL" print has been received. This message also includes the bin number in which the print was inserted. Once this is completed the collator system software checks to see if the two pointers mentioned in MODE HANDLING "SPECIAL" mode are equal to one another, and if they are, a check is then made to see if an END OF JOB message has been received. If an END OF JOB has not been received, it is assumed that more SPECIAL messages are yet to come and therefore nothing is yet altered. If the two buffers are not equal to one another, the collator system software gets the next bin number in the buffer referenced by one of the pointers in which the next MODE 5 print should be placed, at the same time incrementing that pointer. The shortest route to this bin is determined, the motor direction is then determined, and the clutch is enabled until the particular bin is aligned with the paper slot, at which time the clutch is disabled and the brake enabled. Once the two pointers become equal and an END OF JOB message has been received, then the job is considered complete. The two pointers are then reset, all MODE 5—SPECIAL bin numbers used are considered full bins, bit B1 of R2 is set (TRANSMIT MESSAGE), the motor direction bit B0 is left intact, and bits B2–B7 are all reset in register R2. Bits B1, B5, and B6 are all set in the "status" register. They are END OF JOB, SPECIAL and COLLATOR RUNNING, respectively. The alarm buzzer is then turned on for a short period of time (approximately two seconds) and then turned off. No other registers or pointers are altered.

Serial communications between the collator and printer need not be described in detail here. However, it should be pointed out that an interrupt will occur whenever the collator UART (Universal Asynchronous Receiver Transmitter) receives a character. The collator system software is set up so that it can determine whether or not the character received is from a message that the printer is originating or an echoed character from a message that the collator had originated.

A specific listing of a computer program preferred for accomplishing the foregoing operation is provided below.

It is in asssembly language MCS-48, designed by Intel Corp. (see INTEL MICRO-CONTROLLER HANDBOOK, 1986, Chapter 14). The left-hand column indicates the E-PROM memory addresses; the second column indicates the hexadecimal encoding of operator and argument; the third column indicates the label field; the fourth column indicates the operator field; the fifth column shows the operator arguments; and the sixth field is the comment field.

```
AVOCET SYSTEMS 8048 CROSS-ASSEMBLER -  VERSION 1.62
```

COPYRIGHT 1987 R. FUNK & CO.,INC.
ALL RIGHTS RESERVED.

```
SOURCE FILE NAME: SPCL11.ASM

03FC                        ORG     $3FC
03FC 2AFF0D0A               DB      $2A,$FF,$0D,$0A
0060            TOGPTR      EQU     $60
0061            ACCUM       EQU     $61
0078            DIRCTR      EQU     $78
0077            MULT        EQU     $77
0070            SPECBIN     EQU     $70
007C            FLAGS       EQU     $7C
0079            R1REG       EQU     $79
009C            MXWTDF      EQU     $9C
00B1            DWTD1F      EQU     $B1
0001            A           EQU     $01
0002            B           EQU     $02
0003            C           EQU     $03
0004            D           EQU     $04
0063            HDPTR       EQU     $63
0064            APPTR       EQU     $64
0065            ECHO        EQU     $65
0062            HDPTR1      EQU     $62
007E            BYTES       EQU     $7E
0080            PAPE        EQU     $80
```

```
0081            KEY       EQU      $81
0400
0400
0400
0400
0082            KEEPER    EQU      $82
0083            FLAG3     EQU      $83
0084            NMDCNT    EQU      $84
0400
0086            DATSUM    EQU      $86
0087            FINSUM    EQU      $87
0085            CUSTODY   EQU      $85
00BF            BUFF1     EQU      $BF
00FA            EMPBIN    EQU      $FA
0089            ACTSUM    EQU      $89
008A            CNT       EQU      $8A
008B            CNT1      EQU      $8B
008C            CNT2      EQU      $8C
00E0            NMDBUF    EQU      $E0
00E1            NMBUF1    EQU      $E1
00E3            NMBUF2    EQU      $E3
0088            STKBIN    EQU      $88
0097            EOJREG    EQU      $97
0096            ACC1      EQU      $96
0400
00FE            BLUF1     EQU      $FE
00FF            BLUF2     EQU      $FF
00FD            BLUF      EQU      $FD
00FC            R2REG     EQU      $FC
0400
00FB            R3REG     EQU      $FB
00D0            CNTBF     EQU      $D0
00D1            CNTBF1    EQU      $D1
00D2            CNTBF2    EQU      $D2
00F0            CONSEC    EQU      $F0
00F1            CRDSRT    EQU      $F1
0000                      ORG      $00
0000 0405       START:    JMP      INT
0003                      ORG      $03
0003 E408                 JMP      INTRPT
0005                      ORG      $05
0005 0A         INT:      IN       A,P2
0006 53F0                 ANL      A,#$F0
0008 3A                   OUTL     P2,A
0009 37                   CPL      A
000A B210                 JB5      HOP6
000C F5                   SEL      MB1
000D 3400                 CALL     TOGGLE
000F E5                   SEL      MB0
0010 2390       HOP6:     MOV      A,#$90
0012 3A                   OUTL     P2,A
0013
0013 2387                 MOV      A,#$87
```

```
0015
0015 39                 OUTL    P1,A

0016 2300               MOV     A,#$00
0018 BA40               MOV     R2,#$40
001A AC                 MOV     R4,A
001B AD                 MOV     R5,A
001C AF                 MOV     R7,A
001D BE01               MOV     R6,#$01
001F D5                 SEL     RB1
0020 BA0A               MOV     R2,#$0A
0022 AB                 MOV     R3,A
0023 AC                 MOV     R4,A
0024 BD20               MOV     R5,#$20
0026 BE30               MOV     R6,#$30
0028 AF                 MOV     R7,A
0029 C5                 SEL     RB0
002A BBE0               MOV     R3,#$E0
002C B820               MOV     R0,#$20
002E A0         MEM:    MOV     @R0,A
002F 18                 INC     R0
0030 EB2E               DJNZ    R3,MEM

0032 B8BF               MOV     R0,#BUFF1

0034 B0C0               MOV     @R0,#$C0
0036 B864               MOV     R0,#APPTR
0038 B099               MOV     @R0,#$99
003A B862               MOV     R0,#HDPTR1
003C B0D9               MOV     @R0,#$D9

003E F5                 SEL     MB1
003F 1400               CALL    STATUS
0041
0041 E5                 SEL     MB0

0042 BB01               MOV     R3,#$01
0044 F5                 SEL     MB1
0045 343E               CALL    MOTOR
0047 E5                 SEL     MB0

0048
0048 D4B0               CALL    UART
004A

004A 05                 EN      I

004B 09         MNLOOP: IN      A,P1
004C 5307               ANL     A,#$07
004E C674               JZ      FLAG1
0050 AB                 MOV     R3,A
0051
0051 D305               XRL     A,#$05
0053 C666               JZ      MOFF

0055 B881               MOV     R0,#KEY
0057 F0                 MOV     A,@R0
0058 537F               ANL     A,#$7F
```

```
005A A0                 MOV     @R0,A
005B

005B 0A                 IN      A,P2
005C 5340               ANL     A,#$40
005E 9670               JNZ     PAPPY
0060 0A                 IN      A,P2
0061 4340               ORL     A,#$40
0063 3A                 OUTL    P2,A
0064 0470               JMP     PAPPY

0066 B881       MOFF:   MOV     R0,#KEY

0068 F0                 MOV     A,@R0
0069 4380               ORL     A,#$80
006B A0                 MOV     @R0,A
006C

006C 0A                 IN      A,P2
006D 53BF               ANL     A,#$BF
006F 3A                 OUTL    P2,A
0070
0070 5674       PAPPY:  JT1     FLAG1
0072 2400               JMP     PAPER
0074 7698       FLAG1:  JF1     MESS1
0076 C5         RES1:   SEL     RB0
0077 FA                 MOV     A,R2
0078 B29A               JB5     RES


007A
007A
007A
007A
007A 00                 NOP
007B
007B
007B


007B C4A0               JMP     KEYSUB
007D FA         KEYRET: MOV     A,R2
007E 37                 CPL     A
007F D287               JB6     SKIPTWN
0081 15                 DIS     I
0082 F5                 SEL     MB1
0083 1400               CALL    STATUS
0085 E5                 SEL     MB0
0086 05                 EN      I

0087 B883       SKIPTWN:MOV     R0,#FLAG3
0089 F0                 MOV     A,@R0
008A 328E               JB1     RESFG3
008C 0493               JMP     DOWN
```

```
008E 53FC      RESFG3: ANL     A,#$FC
0090 A0                MOV     @R0,A
0091 049D              JMP     XMIT


0093 FA        DOWN:   MOV     A,R2

0094 329D              JB1     XMIT
0096 044B              JMP     MNLOOP

0098 44F0      MESS1:  JMP     MESS


009A 15        RES:    DIS     I
009B 0400              JMP     START


009D D5        XMIT:   SEL     RB1
009E FC                MOV     A,R4
009F 12C0              JB0     OUT1
00A1

00A1 72DC              JB3     XMIT1
00A3 4308              ORL     A,#$08
00A5 AC                MOV     R4,A


00A6 BE30              MOV     R6,#$30
00A8 B800      TAGN:   MOV     R0,#$00
00AA B901              MOV     R1,#$01
00AC 81                MOVX    A,@R1
00AD 52B1              JB2     TEMPTY
00AF 04A8              JMP     TAGN
00B1 FE        TEMPTY: MOV     A,R6
00B2 A9                MOV     R1,A
00B3 F1                MOV     A,@R1
00B4 D3FF              XRL     A,#$FF
00B6 C6C3              JZ      OUT2
00B8 FC                MOV     A,R4
```

```
00B9 12C0                JB0     OUT1
00BB 4310                ORL     A,#$10
00BD AC                  MOV     R4,A
00BE F1                  MOV     A,@R1

00BF 90                  MOVX    @R0,A
00C0 C5          OUT1:   SEL     RB0
00C1 044B                JMP     MNLOOP


00C3 BE30        OUT2:   MOV     R6,#$30


00C5 FC                  MOV     A,R4
00C6 53E7                ANL     A,#$E7
00C8 AC                  MOV     R4,A


00C9 C5                  SEL     RB0
00CA FA                  MOV     A,R2
00CB 53FD                ANL     A,#$FD
00CD AA                  MOV     R2,A
00CE B87C                MOV     R0,#FLAGS
00D0 F0                  MOV     A,@R0
00D1 53C1                ANL     A,#$C1
00D3 A0                  MOV     @R0,A
00D4 15                  DIS     I
00D5 F5                  SEL     MB1
00D6 1400                CALL    STATUS
00D8 E5                  SEL     MB0
00D9 05                  EN      I

00DA 04C0                JMP     OUT1
00DC
00DC D2E0        XMIT1:  JB6     ECODUN
00DE 04C0                JMP     OUT1
00E0 53BF        ECODUN: ANL     A,#$BF
00E2 AC                  MOV     R4,A
00E3 F2E6                JB7     ECHER
00E5 1E                  INC     R6
00E6 FC          ECHER:  MOV     A,R4
00E7 537F                ANL     A,#$7F
00E9 AC                  MOV     R4,A
00EA 04A8                JMP     TAGN

0100                     ORG     $100
0100 B880        PAPER:  MOV     R0,#PAPE
0102 FB                  MOV     A,R3
0103 A0                  MOV     @R0,A
0104 FA                  MOV     A,R2
0105 37                  CPL     A
0106 520A                JB2     BYP2
0108 0474                JMP     FLAG1
010A B8FF        BYP2:   MOV     R0,#$FF
010C B904                MOV     R1,#$04
```

```
010E 561C      WAIT:   JT1     NOISE
0110
0110 E80E              DJNZ    R0,WAIT
0112 E90E              DJNZ    R1,WAIT
0114 B8FF              MOV     R0,#$FF
0116 B9FF              MOV     R1,#$FF
0118 BB01              MOV     R3,#$01

011A 241E              JMP     WAIT1

011C 0474      NOISE:  JMP     FLAG1

011E 562C      WAIT1:  JT1     HANG
0120 E81E              DJNZ    R0,WAIT1
0122 E91E              DJNZ    R1,WAIT1
0124 EB1E              DJNZ    R3,WAIT1
0126
0126 F5                SEL     MB1
0127 14A8              CALL    JAM
0129 E5                SEL     MB0
012A 0474              JMP     FLAG1


012C F5        HANG:   SEL     MB1
012D 9481              CALL    DLY
012F E5                SEL     MB0
0130 FA                MOV     A,R2
0131 D235              JB6     CLERE
0133 2444              JMP     HERE
0135 53BF      CLERE:  ANL     A,#$BF
0137 AA                MOV     R2,A
0138 B97C              MOV     R1,#FLAGS
013A F1                MOV     A,@R1
013B 4340              ORL     A,#$40
013D A1                MOV     @R1,A
013E 15                DIS     I
013F F5                SEL     MB1

0140 1400              CALL    STATUS
0142 E5                SEL     MB0
0143 05                EN      I
0144 FE        HERE:   MOV     A,R6
0145 4340              ORL     A,#$40
0147 A9                MOV     R1,A
0148 F1                MOV     A,@R1
0149 D3FF              XRL     A,#$FF


014B 9651              JNZ     BREAK1
014D 97                CLR     C
014E A7                CPL     C
014F 24AF              JMP     BREAK2
```

```
0151 F5          BREAK1: SEL     MB1
0152 94A4                CALL    WEIGHT
0154 E5                  SEL     MB0


0155

0155 FE                  MOV     A,R6
0156 4340                ORL     A,#$40
0158 A9                  MOV     R1,A
0159 D359                XRL     A,#$59
015B 965F                JNZ     SKIP0
015D B940                MOV     R1,#$40
015F 19          SKIP0:  INC     R1
0160 BB18                MOV     R3,#$18
0162 F1          SKIP2:  MOV     A,@R1
0163 D3FF                XRL     A,#$FF
0165 9692                JNZ     BREAK0
0167 19                  INC     R1
0168 F9                  MOV     A,R1
0169 D35A                XRL     A,#$5A
016B 966F                JNZ     SKIP1
016D B941                MOV     R1,#$41
016F EB62        SKIP1:  DJNZ    R3,SKIP2
0171 F8                  MOV     A,R0
0172 97                  CLR     C
0173 03B1                ADD     A,#DWTDIF
0175 F69A                JC      SKIP4
0177
0177
0177 97          SKIP3:  CLR     C
0178 F5                  SEL     MB1
0179 949E                CALL    GETMOD
017B E5                  SEL     MB0
017C D30A                XRL     A,#$0A
017E C692                JZ      BREAK0
0180

0180 FC                  MOV     A,R4
0181 53FC                ANL     A,#$FC
0183 C69A                JZ      SKIP4
0185 FF                  MOV     A,R7
0186 AB                  MOV     R3,A
0187 1B                  INC     R3
0188 FC                  MOV     A,R4
0189 07          SKIP5:  DEC     A
018A EB89                DJNZ    R3,SKIP5
018C F29A                JB7     SKIP4
018E 53FC                ANL     A,#$FC
0190 C69A                JZ      SKIP4


0192 F8          BREAK0: MOV     A,R0

0193
```

```
0193 97                 CLR     C
0194 039C               ADD     A,#MXWTDF
0196 F6AF               JC      BREAK2
0198 24BA               JMP     MODE

019A 97         SKIP4:  CLR     C
019B 15                 DIS     I
019C D5                 SEL     RB1
019D B97C               MOV     R1,#FLAGS
019F F1                 MOV     A,@R1
01A0 4301               ORL     A,#$01
01A2 A1                 MOV     @R1,A
01A3 C5                 SEL     RB0
01A4 05                 EN      I
01A5 FA                 MOV     A,R2
01A6 4302               ORL     A,#$02
01A8 AA                 MOV     R2,A
01A9 15                 DIS     I
01AA F5                 SEL     MB1
01AB 1400               CALL    STATUS
01AD E5                 SEL     MB0
01AE 05                 EN      I

01AF
01AF FA         BREAK2: MOV     A,R2
01B0 53F7               ANL     A,#$F7
01B2 AA                 MOV     R2,A
01B3 E6BA               JNC     MODE
01B5 B1FF               MOV     @R1,#$FF
01B7 4308               ORL     A,#$08
01B9 AA                 MOV     R2,A
01BA F5         MODE:   SEL     MB1

01BB 949E               CALL    GETMOD
01BD E5                 SEL     MB0
01BE A8                 MOV     R0,A
01BF 1F                 INC     R7
01C0 D335               XRL     A,#$35
01C2 C6C6               JZ      FIVER
01C4 24FC               JMP     UPOVR


01C6 00         FIVER:  NOP
01C7
01C7 0474               JMP     FLAG1


01FC                    ORG     $01FC
```

```
01FC F8          UPOVR:  MOV     A,R0
01FD D331                XRL     A,#$31
01FF 9603                JNZ     NOMDE1
0201 4463                JMP     MDE1
0203 FF          NOMDE1: MOV     A,R7
0204 DC                  XRL     A,R4
0205 C61B                JZ      EQUAL
0207
0207 FA                  MOV     A,R2
0208 720C                JB3     FULL

020A 0474                JMP     FLAG1
020C F5          FULL:   SEL     MB1
020D 346A                CALL    HEFTY
020F E5                  SEL     MB0
0210 B9FA                MOV     R1,#EMPBIN
0212 F1                  MOV     A,@R1
0213 C619                JZ      HOP10

0215 F5                  SEL     MB1
0216 F400                CALL    SEARCH
0218 E5                  SEL     MB0

0219 0474        HOP10:  JMP     FLAG1

021B BF00        EQUAL:  MOV     R7,#$00

021D F8                  MOV     A,R0
021E D333                XRL     A,#$33
0220 C627                JZ      MODE3
```

```
0222 B883                MOV     R0,#FLAG3
0224 F0                  MOV     A,@R0
0225 72D3                JB3     STOPROG

0227 B877        MODE3:  MOV     R0,#MULT
0229 10                  INC     @R0
022A F0                  MOV     A,@R0
022B 07                  DEC     A
022C 9653                JNZ     ADD
022E FA                  MOV     A,R2
022F 37                  CPL     A
0230 9238                JB4     IHOP
0232 FC                  MOV     A,R4
0233 B887                MOV     R0,#FINSUM
0235 D0                  XRL     A,@R0
0236 C647                JZ      CALLO
0238 F5          IHOP:   SEL     MB1
0239 346A                CALL    HEFTY
023B
```

```
023B E5                 SEL     MB0
023C B9FA               MOV     R1,#EMPBIN
023E F1                 MOV     A,@R1
023F C645               JZ      HOME
0241 F5                 SEL     MB1
0242 F400               CALL    SEARCH

0244 E5                 SEL     MB0
0245 0474       HOME:   JMP     FLAG1

0247 FE         CALLO:  MOV     A,R6
0248 4340               ORL     A,#$40
024A A8                 MOV     R0,A
024B B0FF               MOV     @R0,#$FF

024D F5                 SEL     MB1
024E 5401               CALL    OVER2
0250 E5                 SEL     MB0
0251 0474               JMP     FLAG1

0253 AB         ADD:    MOV     R3,A
0254 FA                 MOV     A,R2

0255 37                 CPL     A
0256 9238               JB4     IHOP
0258 FC                 MOV     A,R4
0259 6C         AGN4:   ADD     A,R4
025A EB59               DJNZ    R3,AGN4
025C B887               MOV     R0,#FINSUM
025E D0                 XRL     A,@R0
025F C647               JZ      CALLO
0261 4438               JMP     IHOP


0263 BB01       MDE1:   MOV     R3,#$01
0265 FA                 MOV     A,R2
0266 127D               JB0     REVER
0268 B978               MOV     R1,#DIRCTR
026A 11                 INC     @R1
026B FC                 MOV     A,R4
026C D1                 XRL     A,@R1
026D C68C               JZ      LOOKOUT
026F 1E                 INC     R6
0270 FE                 MOV     A,R6
0271 D31A               XRL     A,#$1A
0273 9677               JNZ     ARND3
0275 BE01               MOV     R6,#$01
0277 F5         ARND3:  SEL     MB1
0278 343E               CALL    MOTOR
027A E5                 SEL     MB0
027B 0474               JMP     FLAG1
```

```
027D B978      REVER:   MOV     R1,#DIRCTR
027F F1                 MOV     A,@R1
0280 07                 DEC     A,
0281 A1                 MOV     @R1,A
0282 C68C               JZ      LOOKOUT
0284 CE                 DEC     R6
0285 FE                 MOV     A,R6
0286 968A               JNZ     ARND4
0288 BE19               MOV     R6,#$19
028A 4477      ARND4:   JMP     ARND3

028C BF00      LOOKOUT:MOV      R7,#$00

028E B977               MOV     R1,#MULT
0290 11                 INC     @R1

0291 FA                 MOV     A,R2
0292 37                 CPL     A
0293 92A6               JB4     SPMOD

0295 F1                 MOV     A,@R1
0296 07                 DEC     A
0297 969C               JNZ     BYPASS
0299 FC                 MOV     A,R4
029A 44A1               JMP     COMPAR
029C A8        BYPASS:  MOV     R0,A
029D FC                 MOV     A,R4
029E 6C        DONOW:   ADD     A,R4
029F E89E               DJNZ    R0,DONOW
02A1 B987      COMPAR:  MOV     R1,#FINSUM
02A3 D1                 XRL     A,@R1
02A4 C6C1               JZ      COLDON
02A6

02A6 FE        SPMOD:   MOV     A,R6
02A7 4340               ORL     A,#$40
02A9 A9                 MOV     R1,A
02AA F1                 MOV     A,@R1
02AB D3FF               XRL     A,#$FF
02AD 96BB               JNZ     CONTIN
02AF B981               MOV     R1,#KEY
02B1 F1                 MOV     A,@R1
02B2 4304               ORL     A,#$04
02B4 A1                 MOV     @R1,A
02B5 B978               MOV     R1,#DIRCTR
02B7 B100               MOV     @R1,#$00
02B9 843D               JMP     MOMODE

02BB F5        CONTIN:  SEL     MB1
02BC 3400               CALL    TOGGLE
02BE E5                 SEL     MB0
02BF 0474               JMP     FLAG1
```

```
02C1 F5        COLDON: SEL     MB1
02C2 948B              CALL    COLD
02C4 E5                SEL     MB0
02C5 FA                MOV     A,R2
02C6 37                CPL     A
02C7 12CD              JB0     HOP20
02C9 F5                SEL     MB1
02CA 3400              CALL    TOGGLE
02CC E5                SEL     MB0
02CD F5        HOP20:  SEL     MB1
02CE 5400              CALL    OVER
02D0 E5                SEL     MB0
02D1 0474              JMP     FLAG1

030D A463              JMP     FIN
030F F0        NOT6:   MOV     A,@R0
0310 D337              XRL     A,#$37

0312 9631              JNZ     NOT7

0314 B984              MOV     R1,#NMDCNT
0316 F1                MOV     A,@R1
0317 AB                MOV     R3,A
0318 C62A              JZ      HOP15
031A A8                MOV     R0,A
031B B9E0              MOV     R1,#NMDBUF
031D 19        LOOP5:  INC     R1
031E 19                INC     R1
031F E81D              DJNZ    R0,LOOP5
0321 F1                MOV     A,@R1
0322 F22A              JB7     HOP15
0324 FB                MOV     A,R3
0325 B9D0              MOV     R1,#CNTBF
0327 69                ADD     A,R1
0328 A9                MOV     R1,A
0329 11                INC     @R1
032A

032A 1D        HOP15:  INC     R5


032B F5                SEL     MB1
032C 14C7              CALL    SRTCLR
032E E5                SEL     MB0
032F A463              JMP     FIN
0331 F0        NOT7:   MOV     A,@R0
0332 D338              XRL     A,#$38
0334 9664              JNZ     NOT8

0336 B8F0              MOV     R0,#CONSEC
0338 10                INC     @R0
0339 2302              MOV     A,#$02
033B D0                XRL     A,@R0
033C C660              JZ      HOP09
033E B8F1              MOV     R0,#CRDSRT
```

```
0340 F0                 MOV     A,@R0
0341 E7                 RL      A
0342 533F               ANL     A,#$3F
0344 A0                 MOV     @R0,A
0345 D32A               XRL     A,#$2A

02D3 C400       STOPROG:JMP     STORY


02F0                    ORG     $2F0
02F0 15         MESS:   DIS     I
02F1 D5                 SEL     RB1
02F2 FC                 MOV     A,R4
02F3 53FC               ANL     A,#$FC
02F5 AC                 MOV     R4,A
02F6 A5                 CLR     F1
02F7 C5                 SEL     RB0
02F8 05                 EN      I


02F9 B87E               MOV     R0,#BYTES
02FB 2302               MOV     A,#$02
02FD A0                 MOV     @R0,A
02FE AB                 MOV     R3,A
02FF B820               MOV     R0,#$20
0301 F0                 MOV     A,@R0
0302 D330               XRL     A,#$30
0304 9608               JNZ     NOT0


0306 A463               JMP     FIN
0308 F0         NOT0:   MOV     A,@R0
0309 D336               XRL     A,#$36
030B 960F               JNZ     NOT6

0347 C651               JZ      SURESRT
0349

0349 F5                 SEL     MB1
034A 949E               CALL    GETMOD
```

```
034C B400                CALL    UPKEEP
034E E5                  SEL     MB0
034F A463                JMP     FIN

0351 B000       SURESRT:MOV      @R0,#$00
0353 B8F0                MOV     R0,#CONSEC
0355 B000                MOV     @R0,#$00
0357 B97C       CNTCNT: MOV      R1,#FLAGS
0359 F1                  MOV     A,@R1
035A 4304                ORL     A,#$04
035C A1                  MOV     @R1,A
035D FA                  MOV     A,R2
035E 647B                JMP     STATINT

0360 B000       HOPO9:  MOV      @R0,#$00
0362 A463                JMP     FIN


0364 F0         NOT8:   MOV      A,@R0
0365 D339                XRL     A,#$39
0367 966F                JNZ     NOT9
0369 FA                  MOV     A,R2
036A 4320                ORL     A,#$20
036C AA                  MOV     R2,A
036D A463                JMP     FIN
036F F0         NOT9:   MOV      A,@R0
0370 D334                XRL     A,#$34

0372 968C                JNZ     PMODES

0374 F5                  SEL     MB1
0375 14C7                CALL    SRTCLR
0377 E5                  SEL     MB0

0378 FA                  MOV     A,R2
0379 53FB                ANL     A,#$FB
037B 4302       STATINT:ORL      A,#$02
037D AA                  MOV     R2,A
037E B97C                MOV     R1,#FLAGS
0380 F1                  MOV     A,@R1
0381 4340                ORL     A,#$40
0383 A1                  MOV     @R1,A
0384 15                  DIS     I
0385 F5                  SEL     MB1
0386 1400                CALL    STATUS
0388 E5                  SEL     MB0

0389 05                  EN      I
038A A463                JMP     FIN


038C B9F0       PMODES: MOV      R1,#CONSEC
038E B100                MOV     @R1,#$00
0390 B9F1                MOV     R1,#CRDSRT
```

```
0392 F1                 MOV     A,@R1
0393 E7                 RL      A
0394 4301               ORL     A,#$01
0396 A1                 MOV     @R1,A
0397 5307               ANL     A,#$07
0399 D307               XRL     A,#$07
039B 96A1               JNZ     HOP08
039D
039D B100               MOV     @R1,#$00
039F 6457               JMP     CNTCNT

03A1 B983       HOP08:  MOV     R1,#FLAG3
03A3 F1                 MOV     A,@R1
03A4 52A8               JB2     JIP
03A6 64AE               JMP     VIRG
03A8 B985       JIP:    MOV     R1,#CUSTODY
03AA F0                 MOV     A,@R0
03AB A1                 MOV     @R1,A
03AC 64B4               JMP     MIP


03AE F0         VIRG:   MOV     A,@R0
03AF 15                 DIS     I
03B0 D5                 SEL     RB1
03B1 AA                 MOV     R2,A
03B2 C5                 SEL     RB0
03B3 05                 EN      I
03B4 B820       MIP:    MOV     R0,#$20
03B6 BB02               MOV     R3,#$02
03B8 18         MORE:   INC     R0
03B9 F0                 MOV     A,@R0
03BA D3FF               XRL     A,#$FF
03BC C6C1               JZ      DATA
03BE 1B                 INC     R3
03BF 64B8               JMP     MORE

03C1 C8         DATA:   DEC     R0
03C2 F0                 MOV     A,@R0
03C3 53CF               ANL     A,#$CF
03C5 A0                 MOV     @R0,A
03C6 B97E               MOV     R1,#BYTES
03C8 FB                 MOV     A,R3
03C9 A1                 MOV     @R1,A
03CA D304               XRL     A,#$04
03CC 96D0               JNZ     HOP2
03CE 842D               JMP     NUMERIC
03D0 F0         HOP2:   MOV     A,@R0
03D1 A8                 MOV     R0,A


03D2 F5         UP3:    SEL     MB1
03D3 B438               CALL    NOCAN
03D5 E5                 SEL     MB0
```

```
03D6 B983              MOV     R1,#FLAG3
03D8 F1                MOV     A,@R1
03D9 37                CPL     A
03DA 52DE              JB2     UP4
03DC A463              JMP     FIN


03DE F8        UP4:    MOV     A,R0
03DF AC                MOV     R4,A
03E0
03E0 B886              MOV     R0,#DATSUM
03E2 60                ADD     A,@R0
03E3 A0                MOV     @R0,A
03E4 FC                MOV     A,R4
03E5 A8                MOV     R0,A

03E6 F5                SEL     MB1
03E7 949E              CALL    GETMOD
03E9 E5                SEL     MB0

03EA 8400              JMP     PAGE4

0400                   ORG     $400
0400 A8        PAGE4:  MOV     R0,A
0401 D335              XRL     A,#$35
0403 C607              JZ      MDFV
0405 840A              JMP     ONEMOR

0407 00        MDFV:   NOP
0408
0408 A463              JMP     FIN


040A F8        ONEMOR: MOV     A,R0
040B D331              XRL     A,#$31
040D 963D              JNZ     MOMODE
040F FC                MOV     A,R4
0410 97                CLR     C
0411 03E6              ADD     A,#$E6


0413 E63D              JNC     MOMODE
0415
0415 F5                SEL     MB1
0416 9497              CALL    MODE10
0418 E5                SEL     MB0
0419 BC00              MOV     R4,#$00
041B FA        ERMES1: MOV     A,R2
041C 4302              ORL     A,#02
041E AA                MOV     R2,A
041F B87C              MOV     R0,#FLAGS
```

```
0421 F0                 MOV     A,@R0
0422 2350               MOV     A,#$50
0424 A0                 MOV     @R0,A
0425 15                 DIS     I
0426 F5                 SEL     MB1
0427 1400               CALL    STATUS
0429 E5                 SEL     MB0
042A 05                 EN      I
042B A463               JMP     FIN

042D F0         NUMERIC:MOV     A,@R0
042E A9                 MOV     R1,A
042F C8                 DEC     R0
0430 F0                 MOV     A,@R0
0431 53CF               ANL     A,#$CF
0433 A0                 MOV     @R0,A
0434 BB09               MOV     R3,#$09
0436 60         SUM:    ADD     A,@R0
0437 EB36               DJNZ    R3,SUM
0439 69                 ADD     A,R1
043A A8                 MOV     R0,A
043B 64D2               JMP     UP3

043D FA         MOMODE: MOV     A,R2
043E 5301               ANL     A,#01
0440 C646               JZ      FWD1
0442 F5                 SEL     MB1
0443 3400               CALL    TOGGLE
0445 E5                 SEL     MB0
0446 FE         FWD1:   MOV     A,R6
0447 4340               ORL     A,#$40
0449 A9                 MOV     R1,A
044A B879               MOV     R0,#R1REG
044C A0                 MOV     @R0,A
044D B8FC               MOV     R0,#R2REG
044F A0                 MOV     @R0,A
0450 F5                 SEL     MB1
0451 949E               CALL    GETMOD
0453 E5                 SEL     MB0
0454 D331               XRL     A,#$31
0456 965A               JNZ     NMODE1
0458 A400               JMP     MODE1
045A F1         NMODE1: MOV     A,@R1
045B 965F               JNZ     SKIP
045D A417               JMP     INIT


045F BB00       SKIP:   MOV     R3,#$00
0461 1B         MERYGO: INC     R3
0462 19                 INC     R1
0463 235A               MOV     A,#$5A
0465 D9                 XRL     A,R1
0466 966A               JNZ     R1VIL
0468 B941               MOV     R1,#$41
046A F1         R1VIL:  MOV     A,@R1
```

```
046B 966F                JNZ     NEMPT
046D 848A                JMP     EMPT
046F FB          NEMPT:  MOV     A,R3
0470 D319                XRL     A,#$19
0472 9661                JNZ     MERYGO


0474 B97C        ERISHMN:MOV     R1,#FLAGS
0476 F1                  MOV     A,@R1
0477 4308                ORL     A,#$08
0479 A1                  MOV     @R1,A
047A FA                  MOV     A,R2

047B 4302                ORL     A,#$02
047D AA                  MOV     R2,A
047E 15                  DIS     I
047F F5                  SEL     MB1
0480 1400                CALL    STATUS
0482 E5                  SEL     MB0
0483 05                  EN      I
0484 F5                  SEL     MB1
0485 9497                CALL    MODE10
0487 E5                  SEL     MB0
0488 A463                JMP     FIN


048A F9          EMPT:   MOV     A,R1
048B 53BF                ANL     A,#$BF
048D AE                  MOV     R6,A
048E F5                  SEL     MB1
048F 343E                CALL    MOTOR
0491 E5                  SEL     MB0
0492 A417                JMP     INIT


0500                     ORG     $500
0500 FC          MODE1:  MOV     A,R4
0501 AB                  MOV     R3,A
0502 B8FD                MOV     R0,#BLUF
0504 A0                  MOV     @R0,A

0505 F5                  SEL     MB1
0506 D484                CALL    COLLSCH
0508 E5                  SEL     MB0

0509 FB                  MOV     A,R3
050A C60E                JZ      YEAH
050C 8474                JMP     ERISHMN


050E F5          YEAH:   SEL     MB1
```

```
050F D49F                CALL    GOTCHA
0511 E5                  SEL     MB0

0512 B881                MOV     R0,#KEY
0514 F0                  MOV     A,@R0
0515 5219                JB2     NOSENSE
0517 BF00       INIT:    MOV     R7,#$00

0519 B87C       NOSENSE:MOV      R0,#FLAGS

051B 2340                MOV     A,#$40
051D A0                  MOV     @R0,A
051E 15                  DIS     I
051F F5                  SEL     MB1
0520 1400                CALL    STATUS
0522 E5                  SEL     MB0
0523 05                  EN      I


0524 B883                MOV     R0,#FLAG3
0526 F0                  MOV     A,@R0
0527 4304                ORL     A,#$04
0529 A0                  MOV     @R0,A


052A B881                MOV     R0,#KEY
052C F0                  MOV     A,@R0
052D 5304                ANL     A,#$04
052F 9659                JNZ     ABND

0531 B883                MOV     R0,#FLAG3
0533 F0                  MOV     A,@R0
0534 37                  CPL     A
0535 7239                JB3     PREFIN
0537 0474                JMP     FLAG1
0539 BD00       PREFIN:  MOV     R5,#$00
053B BA00                MOV     R2,#$00

053D

053D FE                  MOV     A,R6
053E 4340                ORL     A,#$40
0540 A9                  MOV     R1,A
0541 BB19                MOV     R3,#$19
0543 F1         SKIP8:   MOV     A,@R1
0544 D300                XRL     A,#$00
0546 9654                JNZ     SKIP6

0548 19         SKIP9:   INC     R1
0549 F9                  MOV     A,R1
054A D35A                XRL     A,#$5A
054C 9650                JNZ     SKIP7
054E B941                MOV     R1,#$41
```

```
0550 EB43      SKIP7:  DJNZ    R3,SKIP8
0552 A463              JMP     FIN
0554
0554 23FF      SKIP6:  MOV     A,#$FF
0556 A1                MOV     @R1,A
0557 A448              JMP     SKIP9

0559


0559 F0        ABND:   MOV     A,@R0
055A 53FB              ANL     A,#$FB
055C A0                MOV     @R0,A
055D FA                MOV     A,R2
055E 5310              ANL     A,#$10
0560 AA                MOV     R2,A
0561 0474              JMP     FLAG1


0563 15        FIN:    DIS     I
0564 D5                SEL     RB1
0565 FB                MOV     A,R3
0566
0566 77                RR      A
0567 537F              ANL     A,#$7F
0569 AB                MOV     R3,A
056A 1272              JB0     MORMESS
056C BD20              MOV     R5,#$20
056E C5        OUT:    SEL     RB0
056F 05                EN      I
0570 0476              JMP     RES1
0572 A5        MORMESS:CLR     F1
0573 B5                CPL     F1
0574 C5                SEL     RB0
0575 B97E              MOV     R1,#BYTES
0577 F1                MOV     A,@R1
0578 D5                SEL     RB1
0579 07        PTRLOC: DEC     A
057A CD                DEC     R5
057B 9679              JNZ     PTRLOC
057D C5                SEL     RB0
057E 2320              MOV     A,#$20
0580 61                ADD     A,@R1
0581 A9                MOV     R1,A
0582 B820              MOV     R0,#$20
0584 BB0E              MOV     R3,#$0E
0586 F1        UP2:    MOV     A,@R1
0587 A0                MOV     @R0,A
0588 EB8C              DJNZ    R3,BUFF
058A A46E              JMP     OUT
058C 18        BUFF:   INC     R0
058D 19                INC     R1
058E A486              JMP     UP2
```

```
0600                    ORG     $0600
0600 FE         STORY:  MOV     A,R6
0601 4340               ORL     A,#$40
0603 A8                 MOV     R0,A
0604 B0FF               MOV     @R0,#$FF
0606 B889               MOV     R0,#ACTSUM
0608 FC                 MOV     A,R4
0609 60                 ADD     A,@R0
060A A0                 MOV     @R0,A
060B B888               MOV     R0,#STKBIN
060D F0                 MOV     A,@R0
060E 07                 DEC     A
060F F22B               JB7     CKOUT
0611 A0                 MOV     @R0,A
0612
0612 F5                 SEL     MB1
0613 F400               CALL    SEARCH
0615 E5                 SEL     MB0

0616 B8FA               MOV     R0,#EMPBIN
0618 F0                 MOV     A,@R0
0619 07                 DEC     A
061A A0                 MOV     @R0,A
061B B88B               MOV     R0,#CNT1
061D F0                 MOV     A,@R0
061E AC                 MOV     R4,A
061F B98C               MOV     R1,#CNT2
0621 BB04               MOV     R3,#$04
0623 F1         XFR:    MOV     A,@R1
0624 A0                 MOV     @R0,A
0625 19                 INC     R1
0626 18                 INC     R0
0627 EB23               DJNZ    R3,XFR
0629 843D               JMP     MOMODE

062B B989       CKOUT:  MOV     R1,#ACTSUM
062D B887               MOV     R0,#FINSUM
062F F1                 MOV     A,@R1
0630 D0                 XRL     A,@R0
0631 C639               JZ      STOVR

0633 F5                 SEL     MB1
0634 5403               CALL    ALARM
0636 E5                 SEL     MB0
0637 C43D               JMP     OVRSTK

0639 F5         STOVR:  SEL     MB1
063A 5401               CALL    OVER2
063C E5                 SEL     MB0
063D 0474       OVRSTK: JMP     FLAG1
06A0                    ORG     $6A0

06A0 8A01       KEYSUB: ORL     P2,#$01
06A2

06A8                    ORG     $6A8
06A8 047D               JMP     KEYRET
```

```
06AA 00                 NOP
06AB 00                 NOP
06AC 00                 NOP
06AD 00                 NOP
06AE 00                 NOP
06AF 00                 NOP
```

```
06B0                    ORG     $6B0
06B0 B901       UART:   MOV     R1,#$01
06B2 B803               MOV     R0,#$03

06B4 2300               MOV     A,#$00
06B6 91         TRY:    MOVX    @R1,A
06B7 E8B6               DJNZ    R0,TRY
06B9 2340               MOV     A,#$40
06BB 91                 MOVX    @R1,A
06BC 237A               MOV     A,#$7A
06BE 91                 MOVX    @R1,A
06BF 2335               MOV     A,#$35
06C1 91                 MOVX    @R1,A
06C2 83                 RET
```

```
06C3 00                 NOP
06C4 00                 NOP
06C5 00                 NOP
06C6 00                 NOP
06C7 00                 NOP

06C8 00                 NOP
06C9 00                 NOP
06CA 00                 NOP
06CB 00                 NOP
06CC 00                 NOP

06CD 00                 NOP
06CE 00                 NOP
06CF 00                 NOP
```

```
0700                        ORG     $700
0700 B87A        MIMIC:     MOV     R0,#$7A
0702 10                     INC     @R0
0703 F0                     MOV     A,@R0
0704 A8                     MOV     R0,A
0705 F9                     MOV     A,R1
0706 A0                     MOV     @R0,A
0707 83                     RET
0708 15          INTRPT:    DIS     I
0709 D5                     SEL     RB1
070A B961                   MOV     R1,#ACCUM
070C A1                     MOV     @R1,A

070D

070D B901                   MOV     R1,#$01
070F 81                     MOVX    A,@R1
0710 5338                   ANL     A,#$38
0712 C618                   JZ      FINE
0714 D4B0                   CALL    UART
0716 E45D                   JMP     OUT4

0718


0718 FC          FINE:      MOV     A,R4
0719 92CC                   JB4     COLLORG



071B B900                   MOV     R1,#$00
071D 81                     MOVX    A,@R1
071E A8                     MOV     R0,A
071F D33A                   XRL     A,#$3A
0721 9663                   JNZ     NOCOLON
0723 B965        PRTR:      MOV     R1,#ECHO
0725 F8                     MOV     A,R0
0726 A1                     MOV     @R1,A
0727 F9                     MOV     A,R1
0728 B87A                   MOV     R0,#$7A
072A A0                     MOV     @R0,A
072B FC                     MOV     A,R4
072C 4301                   ORL     A,#$01
072E AC                     MOV     R4,A


072F B800        OUT3:      MOV     R0,#$00
0731 B901                   MOV     R1,#$01
0733 81          TRYAGN:    MOVX    A,@R1
0734 5238                   JB2     DOIT
0736 E433                   JMP     TRYAGN
0738 B97A        DOIT:      MOV     R1,#$7A
073A F1                     MOV     A,@R1
```

```
073B A9                 MOV     R1,A
073C F1                 MOV     A,@R1
073D 90                 MOVX    @R0,A


073E B8BF               MOV     R0,#BUFF1
0740 F0                 MOV     A,@R0
0741 D3CF               XRL     A,#$CF
0743 9648               JNZ     HOP14
0745 23C0               MOV     A,#$C0
0747 A0                 MOV     @R0,A
0748 F0         HOP14:  MOV     A,@R0
0749 A8                 MOV     R0,A
074A F1                 MOV     A,@R1
074B A0                 MOV     @R0,A
074C B8BF               MOV     R0,#BUFF1
074E 10                 INC     @R0


074F D30A               XRL     A,#$0A


0751 965D               JNZ     OUT4
0753 B8FF               MOV     R0,#$FF
0755 B910               MOV     R1,#$10
0757 00         DLY2:   NOP
0758 00                 NOP
0759 E857               DJNZ    R0,DLY2
075B E957               DJNZ    R1,DLY2


075D B961       OUT4:   MOV     R1,#ACCUM
075F F1                 MOV     A,@R1
0760 C5                 SEL     RB0
0761 05                 EN      I
0762 93                 RETR

0763 FC         NOCOLON:MOV     A,R4
0764 4301               ORL     A,#$01
0766 AC                 MOV     R4,A
0767 F8                 MOV     A,R0
0768 A9                 MOV     R1,A
0769 5330               ANL     A,#$30
076B C676               JZ      CR
076D FD                 MOV     A,R5
076E A8                 MOV     R0,A
076F F9                 MOV     A,R1
0770 A0                 MOV     @R0,A
0771 1D                 INC     R5
```

```
0772 F400                CALL    MIMIC
0774 E42F                JMP     OUT3


0776 FC          CR:     MOV     A,R4
0777 3286                JB1     LF

0779 F9                  MOV     A,R1
077A D30D                XRL     A,#$0D
077C 962F                JNZ     OUT3
077E FC                  MOV     A,R4
077F 4302                ORL     A,#$02
0781 AC                  MOV     R4,A
0782 F400                CALL    MIMIC
0784 E42F                JMP     OUT3

0786 F9          LF:     MOV     A,R1
0787 D30A                XRL     A,#$0A
0789 962F                JNZ     OUT3

078B B883                MOV     R0,#FLAG3
078D F0                  MOV     A,@R0
078E 1292                JB0     BIT1
0790 E495                JMP     DUNE
0792 4302        BIT1:   ORL     A,#$02
0794 A0                  MOV     @R0,A


0795 FC          DUNE:   MOV     A,R4
0796 53FD                ANL     A,#$FD
0798 AC                  MOV     R4,A
0799 F400                CALL    MIMIC
079B FD                  MOV     A,R5
079C A8                  MOV     R0,A
079D B0FF                MOV     @R0,#$FF
079F 1D                  INC     R5

07A0 FB                  MOV     A,R3
07A1 12A7                JB0     SETB1
07A3 4301                ORL     A,#$01
07A5 E4C7                JMP     FLG1

07A7 32AD        SETB1:  JB1     SETB2
07A9 4302                ORL     A,#$02
07AB E4C7                JMP     FLG1

07AD 52B3        SETB2:  JB2     SETB3
07AF 4304                ORL     A,#$04
07B1 E4C7                JMP     FLG1

07B3 72B9        SETB3:  JB3     SETB4
07B5 4308                ORL     A,#$08
07B7 E4C7                JMP     FLG1
```

```
07B9 92BF      SETB4:  JB4     SETB5
07BB 4310              ORL     A,#$10
07BD E4C7              JMP     FLG1

07BF B2C5      SETB5:  JB5     SETB6
07C1 4320              ORL     A,#$20
07C3 E4C7              JMP     FLG1

07C5 4340      SETB6:  ORL     A,#$40
07C7 AB        FLG1:   MOV     R3,A

07C8 A5                CLR     F1
07C9 B5                CPL     F1
07CA E42F              JMP     OUT3


07CC B900      COLLORG:MOV     R1,#$00
07CE 81                MOVX    A,@R1
07CF A9                MOV     R1,A
07D0 D33A              XRL     A,#$3A
07D2 96EF              JNZ     CHAR
07D4 FC                MOV     A,R4
07D5 5327              ANL     A,#$27
07D7 AC                MOV     R4,A

07D8 BE30              MOV     R6,#$30
07DA F9                MOV     A,R1
07DB A8                MOV     R0,A
07DC C5                SEL     RB0
07DD FA                MOV     A,R2
07DE 32E3              JB1     MESEND
07E0 D5                SEL     RB1
07E1 E423              JMP     PRTR
07E3 53FD      MESEND: ANL     A,#$FD
07E5 AA                MOV     R2,A
07E6 D5                SEL     RB1
07E7 B983              MOV     R1,#FLAG3
07E9 F1                MOV     A,@R1
07EA 4301              ORL     A,#$01
07EC A1                MOV     @R1,A


07ED E423              JMP     PRTR


07EF FE        CHAR:   MOV     A,R6
07F0 A8                MOV     R0,A
07F1 F0                MOV     A,@R0
07F2 D9                XRL     A,R1
07F3 C6F9              JZ      DATEQL
```

```
07F5 FC                 MOV     A,R4
07F6 4380               ORL     A,#$80
07F8 AC                 MOV     R4,A
07F9 FC         DATEQL: MOV     A,R4
07FA 4340               ORL     A,#$40
07FC AC                 MOV     R4,A
07FD E45D               JMP     OUT4

07FF 00                 NOP
```

```
0800                    ORG     $800
0800 FA         STATUS: MOV     A,R2
0801 D5                 SEL     RB1
0802 A8                 MOV     R0,A
0803 FC                 MOV     A,R4
0804 5308               ANL     A,#$08
0806 9639               JNZ     NOWAY
0808 BE30               MOV     R6,#$30
080A F8                 MOV     A,R0
080B B97D               MOV     R1,#$7D
080D B100               MOV     @R1,#$00
080F C9                 DEC     R1
0810 C9                 DEC     R1
0811 A1                 MOV     @R1,A
0812 D23F               JB6     BINSEMP
0814 B97B       BINSNO: MOV     R1,#$7B
0816 F1                 MOV     A,@R1
0817 5246               JB2     COLLSTP
0819 143B       NOSTOP: CALL    SETUP
081B 124D               JB0     BINSFUL
081D 143B       NOFULL: CALL    SETUP
081F B277               JB5     SPECIAL
0821 143B       NOSPEC: CALL    SETUP
0823 525B               JB2     CNTEROR
0825 143B       NOCNTER:CALL    SETUP
0827 7262               JB3     QTYER1
0829 143B       NOQTY1: CALL    SETUP
082B 9269               JB4     QTYER2
082D 143B       NOQTY2: CALL    SETUP
082F D270               JB6     COLLRUN
0831 143B       NORUN:  CALL    SETUP
0833 3254               JB1     ENDJOB
```

```
0835 FE        NOEND:  MOV     A,R6
0836 A8                MOV     R0,A
0837 B0FF              MOV     @R0,#$FF
0839 C5        NOWAY:  SEL     RB0
083A 83                RET


083B B97C      SETUP:  MOV     R1,#FLAGS
083D F1                MOV     A,@R1
083E 83                RET


083F 148F      BINSEMP:CALL    STAT
0841 2331              MOV     A,#$31
0843 A0                MOV     @R0,A
0844 0414              JMP     BINSNO

0846 148F      COLLSTP:CALL    STAT
0848 2330              MOV     A,#$30
084A A0                MOV     @R0,A
084B 0419              JMP     NOSTOP

084D 148F      BINSFUL:CALL    STAT
084F 2332              MOV     A,#$32
0851 A0                MOV     @R0,A
0852 041D              JMP     NOFULL

0854 148F      ENDJOB: CALL    STAT
0856 2333              MOV     A,#$33
0858 A0                MOV     @R0,A
0859 0435              JMP     NOEND

085B 148F      CNTEROR:CALL    STAT
085D 2334              MOV     A,#$34
085F A0                MOV     @R0,A
0860 0425              JMP     NOCNTER

0862 148F      QTYER1: CALL    STAT
0864 2335              MOV     A,#$35
0866 A0                MOV     @R0,A
0867 0429              JMP     NOQTY1

0869 148F      QTYER2: CALL    STAT
086B 2336              MOV     A,#$36
086D A0                MOV     @R0,A
086E 042D              JMP     NOQTY2

0870 148F      COLLRUN:CALL    STAT
0872 2339              MOV     A,#$39
0874 A0                MOV     @R0,A
0875 0431              JMP     NORUN

0877 148F      SPECIAL:CALL    STAT
0879 2337              MOV     A,#$37
087B A0                MOV     @R0,A
```

```
087C 1E                INC     R6
087D 18                INC     R0
087E B970              MOV     R1,#SPECBIN
0880 F1                MOV     A,@R1
0881 A0                MOV     @R0,A
0882 19                INC     R1
0883 18                INC     R0
0884 F1                MOV     A,@R1
0885 A0                MOV     @R0,A
0886 18                INC     R0
0887 B00D              MOV     @R0,#$0D
0889 18                INC     R0
088A B00A              MOV     @R0,#$0A
088C 1E                INC     R6
088D 0421              JMP     NOSPEC
088F D5        STAT:   SEL     RB1
0890 BFFC              MOV     R7,#$FC
0892 FE                MOV     A,R6
0893 A8                MOV     R0,A
0894 B904              MOV     R1,#$04
0896 FF                MOV     A,R7
0897 E3        TABLE:  MOVP3   A,@A
0898 A0                MOV     @R0,A
0899 18                INC     R0
089A 1E                INC     R6
089B 1F                INC     R7
089C FF                MOV     A,R7
089D E997              DJNZ:   R1,TABLE
089F B97D              MOV     R1,#$7D
08A1 11                INC     @R1
08A2 FE                MOV     A,R6
08A3 07                DEC     A
08A4 07                DEC     A
08A5 07                DEC     A
08A6 A8                MOV     R0,A
08A7 83                RET


08A8 0A        JAM:    IN      A,P2
08A9 53BF              ANL     A,#$BF
08AB 4310              ORL     A,#$10
08AD 3A                OUTL    P2,A

08AE 09                IN      A,P1


08AF
08AF 4308              ORL     A,#$08
08B1
08B1 39                OUTL    P1,A
```

```
08B2 9471          CALL   ALARM1
08B4 9475          CALL   DELAY
08B6 9471          CALL   ALARM1
08B8 B97C   STOP:  MOV    R1,#FLAGS
08BA F1            MOV    A,@R1
08BB 53BF          ANL    A,#$BF
08BD A1            MOV    @R1,A
08BE FA            MOV    A,R2
08BF 4306          ORL    A,#$06
08C1 AA            MOV    R2,A
08C2 15            DIS    I
08C3 1400          CALL   STATUS
08C5 05            EN     I
08C6 83            RET
```

```
08C7 27     SRTCLR: CLR    A
08C8 B8F0           MOV    R0,#CONSEC
08CA B9F1           MOV    R1,#CRDSRT
08CC A0             MOV    @R0,A
08CD A1             MOV    @R1,A
08CE 83             RET
```

```
0900                ORG    $0900
0900 0A     TOGGLE: IN     A,P2
0901 B860           MOV    R0,#TOGPTR
0903 A0             MOV    @R0,A
0904 53BF           ANL    A,#$BF
0906 A0             MOV    @R0,A
0907 3A             OUTL   P2,A
0908 B8FF           MOV    R0,#$FF
090A B9FF   TGL1:   MOV    R1,#$FF
090C E90C   JTGL:   DJNZ   R1,JTGL
090E E80A           DJNZ   R0,TGL1
0910 B860           MOV    R0,#TOGPTR
0912 F0             MOV    A,@R0
0913 5320           ANL    A,#$20
0915 C624           JZ     TGLE
0917 F0             MOV    A,@R0
0918 539F           ANL    A,#$9F
091A 3A             OUTL   P2,A
091B B860           MOV    R0,#TOGPTR
```

```
091D A0                 MOV     @R0,A
091E FA                 MOV     A,R2
091F 53FE               ANL     A,#$FE
0921 AA                 MOV     R2,A
0922 242F               JMP     TDELAY
0924 B860       TGLE:   MOV     R0,#TOGPTR
0926 F0                 MOV     A,@R0
0927 4320               ORL     A,#$20
0929 3A                 OUTL    P2,A
092A A0                 MOV     @R0,A
092B FA                 MOV     A,R2
092C 4301               ORL     A,#$01
092E AA                 MOV     R2,A
092F B8FF       TDELAY: MOV     R0,#$FF
0931 B9FF       TDEL:   MOV     R1,#$FF
0933 E933       TDE:    DJNZ    R1,TDE
0935 E831               DJNZ    R0,TDEL
0937 B860               MOV     R0,#TOGPTR
0939 F0                 MOV     A,@R0
093A 4340               ORL     A,#$40
093C 3A                 OUTL    P2,A
093D 83                 RET


093E 0A         MOTOR:  IN      A,P2
093F 4340               ORL     A,#$40
0941 53EF               ANL     A,#$EF
0943 3A                 OUTL    P2,A
0944 2648       TST3:   JNT0    TST4
0946 2444               JMP     TST3
0948 364C       TST4:   JT0     DCR
094A 2448               JMP     TST4
094C EB44       DCR:    DJNZ    R3,TST3
094E 364E       TST7:   JT0     TST7
0950 2654       TST6:   JNT0    TST8
0952 2450               JMP     TST6
0954 B981       TST8:   MOV     R1,#KEY
0956 F1                 MOV     A,@R1
0957 3269               JB1     NOMAS

0959 0A                 IN      A,P2
095A 4310               ORL     A,#$10
095C 3A                 OUTL    P2,A

095D F1                 MOV     A,@R1
095E F265               JB7     ALLOFF
0960
0960 FD                 MOV     A,R5
0961 D300               XRL     A,#$00
0963 9669               JNZ     NOMAS
0965 0A         ALLOFF: IN      A,P2
0966 53BF               ANL     A,#$BF
0968 3A                 OUTL    P2,A
0969 83         NOMAS:  RET
```

```
096A 949E    HEFTY:  CALL    GETMOD
096C D333            XRL     A,#$33
096E C6CC            JZ      CLECTO
0970 FE              MOV     A,R6
0971 4340            ORL     A,#$40
0973 A9              MOV     R1,A
0974 B1FF            MOV     @R1,#$FF
0976 BB01            MOV     R3,#$01
0978 1E      UBET:   INC     R6
0979 FE              MOV     A,R6
097A 231A            MOV     A,#$1A
097C DE              XRL     A,R6
097D 9681            JNZ     UBET1
097F BE01            MOV     R6,#$01
0981 FE      UBET1:  MOV     A,R6
0982 4340            ORL     A,#$40
0984 A9              MOV     R1,A
0985 F1              MOV     A,@R1
0986 D3FF            XRL     A,#$FF
0988 968C            JNZ     NOHNO
098A 24A6            JMP     OHNO

098C 949E    NOHNO:  CALL    GETMOD
098E D333            XRL     A,#$33
0990 9695            JNZ     NONO
0992 FB              MOV     A,R3
0993 C6CB            JZ      NON1

0995 343E    NONO:   CALL    MOTOR
0997 FA              MOV     A,R2
0998 53F5            ANL     A,#$F5
099A AA              MOV     R2,A
099B B97C            MOV     R1,#FLAGS
099D F1              MOV     A,@R1
099E 53FE            ANL     A,#$FE
09A0 A1              MOV     @R1,A
09A1 15              DIS     I
09A2 1400            CALL    STATUS
09A4 05              EN      I
09A5 83              RET


09A6 1B      OHNO:   INC     R3
09A7 231A            MOV     A,#$1A
09A9 DB              XRL     A,R3
09AA C6AE            JZ      NUBET

09AC 2478            JMP     UBET
09AE B97C    NUBET:  MOV     R1,#FLAGS
09B0 F1              MOV     A,@R1
09B1 53BF            ANL     A,#$BF
09B3 4301            ORL     A,#$01
09B5 A1              MOV     @R1,A
09B6 FA              MOV     A,R2
09B7 4306            ORL     A,#$06
09B9 AA              MOV     R2,A
09BA 15              DIS     I
09BB 1400            CALL    STATUS
```

```
09BD 05                 EN      I
09BE 9471               CALL    ALARM1
09C0 9475               CALL    DELAY
09C2 9471               CALL    ALARM1
09C4 B977               MOV     R1,#MULT
09C6 B100               MOV     @R1,#$00
09C8 19                 INC     R1
09C9 B100               MOV     @R1,#$00
09CB 83         NON1:   RET

09CC BB00       CLECTO: MOV     R3,#$00
09CE 2481               JMP     UBET1


0A00                    ORG     $0A00
0A00 FA         OVER:   MOV     A,R2
0A01 4455       OVER2:  JMP     JOBOVR
0A03 9471       ALARM:  CALL    ALARM1
0A05 9475               CALL    DELAY
0A07 B97C               MOV     R1,#FLAGS
0A09 F1                 MOV     A,@R1
0A0A 4304               ORL     A,#$04
0A0C A1                 MOV     @R1,A
0A0D 15         BUTTIN: DIS     I
0A0E 1400               CALL    STATUS
0A10 05                 EN      I
0A11 FA                 MOV     A,R2
AVOCET SYSTEMS 8048 CROSS-ASSEMBLER -  VERSIUI

SOURCE FILE NAME: SPCL11.ASM


0A12 53EF               ANL     A,#$EF
0A14 4302               ORL     A,#$02
0A16 AA                 MOV     R2,A
0A17 B977               MOV     R1,#MULT
0A19 B100               MOV     @R1,#$00
0A1B 19                 INC     R1
0A1C B100               MOV     @R1,#$00
0A1E 9471               CALL    ALARM1


0A20 B987               MOV     R1,#FINSUM
0A22 F1                 MOV     A,@R1
0A23 A9                 MOV     R1,A
0A24 CD         SUBTRC: DEC     R5
0A25 E924               DJNZ    R1,SUBTRC
0A27 B985               MOV     R1,#CUSTODY
0A29 BB08               MOV     R3,#$08
0A2B 2300               MOV     A,#$00
0A2D A1         XFER:   MOV     @R1,A
0A2E 19                 INC     R1
0A2F EB2D               DJNZ    R3,XFER
0A31
```

```
0A31
0A31
0A31
0A31
0A31
0A31
0A31
0A31 B983                MOV     R1,#FLAG3
0A33 F1                  MOV     A,@R1
0A34 53E3                ANL     A,#$E3
0A36 A1                  MOV     @R1,A
0A37
0A37
0A37 B984                MOV     R1,#NMDCNT
0A39 F1                  MOV     A,@R1
0A3A 96B6                JNZ     CONFIG

0A3C
0A3C 9497                CALL    MODE10
0A3E BF00                MOV     R7,#$00
0A40 BD00                MOV     R5,#$00
0A42 BC00                MOV     R4,#$00
0A44 9400                CALL    NEOJ
0A46 0A                  IN      A,P2
0A47 4310                ORL     A,#$10
0A49 53BF                ANL     A,#$BF
0A4B 3A                  OUTL    P2,A
0A4C B997                MOV     R1,#EOJREG
0A4E B8FA                MOV     R0,#EMPBIN
AVOCET SYSTEMS 8048 CROSS-ASSEMBLER -  VERS

SOURCE FILE NAME: SPCL11.ASM


0A50 2300                MOV     A,#$00
0A52 A1                  MOV     @R1,A
0A53 A0                  MOV     @R0,A
0A54 83                  RET


0A55 B97C        JOBOVR: MOV     R1,#FLAGS
0A57 F1                  MOV     A,@R1
0A58 4302                ORL     A,#$02
0A5A A1                  MOV     @R1,A
0A5B 440D                JMP     BUTTIN


0A5D BF00        FREE:   MOV     R7,#$00
0A5F B983                MOV     R1,#FLAG3
0A61 F1                  MOV     A,@R1
0A62 53EF                ANL     A,#$EF
0A64 A1                  MOV     @R1,A
0A65
0A65 726E                JB3     HOP16
0A67 B9D1                MOV     R1,#CNTBF1
0A69 B887                MOV     R0,#FINSUM
```

```
0A6B F1                 MOV     A,@R1
0A6C 60                 ADD     A,@R0
0A6D A0                 MOV     @R0,A

0A6E 9430       HOP16:  CALL    CNTXFR


0A70 B997               MOV     R1,#EOJREG
0A72 F1                 MOV     A,@R1
0A73 07                 DEC     A
0A74 A1                 MOV     @R1,A
0A75 9679               JNZ     EOJ
0A77 4483               JMP     EOJ1
0A79 FA         EOJ:    MOV     A,R2
0A7A 4310               ORL     A,#$10
0A7C AA                 MOV     R2,A
0A7D 949E               CALL    GETMOD
0A7F D331               XRL     A,#$31
0A81 C686               JZ      LATER

0A83 9400       EOJ1:   CALL    NEOJ
0A85 83                 RET

0A86 B883       LATER:  MOV     R0,#FLAG3
0A88 F0                 MOV     A,@R0
0A89 D290               JB6     TWICE
0A8B
0A8B 53DF               ANL     A,#$DF
AVOCET SYSTEMS 8048 CROSS-ASSEMBLER -  VERSIUN 1.62

SOURCE FILE NAME: SPCL11.ASM


0A8D A0                 MOV     @R0,A
0A8E
0A8E 4499               JMP     STEP0
0A90 53BF       TWICE:  ANL     A,#$BF
0A92 A0                 MOV     @R0,A
0A93 B9FF               MOV     R1,#BLUF2
0A95 B8FE               MOV     R0,#BLUF1
0A97 F1                 MOV     A,@R1
0A98 A0                 MOV     @R0,A
0A99 B8FD       STEP0:  MOV     R0,#BLUF
0A9B FC                 MOV     A,R4
0A9C A0                 MOV     @R0,A
0A9D AB                 MOV     R3,A
0A9E FE                 MOV     A,R6
0A9F 4340               ORL     A,#$40
0AA1 B9FC               MOV     R1,#R2REG
0AA3 A1                 MOV     @R1,A
0AA4
0AA4 A9                 MOV     R1,A
0AA5 D484               CALL    COLLSCH
0AA7 FB                 MOV     A,R3
0AA8 9685               JNZ     STEP1
0AAA D49F               CALL    GOTCHA
0AAC FC                 MOV     A,R4
0AAD A8                 MOV     R0,A
```

```
0AAE B0FA                MOV     R1,#EMPBIN
0AB0 F1                  MOV     A,@R1
0AB1 07          LOOP4:  DEC     A
0AB2 E8B1                DJNZ    R0,LOOP4
0AB4 A1                  MOV     @R1,A

0AB5 83          STEP1:  RET


0AB6


0AB6 B9[illegible]       CONFIG: MOV     [illegible],#CNTE[illegible]
0AB8 F1                  MOV     [illegible],@R1
0AB9 D300                XRL     A,#$[illegible]
0ABB C6C4                JZ      CONF[illegible]
0ABD FC                  MOV     [illegible],R4
0ABE A8                  MOV     [illegible],A
0ABF F1                  MOV     A,@R[illegible]
0AC0 07          LOOP8:  DEC     A
0AC1 E8C0                DJNZ    R0,LOO[illegible]
0AC3 A1                  MOV     @R1,A

0AC4
0AC4
AVOCET SYSTEMS 8048 CROSS-ASSEMBLER -  VERSION

SOURCE FILE NAME: SPCL11.ASY


0AC4 B983        CONFG1: MOV     R1,#FLAG3
0AC6 F1                  MOV     A,@R1
0AC7 4304                ORL     A,#$04
0AC9 A1                  MOV     @R1,A
0ACA B0E1                MOV     R2,#NMBUF1
0ACC F0                  MOV     A,@R0
0ACD D5                  SEL     RB1
0ACE AA                  MOV     R2,A
0ACF C5                  SEL     RB0
0AD0 AB                  MOV     R3,A
0AD1 18                  INC     R0
0AD2 F0                  MOV     A,@R0
0AD3 945C                CALL    DATCHK
0AD5 AC                  MOV     R4,A
0AD6 [illegible]         CALL    TOTAL

0AD8 [illegible]         CALL    XFRBUF

0ADA B883                MOV     R0,#FLAG3
0ADC F0                  MOV     A,@R0
0ADD 925D                JB4     FREE
0ADF F1                  MOV     A,@R1

0AE0 96E4                JNZ     CHKCOL
0AE2 445D                JMP     FREE
0AE4 FB          CHKCOL: MOV     A,R3
0AE5 D333                XRL     A,#$33
0AE7 C6EB                JZ      SPCOL
```

```
0AE9 6411                JMP     CHKSTK
0AEB B8E1        SPCOL:  MOV     R0,#NMBUF1
0AED F0                  MOV     A,@R0
0AEE D333                XRL     A,#$33
0AF0 965D                JNZ     FREE
0AF2 18                  INC     R0
0AF3 F0                  MOV     A,@R0
0AF4 945C                CALL    DATCHK
0AF6 6C                  ADD     A,R4
0AF7 AC                  MOV     R4,A
0AF8 9456                CALL    TOTAL
0AFA 943C                CALL    SPFLG
0AFC 9443                CALL    XFRBUF
0AFE 9430                CALL    CNTXFR

0B00 B883                MOV     R0,#FLAG3
0B02 F0                  MOV     A,@R0
0B03 37                  CPL     A
0B04 9208                JB4     HOP31
0B06 445D                JMP     FREE
0B08 B984        HOP31:  MOV     R1,#NMDCNT
0B0A F1                  MOV     A,@R1
```

```
0B0B C60F                JZ      HOP32
0B0D 44EB                JMP     SPCOL

0B0F 445D        HOP32:  JMP     FREE

0B11 FB          CHKSTK: MOV     A,R3
0B12 D332                XRL     A,#$32

0B14 C618                JZ      STEP2
0B16 644F                JMP     CHKLATE
0B18

0B18 BB01        STEP2:  MOV     R3,#$01
0B1A B98A        SPSTK:  MOV     R1,#CNT
0B1C B8E1                MOV     R0,#NMBUF1
0B1E F0                  MOV     A,@R0
0B1F D332                XRL     A,#$32
0B21 C625                JZ      HOP17
0B23 445D                JMP     FREE
0B25 18          HOP17:  INC     R0
0B26 FB                  MOV     A,R3
0B27 69                  ADD     A,R1
0B28 A9                  MOV     R1,A
0B29 F0                  MOV     A,@R0
0B2A 945C                CALL    DATCHK
0B2C A1                  MOV     @R1,A
0B2D B986                MOV     R1,#DATSUM
0B2F 61                  ADD     A,@R1
0B30 A1                  MOV     @R1,A
```

```
0B31 19                 INC     R1
0B32 A1                 MOV     @R1,A
0B33 B988               MOV     R1,#STKBIN
0B35 FB                 MOV     A,R3
0B36 A1                 MOV     @R1,A
0B37 1B                 INC     R3
0B38 943C               CALL    SPFLG
0B3A 9443               CALL    XFRBUF
0B3C 9430               CALL    CNTXFR

0B3E B883               MOV     R0,#FLAG3
0B40 F0                 MOV     A,@R0
0B41 37                 CPL     A
0B42 9246               JB4     STEP6
0B44 445D               JMP     FREE
0B46 B984       STEP6:  MOV     R1,#NMDCNT
0B48 F1                 MOV     A,@R1

0B49 C64D               JZ      STEP5
0B4B 641A               JMP     SPSTK
AVOCET SYSTEMS 8048 CROSS-ASSEMBLER -  VERSIUN 1.62

SOURCE FILE NAME: SPCL11.ASM


0B4D 445D       STEP5:  JMP     FREE


0B4F FB         CHKLATE:MOV     A,R3
0B50 D331               XRL     A,#$31
0B52 C656               JZ      SPLATE
0B54 445D               JMP     FREE

0B56 B8E1       SPLATE: MOV     R0,#NMBUF1
0B58 F0                 MOV     A,@R0
0B59 D31F               XRL     A,#31
0B5B C65F               JZ      STEP3
0B5D 445D               JMP     FREE
0B5F 18         STEP3:  INC     R0
0B60 F0                 MOV     A,@R0
0B61 945C               CALL    DATCHK
0B63 B886               MOV     R0,#DATSUM
0B65 60                 ADD     A,@R0
0B66 A0                 MOV     @R0,A
0B67 18                 INC     R0
0B68 A0                 MOV     @R0,A
0B69 943C               CALL    SPFLG
0B6B
0B6B 9443               CALL    XFRBUF
0B6D 9430               CALL    CNTXFR
0B6F B883               MOV     R0,#FLAG3
0B71 F0                 MOV     A,@R0
0B72 37                 CPL     A
0B73 9277               JB4     STEP4
0B75 445D               JMP     FREE
```

```
0B77 B984        STEP4:  MOV     R1,#NMDCNT
0B79 F1                  MOV     A,@R1
0B7A 9656                JNZ     SPLATE
0B7C 445D                JMP     FREE
0B7E
```

```
0C00                     ORG     $0C00
0C00 FA          NEOJ:   MOV     A,R2
0C01 37                  CPL     A
0C02 120A                JB0     BN
AVOCET SYSTEMS 8048 CROSS-ASSEMBLER -  VERSION 1.62

SOURCE FILE NAME: SPCL11.ASM

0C04 FA                  MOV     A,R2
0C05 53FE                ANL     A,#$FE
0C07 AA                  MOV     R2,A
0C08 3400                CALL    TOGGLE
0C0A FE          BN:     MOV     A,R6
0C0B 4340                ORL     A,#$40
0C0D A8                  MOV     R0,A
0C0E BB01                MOV     R3,#$01
0C10 18          BN1:    INC     R0
0C11 235A                MOV     A,#$5A
0C13 D8                  XRL     A,R0
0C14 9618                JNZ     HOP40
0C16 B841                MOV     R0,#$41
0C18 F0          HOP40:  MOV     A,@R0
0C19 C624                JZ      FWD2
0C1B 1B                  INC     R3
0C1C FB                  MOV     A,R3
0C1D D31A                XRL     A,#$1A
0C1F 9610                JNZ     BN1
0C21 D400                CALL    ERQTY1
0C23 83                  RET
```

```
0C24 343E        FWD2:   CALL    MOTOR
0C26 F8                  MOV     A,R0
0C27 53BF                ANL     A,#$BF
0C29 AE                  MOV     R6,A
0C2A B9FA                MOV     R1,#EMPBIN
0C2C F1                  MOV     A,@R1
0C2D 07                  DEC     A
0C2E A1                  MOV     @R1,A
0C2F 83                  RET
```

```
0C30 B9D2      CNTXFR: MOV     R1,#CNTBF2
0C32 B80C              MOV     R0,#$0C
0C34 F1        LOOP6:  MOV     A,@R1
0C35 C9                DEC     R1
0C36 A1                MOV     @R1,A
0C37 19                INC     R1
0C38 19                INC     R1
0C39 E834              DJNZ    R0,LOOP6
0C3B 83                RET
N AVOCET SYSTEMS 8048 CROSS-ASSEMBLER -  VERSION 1.62

  SOURCE FILE NAME: SPCL11.ASM


  0C3C B983      SPFLG:  MOV     R1,#FLAG3
  0C3E F1                MOV     A,@R1
  0C3F 430C              ORL     A,#$0C
  0C41 A1                MOV     @R1,A
  0C42 83                RET


  0C43 B91E      XFRBUF: MOV     R1,#$1E
  0C45 B8E3              MOV     R0,#NMBUF2
  0C47 F0        XFRBF1: MOV     A,@R0
  0C48 C8                DEC     R0
  0C49 C8                DEC     R0
  0C4A A0                MOV     @R0,A
  0C4B 18                INC     R0
  0C4C 18                INC     R0
  0C4D 18                INC     R0
  0C4E E947              DJNZ    R1,XFRBF1
  0C50 B984      CNTDEC: MOV     R1,#NMDCNT
  0C52 F1                MOV     A,@R1
  0C53 07                DEC     A
  0C54 A1                MOV     @R1,A
  0C55 83                RET
```

```
0C56 B986        TOTAL:  MOV     R1,#DATSUM
0C58 A1                  MOV     @R1,A
0C59 19                  INC     R1
0C5A A1                  MOV     @R1,A
0C5B 83                  RET
AVOCET SYSTEMS 8048 CROSS-ASSEMBLER -  VERSION 1.62

SOURCE FILE NAME: SPCL11.ASM


0C5C 37          DATCHK: CPL     A
0C5D F26F                JB7     VOID
0C5F 37                  CPL     A
0C60 537F                ANL     A,#$7F
0C62 B896                MOV     R0,#ACC1
0C64 A0                  MOV     @R0,A
0C65 B883                MOV     R0,#FLAG3
0C67 F0                  MOV     A,@R0
0C68 4310                ORL     A,#$10
0C6A A0                  MOV     @R0,A
0C6B B896                MOV     R0,#ACC1
0C6D F0                  MOV     A,@R0
0C6E 83                  RET

0C6F 37          VOID:   CPL     A
0C70 83                  RET


0C71 0A          ALARM1: IN      A,P2
0C72 537F                ANL     A,#$7F
0C74 3A                  OUTL    P2,A
0C75 B8FF        DELAY:  MOV     R0,#$FF
0C77 B9FF        AL1:    MOV     R1,#$FF
0C79 E979        AL2:    DJNZ    R1,AL2
0C7B E877                DJNZ    R0,AL1
0C7D 4380                ORL     A,#$80
0C7F 3A                  OUTL    P2,A
0C80 83                  RET


0C81 B8FF        DLY:    MOV     R0,#$FF
0C83 B9FF                MOV     R1,#$FF
0C85 00          DLY1:   NOP
```

```
0C86 E885                DJNZ    R0,DLY1
0C88 E985                DJNZ    R1,DLY1
0C8A 83                  RET
```

AVOCET SYSTEMS 8048 CROSS-ASSEMBLER - VERSION 1.62

SOURCE FILE NAME: SPCL11.ASM

```
0C8B B979        COLD:   MOV     R1,#R1REG
0C8D F1                  MOV     A,@R1
0C8E A9                  MOV     R1,A
0C8F FC                  MOV     A,R4
0C90 AB                  MOV     R3,A

0C91 B1FF        FILLUP: MOV     @R1,#$FF
0C93 19                  INC     R1
0C94 EB91                DJNZ    R3,FILLUP
0C96 83                  RET
```

RS AVOCET SYSTEMS 8048 CROSS-ASSEMBLER - VER

SOURCE FILE NAME: SPCL11.ASM

```
0C97 15          MODE10: DIS     I
0C98 D5                  SEL     RB1
0C99 BA0A                MOV     R2,#$0A
0C9B C5                  SEL     RB0
0C9C 05                  EN      I
0C9D 83                  RET
```

```
0C9E 15          GETMOD: DIS     I
0C9F D5                  SEL     RB1
0CA0 FA                  MOV     A,R2
0CA1 C5                  SEL     RB0
0CA2 05                  EN      I
0CA3 83                  RET
```

```
0CA4 B880        WEIGHT: MOV     R0,#PAPE
0CA6 F0                  MOV     A,@R0
0CA7 AB                  MOV     R3,A
0CA8 B800                MOV     R0,#$00
0CAA D301                XRL     A,#A
0CAC C6BE                JZ      ASIZE
0CAE FB                  MOV     A,R3
0CAF D302                XRL     A,#B
```

```
0CB1 C6BD                JZ      BSIZE
0CB3 FB                  MOV     A,R3
0CB4 D303                XRL     A,#C
0CB6 C6BA                JZ      CSIZE


0CB8 18                  INC     R0
0CB9 18                  INC     R0
0CBA 18          CSIZE:  INC     R0
0CBB 18                  INC     R0
0CBC 18                  INC     R0
0CBD 18          BSIZE:  INC     R0
0CBE 18          ASIZE:  INC     R0
0CBF F1                  MOV     A,@R1
0CC0 68                  ADD     A,R0
0CC1 A1                  MOV     @R1,A
0CC2 A8                  MOV     R0,A
0CC3 83                  RET
AVOCET SYSTEMS 8048 CROSS-ASSEMBLER -  VERSION 1.62

SOURCE FILE NAME: SPCL11.ASM

0D00                     ORG     $0D00
0D00 D30A        UPKEEP: XRL     A,#$0A
0D02 9606                JNZ     HOP1
0D04 A415                JMP     ATFIN

0D06 B997        HOP1:   MOV     R1,#EOJREG
0D08 11                  INC     @R1
0D09 F1                  MOV     A,@R1
0D0A D301                XRL     A,#$01
0D0C 9615                JNZ     ATFIN
0D0E FA                  MOV     A,R2
0D0F 4310                ORL     A,#$10
0D11 AA                  MOV     R2,A
0D12 B425                CALL    SPCHK
0D14 83                  RET


0D15 B984        ATFIN:  MOV     R1,#NMDCNT
0D17 F1                  MOV     A,@R1
0D18 C624                JZ      NOCT
0D1A 97                  CLR     C
0D1B F7                  RLC     A
0D1C B9E0                MOV     R1,#NMDBUF
0D1E 69                  ADD     A,R1
0D1F A9                  MOV     R1,A
0D20 F1                  MOV     A,@R1
0D21 4380                ORL     A,#$80
0D23 A1                  MOV     @R1,A

0D24 83          NOCT:   RET

0D25 B983        SPCHK:  MOV     R1,#FLAG3
0D27 F1                  MOV     A,@R1
0D28 7231                JB3     MOCODE
```

```
0D2A FD                 MOV     A,R5
0D2B 6C                 ADD     A,R4
0D2C B987               MOV     R1,#FINSUM
```

AVOCET SYSTEMS 8048 CROSS-ASSEMBLER - VERSION 1.62

SOURCE FILE NAME: SPCL11.ASM

```
0D2E A1                 MOV     @R1,A
0D2F A437               JMP     TOFIN

0D31 B986       MOCODE: MOV     R1,#DATSUM
0D33 F1                 MOV     A,@R1
0D34 B987               MOV     R1,#FINSUM
0D36 A1                 MOV     @R1,A
0D37 83         TOFIN:  RET


0D38 B983       NOCAN:  MOV     R1,#FLAG3
0D3A F1                 MOV     A,@R1
0D3B 523F               JB2     JIP1
0D3D A4D1               JMP     GETOUT
0D3F 949E       JIP1:   CALL    GETMOD
0D41 A9                 MOV     R1,A
0D42 D333               XRL     A,#$33
0D44 C68E               JZ      COLLECT


0D46 F9                 MOV     A,R1
0D47 D332               XRL     A,#$32
0D49 C652               JZ      STACK

0D4B F9                 MOV     A,R1
0D4C D331               XRL     A,#$31
0D4E C6AF               JZ      COLL

0D50 A4D1               JMP     GETOUT

0D52 F9         STACK:  MOV     A,R1
0D53 B985               MOV     R1,#CUSTODY
0D55 D1                 XRL     A,@R1
0D56 C65C               JZ      HOP11
0D58

0D58 D42F       OUTHER: CALL    NEWMOD
0D5A A4D1               JMP     GETOUT

0D5C B984       HOP11:  MOV     R1,#NMDCNT
0D5E F1                 MOV     A,@R1
0D5F 9658               JNZ     OUTHER
```

AVOCET SYSTEMS 8048 CROSS-ASSEMBLER - VERSION

SOURCE FILE NAME: SPCL11.ASM

```
0D61 FA                 MOV     A,R2
0D62 37                 CPL     A
0D63 9267               JB4     SOKAY
0D65 A458               JMP     OUTHER
0D67 D412       SOKAY:  CALL    BINNY

0D69 B9FA               MOV     R1,#EMPBIN
0D6B F1         LOOP1:  MOV     A,@R1
0D6C DB                 XRL     A,R3
0D6D C677               JZ      NOTBAD
0D6F EB6B               DJNZ    R3,LOOP1

0D71 BB01               MOV     R3,#$01


0D73 D400               CALL    ERQTY1
0D75 A4D1               JMP     GETOUT


0D77 B983       NOTBAD: MOV     R1,#FLAG3
0D79 F1                 MOV     A,@R1
0D7A 4308               ORL     A,#$08
0D7C A1                 MOV     @R1,A
0D7D B986               MOV     R1,#DATSUM
0D7F F8                 MOV     A,R0
0D80 61                 ADD     A,@R1
0D81 A1                 MOV     @R1,A
0D82 B988               MOV     R1,#STKBIN
0D84 11                 INC     @R1
0D85 F1                 MOV     A,@R1
0D86 B98A               MOV     R1,#CNT
0D88 69                 ADD     A,R1
0D89 A9                 MOV     R1,A
0D8A F8                 MOV     A,R0
0D8B A1                 MOV     @R1,A
0D8C A4D1               JMP     GETOUT
0D8E

0D8E F9         COLLECT:MOV     A,R1
0D8F B985               MOV     R1,#CUSTODY
0D91 D1                 XRL     A,@R1
0D92 C696               JZ      HOP12
0D94

0D94 A458               JMP     OUTHER
0D96
0D96 B984       HOP12:  MOV     R1,#NMDCNT
0D98 F1                 MOV     A,@R1
0D99 9658               JNZ     OUTHER
```

AVOCET SYSTEMS 8048 CROSS-ASSEMBLER - VERSION 1.62

SOURCE FILE NAME: SPCL11.ASM

```
0D9B FA                 MOV     A,R2
0D9C 37                 CPL     A
0D9D 92A1               JB4     SKAY
0D9F A458               JMP     OUTHER
0DA1 B983       SKAY:   MOV     R1,#FLAG3
0DA3 F1                 MOV     A,@R1
0DA4 4308               ORL     A,#$08
0DA6 A1                 MOV     @R1,A
0DA7 FC                 MOV     A,R4
0DA8 68                 ADD     A,R0
0DA9 AC                 MOV     R4,A
0DAA B986               MOV     R1,#DATSUM
0DAC A1                 MOV     @R1,A
0DAD A4D1               JMP     GETOUT

0DAF F9         COLL:   MOV     A,R1
0DB0 B985               MOV     R1,#CUSTODY
0DB2 F1                 MOV     A,@R1
0DB3 D331               XRL     A,#$31
0DB5 9658               JNZ     OUTHER
0DB7 B984               MOV     R1,#NMDCNT
0DB9 F1                 MOV     A,@R1
0DBA 96C0               JNZ     OUTHR1
0DBC FA                 MOV     A,R2
0DBD 37                 CPL     A
0DBE 92C4               JB4     ERR2
0DC0 B985       OUTHR1: MOV     R1,#CUSTODY
0DC2 A458               JMP     OUTHER

0DC4 FA         ERR2:   MOV     A,R2
0DC5 4302               ORL     A,#$02
0DC7 AA                 MOV     R2,A
0DC8 B97C               MOV     R1,#FLAGS
0DCA F1                 MOV     A,@R1
0DCB 4308               ORL     A,#$08
0DCD A1                 MOV     @R1,A
0DCE 1400               CALL    STATUS
0DD0 83                 RET

0DD1


0DD1 83         GETOUT: RET


0E00                    ORG     $0E00
0E00 B97C       ERQTY1: MOV     R1,#FLAGS
```

AVOCET SYSTEMS 8048 CROSS-ASSEMBLER - VERSION 1.62

SOURCE FILE NAME: SPCL11.ASM

```
0E02 F1                 MOV     A,@R1
0E03 4308               ORL     A,#$08
0E05 A1                 MOV     @R1,A
0E06 1400               CALL    STATUS
0E08 FA                 MOV     A,R2
0E09 4302               ORL     A,#$02
0E0B AA                 MOV     R2,A
0E0C B9FA               MOV     R1,#EMPBIN
0E0E F1                 MOV     A,@R1
0E0F 07                 DEC     A
0E10 A1                 MOV     @R1,A
0E11 83                 RET
```

```
0E12 B9FA       BINNY:  MOV     R1,#EMPBIN
0E14 11                 INC     @R1
0E15 FE         BINO:   MOV     A,R6
0E16 4340               ORL     A,#$40
0E18 A9                 MOV     R1,A
0E19 19                 INC     R1
0E1A BB00               MOV     R3,#$00
0E1C F1         LOOP:   MOV     A,@R1
0E1D 9620               JNZ     NOEMP
0E1F 1B                 INC     R3
0E20 19         NOEMP:  INC     R1
0E21 235A               MOV     A,#$5A
0E23 D9                 XRL     A,R1
0E24 9628               JNZ     STEP7
0E26 B941               MOV     R1,#$41
0E28 F9         STEP7:  MOV     A,R1
0E29 53BF               ANL     A,#$BF
0E2B DE                 XRL     A,R6
0E2C 961C               JNZ     LOOP
0E2E 83                 RET
```

```
0E2F FA         NEWMOD: MOV     A,R2
0E30 37                 CPL     A
0E31 9282               JB4     ABORT
```

```
3I( AVOCET SYSTEMS 8048 CROSS-ASSEMBLER -  VERSION

   SOURCE FILE NAME: SPCL11.ASM


    0E33 F1                  MOV     A,@R1
    0E34 D331                XRL     A,#$31
    0E36 C657                JZ      COLLAT
    0E38 D412                CALL    BINNY
    0E3A B9FA                MOV     R1,#EMPBIN

    0E3C F1         LOOP2:   MOV     A,@R1
    0E3D DB                  XRL     A,R3
    0E3E C645                JZ      NBAD1
    0E40 EB3C                DJNZ    R3,LOOP2

    0E42 D400                CALL    ERQTY1
    0E44 83                  RET

    0E45 B984       NBAD1:   MOV     R1,#NMDCNT
    0E47 11                  INC     @R1
    0E48 F1                  MOV     A,@R1
    0E49 97                  CLR     C
    0E4A F7                  RLC     A
    0E4B B9E0                MOV     R1,#NMDBUF
    0E4D 69                  ADD     A,R1
    0E4E A9                  MOV     R1,A
    0E4F F8                  MOV     A,R0
    0E50 A1                  MOV     @R1,A
    0E51 C9                  DEC     R1
    0E52 B885                MOV     R0,#CUSTODY
    0E54 F0                  MOV     A,@R0
    0E55 A1                  MOV     @R1,A

    0E56 83                  RET


    0E57 B983       COLLAT:  MOV     R1,#FLAG3
    0E59 F1                  MOV     A,@R1
    0E5A 4380                ORL     A,#$80
    0E5C A1                  MOV     @R1,A
    0E5D B279                JB5     B6
    0E5F 4320                ORL     A,#$20
    0E61 A1                  MOV     @R1,A
    0E62
    0E62 B9FE                MOV     R1,#BLUF1
    0E64 F8                  MOV     A,R0
    0E65 A1                  MOV     @R1,A

    0E66 B9FA       CUTIN:   MOV     R1,#EMPBIN
    0E68 F8                  MOV     A,R0
    0E69 61                  ADD     A,@R1
    0E6A A1                  MOV     @R1,A
    0E6B F400                CALL    SEARCH
    0E6D B9FD                MOV     R1,#BLUF
    0E6F F1                  MOV     A,@R1
```

```
AVOCET SYSTEMS 8048 CROSS-ASSEMBLER -  VERSION 1.62

SOURCE FILE NAME: SPCL11.ASM


 0E70 A8                    MOV      R0,A
 0E71 B97C                  MOV      R1,#FLAGS
 0E73 F1                    MOV      A,@R1
 0E74 5308                  ANL      A,#$08
 0E76 C645                  JZ       NBAD1
 0E78
 0E78 83                    RET

 0E79 4340        B6:       ORL      A,#$40
 0E7B A1                    MOV      @R1,A
 0E7C
 0E7C F8                    MOV      A,R0
 0E7D B9FF                  MOV      R1,#BLUF2
 0E7F A1                    MOV      @R1,A

 0E80 C466                  JMP      CUTIN


 0E82 00          ABORT:    NOP
 0E83 83                    RET




 0E84 F1          COLLSCH:  MOV      A,@R1
 0E85 9699                  JNZ      HOP3
 0E87 EB8A                  DJNZ     R3,HOP5
 0E89 83                    RET
 0E8A 19          HOP5:     INC      R1
 0E8B 235A                  MOV      A,#$5A
 0E8D D9                    XRL      A,R1
 0E8E 9692                  JNZ      NOPE
 0E90 B941                  MOV      R1,#$41
 0E92 B8FC        NOPE:     MOV      R0,#R2REG
 0E94 F0                    MOV      A,@R0
 0E95 D9                    XRL      A,R1
 0E96 9684                  JNZ      COLLSCH
 0E98 83                    RET
 0E99 B8FD        HOP3:     MOV      R0,#BLUF
 0E9B F0                    MOV      A,@R0
 0E9C AB                    MOV      R3,A
 0E9D C48A                  JMP      HOP5
AVOCET SYSTEMS 8048 CROSS-ASSEMBLER -  VERSION 1.62

SOURCE FILE NAME: SPCL11.ASM

 0E9F FC          GOTCHA:   MOV      A,R4
 0EA0 AB                    MOV      R3,A
 0EA1 EBA5        MERRY2:   DJNZ     R3,HOP4
```

```
0EA3 C4AF                JMP     MERRY4
0EA5 C9          HOP4:   DEC     R1
0EA6 2340                MOV     A,#$40
0EA8 D9                  XRL     A,R1
0EA9 96AD                JNZ     NOPE2
0EAB B959                MOV     R1,#$59
0EAD C4A1        NOPE2:  JMP     MERRY2
0EAF F9          MERRY4: MOV     A,R1
0EB0 53BF                ANL     A,#$BF
0EB2 A9                  MOV     R1,A
0EB3 1B          MERRY3: INC     R3
0EB4 1E                  INC     R6
0EB5 FE                  MOV     A,R6
0EB6 D31A                XRL     A,#$1A
0EB8 96BC                JNZ     NOPE3
0EBA BE01                MOV     R6,#$01
0EBC F9          NOPE3:  MOV     A,R1
0EBD DE                  XRL     A,R6
0EBE 96B3                JNZ     MERRY3
0EC0 B879                MOV     R0,#R1REG
0EC2 F9                  MOV     A,R1
0EC3 4340                ORL     A,#$40
0EC5 A0                  MOV     @R0,A
0EC6 FB                  MOV     A,R3
0EC7 D319                XRL     A,#$19
0EC9 C6CD                JZ      RESPRV
0ECB 343E                CALL    MOTOR
0ECD 83          RESPRV: RET
```

```
0ECE                                          ** IN THE SEARCH **

0ECE 949E        R1ADJ:  CALL    GETMOD
0ED0 D331                XRL     A,#$31
0ED2 96E6                JNZ     STEP8
0ED4 FC                  MOV     A,R4
0ED5 AB                  MOV     R3,A
0ED6 B979                MOV     R1,#R1REG
0ED8 F1                  MOV     A,@R1
0ED9 A0                  MOV     @R0,A
0EDA A9                  MOV     R1,A
0EDB 19          LOOP7:  INC     R1
```

3 8048 CROSS-ASSEMBLER - VERSION 1.62

ME: SPCL11.ASM

```
            MOV     A,#$5A
            XRL     A,R1
            JNZ     HOP30
            MOV     R1,#$41
   HOP30:   DJNZ    R3,LOOP7
            RET
```

```
STEP8:  MOV     R3,#$01
        JMP     LOOP7


B7FLG3: MOV     R0,#FLAG3
        MOV     A,@R0
        ANL     A,#$7F
        MOV     @R0,A
        RET


** FOR THOSE MODES HELD IN STORAGE BUFFER **

        ORG     $0F00
SEARCH: CALL    BINO
        MOV     R1,#EMPBIN
LOOP3:  MOV     A,@R1
        XRL     A,R3
        JZ      UNDIT
        DJNZ    R3,LOOP3

        MOV     R3,#$01
        CALL    COLLIMP
        CALL    B7FLG3
        RET


UNDIT:  MOV     R1,#FLAG3
        MOV     A,@R1
        JB5     STEP15
        RET

STEP15: MOV     A,R6
```

AVOCET SYSTEMS 8048 CROSS-ASSEMBLER - VERSION 1. AVOCET SYSTEMS

SOURCE FILE NAME: SPCL11.ASM SOURCE FILE NA

```
0F18 4340       ORL     A,#$40          0EDC 235A
0F1A B8FC       MOV     R0,#R2REG       0EDE D9
0F1C A0         MOV     @R0,A           0EDF 96E3
0F1D A9         MOV     R1,A            0EE1 B941
0F1E D4CE       CALL    R1ADJ           0EE3 EBDB
                                        0EE5 83
```

```
0F20 B8FE                MOV     R0,#BLUF1
0F22 F0                  MOV     A,@R0
0F23 C8                  DEC     R0
0F24 A0                  MOV     @R0,A
0F25 AB                  MOV     R3,A

0F26 D484                CALL    COLLSCH
0F28
0F28

0F28 FB                  MOV     A,R3
0F29 9690                JNZ     STEP13
0F2B B883                MOV     R0,#FLAG3
0F2D F0                  MOV     A,@R0
0F2E D233                JB6     MORE1
0F30
0F30 D4EA                CALL    B7FLG3
0F32 83                  RET
0F33 B8FE       MORE1:   MOV     R0,#BLUF1
0F35 F0                  MOV     A,@R0
0F36 AB                  MOV     R3,A
0F37 CB                  DEC     R3
0F38 F9                  MOV     A,R1
0F39
0F39 A8                  MOV     R0,A
0F3A C8         SUBTRAC:DEC      R0
0F3B 2340                MOV     A,#$40
0F3D D8                  XRL     A,R0
0F3E 9642                JNZ     GETEM
0F40 B859                MOV     R0,#$59
0F42 E83A       GETEM:   DJNZ    R3,SUBTRAC
0F44 F8                  MOV     A,R0
0F45 B8FB                MOV     R0,#R3REG
0F47
0F47 A0                  MOV     @R0,A
0F48 19                  INC     R1
0F49 B8FF                MOV     R0,#BLUF2
0F4B F0                  MOV     A,@R0
0F4C AB                  MOV     R3,A
0F4D C8                  DEC     R0
0F4E C8                  DEC     R0
0F4F A0                  MOV     @R0,A
```

```
0EE6 BB01
0EE8 C4DB

0EEA B883
0EEC F0
0EED 537F
0EEF A0
0EF0 83

0EF1

0F00
0F00 D415
0F02 B9FA
0F04 F1
0F05 DB
0F06 C611
0F08 EB04

0F0A BB01
0F0C F4A5
0F0E D4EA
0F10 83

0F11 B983
0F13 F1
0F14 B217
0F16 83

0F17 FE
```

AVOCET SYSTEMS 8048 CROSS-ASSEMBLER - VERS

SOURCE FILE NAME: SPCL11.ASM

```
0F50

0F50 D484                CALL    COLLSCH
0F52
0F52
0F52 FB                  MOV     A,R3
```

```
0F53 9658                JNZ     LASTRND
0F55 D4EA                CALL    B7FLG3
0F57 83                  RET

0F58 B8FB       LASTRND:MOV      R0,#R3REG
0F5A 19                  INC     R1
0F5B 235A                MOV     A,#$5A
0F5D D9                  XRL     A,R1
0F5E 9662                JNZ     HOP18
0F60 B941                MOV     R1,#$41
0F62 F0         HOP18:   MOV     A,@R0
0F63 D9                  XRL     A,R1
0F64 C687                JZ      STEP9
0F66 B8FC                MOV     R0,#R2REG
0F68 C9                  DEC     R1
0F69 2340                MOV     A,#$40
0F6B D9                  XRL     A,R1
0F6C 9670                JNZ     HOP19
0F6E B959                MOV     R1,#$59
0F70 D4CE       HOP19:   CALL    R1ADJ
0F72 B8FF                MOV     R0,#BLUF2
0F74 F0                  MOV     A,@R0
0F75 AB                  MOV     R3,A
0F76 B8FB                MOV     R0,#R3REG
0F78 F0                  MOV     A,@R0
0F79 B8FC                MOV     R0,#R2REG
0F7B A0                  MOV     @R0,A
0F7C D9                  XRL     A,R1
0F7D C687                JZ      STEP9
0F7F


0F7F D484                CALL    COLLSCH
0F81 FB                  MOV     A,R3
0F82 9687                JNZ     STEP9
0F84 D4EA                CALL    B7FLG3
0F86 83                  RET

0F87 F4A5       STEP9:   CALL    COLLIMP
0F89 B883                MOV     R0,#FLAG3
0F8B F0                  MOV     A,@R0
0F8C 533F                ANL     A,#$3F
0F8E A0                  MOV     @R0,A
AVOCET SYSTEMS 8048 CROSS-ASSEMBLER -  VERSION 1.62

SOURCE FILE NAME: SPCL11.ASM


0F8F
0F8F 83                  RET


0F90 F4A5       STEP13:  CALL    COLLIMP
0F92 B983                MOV     R1,#FLAG3
0F94 F1                  MOV     A,@R1
0F95 D29B                JB6     STEP14
0F97
0F97 535F                ANL     A,#$5F
```

```
0F99 A1                    MOV     @R1,A
0F9A 83                    RET

0F9B 533F        STEP14:   ANL     A,#$3F
0F9D A1                    MOV     @R1,A
0F9E B8FF                  MOV     R0,#BLUF2
0FA0 B9FE                  MOV     R1,#BLUF1
0FA2 F0                    MOV     A,@R0
0FA3 A1                    MOV     @R1,A
0FA4 83                    RET


0FA5

0FA5 D400        COLLIMP:CALL      ERQTY1

0FA7 B883                  MOV     R0,#FLAG3
0FA9 F0                    MOV     A,@R0
0FAA F2DD                  JB7     NOCAN1

0FAC B884                  MOV     R0,#NMDCNT
0FAE F0                    MOV     A,@R0
0FAF A9                    MOV     R1,A
0FB0 E7          HOP7:     RL      A
0FB1 E9B0                  DJNZ    R1,HOP7
0FB3 B9E0                  MOV     R1,#NMDBUF
0FB5 69                    ADD     A,R1
0FB6 A9                    MOV     R1,A
0FB7 C9                    DEC     R1
0FB8
0FB8 F1                    MOV     A,@R1
0FB9 D331                  XRL     A,#$31
0FBB 96D0                  JNZ     STEP10
0FBD B883                  MOV     R0,#FLAG3
AVOCET SYSTEMS 8048 CROSS-ASSEMBLER -   V

SOURCE FILE NAME: SPCL11.ASM


0FEF F0          RESCOL:   MOV     A,@R0
0FF0 37                    CPL     A
0FF1 D2F8                  JB6     NOCOLL2
0FF3
0FF3 37                    CPL     A
0FF4 53BF                  ANL     A,#$BF
0FF6 A0                    MOV     @R0,A
0FF7 83                    RET

0FF8 37          NOCOLL2:CPL       A
0FF9 53DF                  ANL     A,#$DF
0FFB A0                    MOV     @R0,A
0FFC 83                    RET


0000                       END
```

AVOCET SYSTEMS 8048 CROSS-ASSEMBLER - VERSION 1.62

SOURCE FILE NAME: SPCL11.ASM
---- SYMBOL TABLE ----

| | | | | | | | |
|---|---|---|---|---|---|---|---|
| A | 0001 | CNT | 008A | ENDJOB | 0854 | HOP6 | 0010 |
| ABND | 0559 | CNT1 | 008B | EOJ | 0A79 | HOP7 | 0FB0 |
| ABORT | 0E82 | CNT2 | 008C | EOJ1 | 0A83 | HOP8 | 0FED |
| ACC1 | 0096 | CNTBF | 00D0 | EOJREG | 0097 | HOP08 | 03A1 |
| ACCUM | 0061 | CNTBF1 | 00D1 | EQUAL | 021B | HOP09 | 0360 |
| ACTSUM | 0089 | CNTBF2 | 00D2 | ERISHMN | 0474 | IHOP | 0238 |
| ADD | 0253 | CNTCNT | 0357 | ERMES1 | 041B | INIT | 0517 |
| AGN4 | 0259 | CNTDEC | 0C50 | ERQTY1 | 0E00 | INT | 0005 |
| AL1 | 0C77 | CNTEROR | 085B | ERR2 | 0DC4 | INTRPT | 0708 |
| AL2 | 0C79 | CNTXFR | 0C30 | FILLUP | 0C91 | JAM | 08A8 |
| ALARM | 0A03 | COLD | 0C8B | FIN | 0563 | JIP | 03A8 |
| ALARM1 | 0C71 | COLDON | 02C1 | FINE | 0718 | JIP1 | 0D3F |
| ALLOFF | 0965 | COLL | 0DAF | FINSUM | 0087 | JOBOVR | 0A55 |
| APPTR | 0064 | COLLAT | 0E57 | FIVER | 01C6 | JTGL | 090C |
| ARND3 | 0277 | COLLECT | 0D8E | FLAG1 | 0074 | KEEPER | 0082 |
| ARND4 | 028A | COLLIMP | 0FA5 | FLAG3 | 0083 | KEY | 0081 |
| ASIZE | 0CBE | COLLORG | 07CC | FLAGS | 007C | KEYRET | 007D |
| ATFIN | 0D15 | COLLRUN | 0870 | FLG1 | 07C7 | KEYSUB | 06A0 |
| B | 0002 | COLLSCH | 0E84 | FREE | 0A5D | LASTRND | 0F58 |
| B6 | 0E79 | COLLSTP | 0846 | FULL | 020C | LATER | 0A86 |
| B7FLG3 | 0EEA | COMPAR | 02A1 | FWD1 | 0446 | LF | 0786 |
| BINNY | 0E12 | CONFG1 | 0AC4 | FWD2 | 0C24 | LOOKOUT | 028C |
| BINO | 0E15 | CONFIG | 0AB6 | GETEM | 0F42 | LOOP | 0E1C |
| BINSEMP | 083F | CONSEC | 00F0 | GETMOD | 0C9E | LOOP1 | 0D6B |
| BINSFUL | 084D | CONTIN | 02BB | GETOUT | 0DD1 | LOOP2 | 0E3C |
| BINSNO | 0814 | CR | 0776 | GOTCHA | 0E9F | LOOP3 | 0F04 |
| BIT1 | 0792 | CRDSRT | 00F1 | HANG | 012C | LOOP4 | 0AB1 |
| BLUF | 00FD | CSIZE | 0CBA | HDPTR | 0063 | LOOP5 | 031D |
| BLUF1 | 00FE | CUSTODY | 0085 | HDPTR1 | 0062 | LOOP6 | 0C34 |
| BLUF2 | 00FF | CUTIN | 0E66 | HEFTY | 096A | LOOP7 | 0EDB |
| BN | 0C0A | D | 0004 | HERE | 0144 | LOOP8 | 0AC0 |
| BN1 | 0C10 | DATA | 03C1 | HOME | 0245 | MDE1 | 0263 |
| BREAK0 | 0192 | DATCHK | 0C5C | HOP1 | 0D06 | MDFV | 0407 |
| BREAK1 | 0151 | DATEQL | 07F9 | HOP10 | 0219 | MEM | 002E |
| BREAK2 | 01AF | DATSUM | 0086 | HOP11 | 0D5C | MERRY2 | 0EA1 |
| BSIZE | 0CBD | DCR | 094C | HOP12 | 0D96 | MERRY3 | 0EB3 |
| BUFF | 058C | DELAY | 0C75 | HOP14 | 0748 | MERRY4 | 0EAF |
| BUFF1 | 00BF | DIRCTR | 0078 | HOP15 | 032A | MERYGO | 0461 |
| BUTTIN | 0A0D | DLY | 0C81 | HOP16 | 0A6E | MESEND | 07E3 |
| BYP2 | 010A | DLY1 | 0C85 | HOP17 | 0825 | MESS | 02F0 |
| BYPASS | 029C | DLY2 | 0757 | HOP18 | 0F62 | MESS1 | 0098 |
| BYTES | 007E | DOIT | 0738 | HOP19 | 0F70 | MIMIC | 0700 |
| C | 0003 | DONOW | 029E | HOP2 | 03D0 | MIP | 03B4 |
| CALLO | 0247 | DOWN | 0093 | HOP20 | 02CD | MNLOOP | 004B |
| CHAR | 07EF | DUNE | 0795 | HOP3 | 0E99 | MOCODE | 0D31 |
| CHKCOL | 0AE4 | DWTDIF | 00B1 | HOP30 | 0EE3 | MODE | 01BA |
| CHKLATE | 0B4F | ECHER | 00E6 | HOP31 | 0808 | MODE1 | 0500 |
| CHKSTK | 0B11 | ECHO | 0065 | HOP32 | 0B0F | MODE10 | 0C97 |
| CKOUT | 062B | ECODUN | 00E0 | HOP4 | 0EA5 | MODE3 | 0227 |
| CLECTO | 09CC | EMPBIN | 00FA | HOP40 | 0C18 | MOFF | 0066 |
| CLERE | 0135 | EMPT | 048A | HOP5 | 0E8A | MOMODE | 043D |

AVOCET SYSTEMS 8048 CROSS-ASSEMBLER - VERSION 1.62

SOURCE FILE NAME: SPCL11.ASM
---- SYMBOL TABLE ----

| | | | | | | | |
|---|---|---|---|---|---|---|---|
| OUT1 | 00C0 | RESFG3 | 008E | SPECBIN | 0070 | STEP8 | 0EE6 |
| OUT2 | 00C3 | RESPRV | 0ECD | SPECIAL | 0877 | STEP9 | 0F87 |
| OUT3 | 072F | REVER | 027D | SPFLG | 0C3C | STKBIN | 0088 |
| OUT4 | 075D | SEARCH | 0F00 | SPLATE | 0B56 | STOP | 08B8 |
| OUTHER | 0D58 | SETB1 | 07A7 | SPMOD | 02A6 | STOPRUG | 02D3 |
| OUTHR1 | 0DC0 | SETB2 | 07AD | SPSTK | 0B1A | STORY | 0600 |
| OVER | 0A00 | SETB3 | 07B3 | SRTCLR | 08C7 | STOVR | 0639 |
| OVER2 | 0A01 | SETB4 | 07B9 | STACK | 0D52 | SUBTRAC | 0F3A |
| OVRSTK | 063D | SETB5 | 07BF | START | 0000 | SUBTRC | 0A24 |
| PAGE4 | 0400 | SETB6 | 07C5 | STAT | 088F | SUM | 0436 |
| PAPE | 0080 | SETUP | 083B | STATINT | 037B | SURESRT | 0351 |
| PAPER | 0100 | SKAY | 0DA1 | STATUS | 0800 | TABLE | 0897 |
| PAPPY | 0070 | SKIP | 045F | STEP0 | 0A99 | TAGN | 00A8 |
| PMODES | 038C | SKIP0 | 015F | STEP1 | 0AB5 | TDE | 0933 |

| | | | | | | | |
|---|---|---|---|---|---|---|---|
| PREFIN | 0539 | SKIP1 | 016F | STEP10 | 0FD0 | TDEL | 0931 |
| PRTR | 0723 | SKIP2 | 0162 | STEP11 | 0FCB | TDELAY | 092F |
| PTRLOC | 0579 | SKIP3 | 0177 | STEP12 | 0FD7 | TEMPTY | 00B1 |
| QTYER1 | 0862 | SKIP4 | 019A | STEP13 | 0F90 | TGL1 | 090A |
| QTYER2 | 0869 | SKIP5 | 0189 | STEP14 | 0F9B | TGLE | 0924 |
| R1ADJ | 0ECE | SKIP6 | 0554 | STEP15 | 0F17 | TOFIN | 0D37 |
| R1REG | 0079 | SKIP7 | 0550 | STEP16 | 0FC1 | TOGGLE | 0900 |
| R1VIL | 046A | SKIP8 | 0543 | STEP2 | 0B18 | TOGPTR | 0060 |
| R2REG | 00FC | SKIP9 | 0548 | STEP3 | 0B5F | TOTAL | 0C56 |
| R3REG | 00FB | SKIPTWN | 0087 | STEP4 | 0B77 | TRY | 06B6 |
| RES | 009A | SOKAY | 0D67 | STEP5 | 0B4D | TRYAGN | 0733 |
| RES1 | 0076 | SPCHK | 0D25 | STEP6 | 0B46 | TST3 | 0944 |
| RESCOL | 0FEF | SPCOL | 0AEB | STEP7 | 0E28 | TST4 | 0948 |

```
C0>TYPE SPCL11A.PRN

AVOCET SYSTEMS 8048 CROSS-ASSEMBLER -  VERSION 1.62

SOURCE FILE NAME: SPCL11A.ASM

AVOCET SYSTEMS 8048 CROSS-ASSEMBLER -  VERSION 1.62

SOURCE FILE NAME: SPCL11A.ASM

AVOCET SYSTEMS 8048 CROSS-ASSEMBLER -  VERSION 1.62

SOURCE FILE NAME: SPCL11A.ASM

AVOCET SYSTEMS 8048 CROSS-ASSEMBLER -  VERSION 1.62

SOURCE FILE NAME: SPCL11A.ASM

AVOCET SYSTEMS 8048 CROSS-ASSEMBLER -  VERSION 1.62

SOURCE FILE NAME: SPCL11A.ASM

03FC                    ORG     $3FC
03FC 2AFF0D0A           DB      $2A,$FF,$0D,$0A


0060            TOGPTR  EQU     $60
0061            ACCUM   EQU     $61
0078            DIRCTR  EQU     $78
0077            MULT    EQU     $77
0070            SPECBIN EQU     $70
007C            FLAGS   EQU     $7C
0079            R1REG   EQU     $79
009C            MXWTDF  EQU     $9C


00B1            DWTDIF  EQU     $B1


0001            A       EQU     $01
0002            B       EQU     $02
0003            C       EQU     $03
0004            D       EQU     $04
0063            HDPTR   EQU     $63
0064            APPTR   EQU     $64
```

```
0065            ECHO     EQU     $65
0062            HDPTR1   EQU     $62
007E            BYTES    EQU     $7E
0080            PAPE     EQU     $80
0081            KEY      EQU     $81
0400
0400
0400

0082            KEEPER   EQU     $82
0083            FLAG3    EQU     $83
0084            NMDCNT   EQU     $84
0400
0086            DATSUM   EQU     $86
0087            FINSUM   EQU     $87
```

AVOCET SYSTEMS 8048 CROSS-ASSEMBLER - VERSI

SOURCE FILE NAME: SPCL11A.ASM

```
0085            CUSTODY  EQU     $85
00BF            BUFF1    EQU     $BF
00FA            EMPBIN   EQU     $FA
0089            ACTSUM   EQU     $89
008A            CNT      EQU     $8A
008B            CNT1     EQU     $8B
008C            CNT2     EQU     $8C
00E0            NMDBUF   EQU     $E0
00E1            NMBUF1   EQU     $E1
00E3            NMBUF2   EQU     $E3
0088            STKBIN   EQU     $88
0097            EOJREG   EQU     $97
0096            ACC1     EQU     $96
0400
00FE            BLUF1    EQU     $FE
00FF            BLUF2    EQU     $FF
00FD            BLUF     EQU     $FD
00FC            R2REG    EQU     $FC
0400
00FB            R3REG    EQU     $FB
00D0            CNTBF    EQU     $D0
00D1            CNTBF1   EQU     $D1
00D2            CNTBF2   EQU     $D2

00F0            CONSEC   EQU     $F0
00F1            CRDSRT   EQU     $F1

0003                     ORG     $03
0003 E408                JMP     INTRPT

0005 B864       FIVER:   MOV     R0,#APPTR
0007 F0                  MOV     A,@R0
0008 4340                ORL     A,#$40
000A A8                  MOV     R0,A
000B F0                  MOV     A,@R0
000C B970                MOV     R1,#SPECBIN
```

```
000E 47                    SWAP    A
000F 530F                  ANL     A,#$0F
0011 4330                  ORL     A,#$30
0013 A1                    MOV     @R1,A
AVOCET SYSTEMS 8048 CROSS-ASSEMBLER -  VERSION 1.62
SOURCE FILE NAME: SPCL11A.ASM

0014 F0                    MOV     A,@R0
0015 530F                  ANL     A,#$0F
0017 4330                  ORL     A,#$30
0019 19                    INC     R1
001A A1                    MOV     @R1,A
001B
001B B97C                  MOV     R1,#FLAGS
001D F1                    MOV     A,@R1
001E 4320                  ORL     A,#$20
0020 A1                    MOV     @R1,A
0021 15                    DIS     I
0022 F5                    SEL     MB1

0023 E5                    SEL     MB0
0024 05                    EN      I
0025 FA                    MOV     A,R2
0026 4302                  ORL     A,#$02
0028 AA                    MOV     R2,A

0029 B864                  MOV     R0,#APPTR
002B 10                    INC     @R0
002C F0                    MOV     A,@R0
002D AB                    MOV     R3,A
002E B863                  MOV     R0,#HDPTR
0030 F0                    MOV     A,@R0
0031 DB                    XRL     A,R3
0032 C63C                  JZ      PTREQ
0034 FB                    MOV     A,R3
0035 A8                    MOV     R0,A
0036 F0                    MOV     A,@R0
0037 AC                    MOV     R4,A
0038 F5                    SEL     MB1
0039 742C                  CALL    MTRADJ
003B E5                    SEL     MB0

003C FA          PTREQ:    MOV     A,R2
003D 537F                  ANL     A,#$7F
003F AA                    MOV     R2,A
0040 9242                  JB4     END1

0042 B863        END1:     MOV     R0,#HDPTR
0044 F0                    MOV     A,@R0
0045 AB                    MOV     R3,A
0046 B899                  MOV     R0,#$99
0048 F0          ALRITE:   MOV     A,@R0
0049 4340                  ORL     A,#$40
004B A9                    MOV     R1,A
004C B1FF                  MOV     @R1,#$FF
004E F8                    MOV     A,R0
004F 18                    INC     R0
```

```
AVOCET SYSTEMS 8048 CROSS-ASSEMBLER -  VER

SOURCE FILE NAME: SPCL11A.ASM


 0050 DB                    XRL     A,R3
 0051 9648                  JNZ     ALRITE
 0053 B964                  MOV     R1,#APPTR
 0055 B863                  MOV     R0,#HDPTR
 0057 2399                  MOV     A,#$99
 0059 A1                    MOV     @R1,A
 005A A0                    MOV     @R0,A
 005B 23D9                  MOV     A,#$D9
 005D B862                  MOV     R0,#HDPTR1
 005F A0                    MOV     @R0,A
 0060 FA                    MOV     A,R2
 0061 5301                  ANL     A,#$01
 0063 4302                  ORL     A,#$02
 0065 AA                    MOV     R2,A
 0066 B87C                  MOV     R0,#FLAGS
 0068 F0                    MOV     A,@R0
 0069 2362                  MOV     A,#$62
 006B A0                    MOV     @R0,A
 006C 0A                    IN      A,P2
 006D 4310                  ORL     A,#$10
 006F 53BF                  ANL     A,#$BF
 0071 3A                    OUTL    P2,A
 0072 15                    DIS     I
 0073 F5                    SEL     MB1

 0074 E5                    SEL     MB0
 0075 05                    EN      I
 0076 F5                    SEL     MB1

 0077 E5                    SEL     MB0
 0078 BF00                  MOV     R7,#$00
 007A BD00                  MOV     R5,#$00
 007C BC00                  MOV     R4,#$00
 007E F5                    SEL     MB1

 007F E5                    SEL     MB0


 0200                       ORG     $200

 0200 FC          MDFV:     MOV     A,R4
 0201 03E6                  ADD     A,#$E6
 0203 E605                  JNC     HOP9

 0205 FC          HOP9:     MOV     A,R4
 0206 4340                  ORL     A,#$40
 0208 A8                    MOV     R0,A
AVOCET SYSTEMS 8048 CROSS-ASSEMBLER -  VEI

SOURCE FILE NAME: SPCL11A.ASM
```

```
0209 F0                 MOV     A,@R0
020A D3FF               XRL     A,#$FF
020C 9610               JNZ     HOP8
020E 4430               JMP     ERMESS
0210 F5         HOP8:   SEL     MB1
0211 7474               CALL    SPECTBL
0213 E5                 SEL     MB0
0214 B863               MOV     R0,#HDPTR
0216 F0                 MOV     A,@R0
0217 961B               JNZ     COOL
0219 B099               MOV     @R0,#$99
021B F0         COOL:   MOV     A,@R0
021C A8                 MOV     R0,A
021D FC                 MOV     A,R4
021E A0                 MOV     @R0,A
021F B863               MOV     R0,#HDPTR
0221 10                 INC     @R0
0222 FA                 MOV     A,R2

0223 4380               ORL     A,#$80
0225 AA                 MOV     R2,A
0226 F5                 SEL     MB1
0227 742C               CALL    MTRADJ
0229 E5                 SEL     MB0
022A B87C               MOV     R0,#FLAGS
022C F0                 MOV     A,@R0
022D 53FE               ANL     A,#$FE
022F A0                 MOV     @R0,A

0230 B87C       ERMESS: MOV     R0,#FLAGS
0232 F0                 MOV     A,@R0
0233 4348               ORL     A,#$48
0235 A0                 MOV     @R0,A
0236 FA                 MOV     A,R2
0237 4302               ORL     A,#$02
0239 AA                 MOV     R2,A
023A 15                 DIS     I
023B F5                 SEL     MB1

023C E5                 SEL     MB0
023D 05                 EN      I
AVOCET SYSTEMS 8048 CROSS-ASSEMBLER -

SOURCE FILE NAME: SPCL11A.ASM


06A2                    ORG     $6A2
06A2 F5                 SEL     MB1
06A3 3400               CALL    KEYPAD
06A5 E5                 SEL     MB0
06A6 9AFE               ANL     P2,#$FE

06A8
06B0                    ORG     $6B0
06B0 B901       UART:   MOV     R1,#$01
06B2 B803               MOV     R0,#$03
06B4 2300               MOV     A,#$00
06B6 91         TRY:    MOVX    @R1,A
06B7 E8B6               DJNZ    R0,TRY
```

```
06B9 2340                MOV     A,#$40
06BB 91                  MOVX    @R1,A
06BC 237A                MOV     A,#$7A
06BE 91                  MOVX    @R1,A
06BF 2335                MOV     A,#$35
06C1 91                  MOVX    @R1,A
06C2 83                  RET
06C3
06C3
06C3

06C3 00                  NOP
06C4 00                  NOP
06C5 00                  NOP
06C6 00                  NOP
06C7 00                  NOP

06C8 00                  NOP
06C9 00                  NOP
06CA 00                  NOP
06CB 00                  NOP
06CC 00                  NOP

06CD 00                  NOP
06CE 00                  NOP
06CF 00                  NOP
06D0
```

AVOCET SYSTEMS 8048 CROSS-ASSEMBLER - VERS1

SOURCE FILE NAME: SPCL11A.ASM

```
0700                     ORG     $700
0700 B87A       MIMIC:   MOV     R0,#$7A
0702 10                  INC     @R0
0703 F0                  MOV     A,@R0
0704 A8                  MOV     R0,A
0705 F9                  MOV     A,R1
0706 A0                  MOV     @R0,A
0707 83                  RET
0708 15         INTRPT:  DIS     I
0709 D5                  SEL     RB1
070A B961                MOV     R1,#ACCUM
070C A1                  MOV     @R1,A

070D

070D B901                MOV     R1,#$01
070F 81                  MOVX    A,@R1
0710 5338                ANL     A,#$38
0712 C618                JZ      FINE
0714 D4B0                CALL    UART
0716 E45D                JMP     OUT4
0718
0718 FC         FINE:    MOV     A,R4
0719 92CC                JB4     COLLORG
```

AVOCET SYSTEMS 8048 CROSS-ASSEMBLER - V

SOURCE FILE NAME: SPCL11A.ASM

```
071B B900                MOV     R1,#$00
071D 81                  MOVX    A,@R1
071E A8                  MOV     R0,A
071F D33A                XRL     A,#$3A
0721 9663                JNZ     NOCOLON
0723 B965        PRTR:   MOV     R1,#ECHO
0725 F8                  MOV     A,R0
0726 A1                  MOV     @R1,A
0727 F9                  MOV     A,R1
0728 B87A                MOV     R0,#$7A
072A A0                  MOV     @R0,A
072B FC                  MOV     A,R4
072C 4301                ORL     A,#$01
072E AC                  MOV     R4,A


072F B800        OUT3:   MOV     R0,#$00
0731 B901                MOV     R1,#$01
0733 81          TRYAGN: MOVX    A,@R1
0734 5238                JB2     DOIT
0736 E433                JMP     TRYAGN
0738 B97A        DOIT:   MOV     R1,#$7A
073A F1                  MOV     A,@R1
073B A9                  MOV     R1,A
073C F1                  MOV     A,@R1
073D 90                  MOVX    @R0,A

073E B8BF                MOV     R0,#BUFF1
0740 F0                  MOV     A,@R0
0741 D3CF                XRL     A,#$CF
0743 9648                JNZ     HOP14
0745 23C0                MOV     A,#$C0
0747 A0                  MOV     @R0,A
0748 F0          HOP14:  MOV     A,@R0
0749 A8                  MOV     R0,A
074A F1                  MOV     A,@R1
074B A0                  MOV     @R0,A
074C B8BF                MOV     R0,#BUFF1
074E 10                  INC     @R0

074F D30A                XRL     A,#$0A


0751 965D                JNZ     OUT4
0753 B8FF                MOV     R0,#$FF
0755 B910                MOV     R1,#$10
0757 00          DLY2:   NOP
```

EI AVOCET SYSTEMS 8048 CROSS-ASSEMBLER - VEI

SOURCE FILE NAME: SPCL11A.ASM

```
0758 00                  NOP
0759 E857                DJNZ    R0,DLY2
075B E957                DJNZ    R1,DLY2
```

```
075D B961      OUT4:     MOV      R1,#ACCUM
075F F1                  MOV      A,@R1
0760 C5                  SEL      RB0
0761 05                  EN       I
0762 93                  RETR

0763 FC        NOCOLON:  MOV      A,R4
0764 4301                ORL      A,#$01
0766 AC                  MOV      R4,A
0767 F8                  MOV      A,R0
0768 A9                  MOV      R1,A
0769 5330                ANL      A,#$30
076B C676                JZ       CR


076D FD                  MOV      A,R5
076E A8                  MOV      R0,A
076F F9                  MOV      A,R1
0770 A0                  MOV      @R0,A
0771 1D                  INC      R5

0772 F400                CALL     MIMIC
0774 E42F                JMP      OUT3


0776 FC        CR:       MOV      A,R4
0777 3286                JB1      LF

0779 F9                  MOV      A,R1
077A D30D                XRL      A,#$0D
077C 962F                JNZ      OUT3
077E FC                  MOV      A,R4
077F 4302                ORL      A,#$02
0781 AC                  MOV      R4,A
0782 F400                CALL     MIMIC
0784 E42F                JMP      OUT3

0786 F9        LF:       MOV      A,R1
0787 D30A                XRL      A,#$0A
0789 962F                JNZ      OUT3
AVOCET SYSTEMS 8048 CROSS-ASSEMBLER -  VEI

SOURCE FILE NAME: SPCL11A.ASM


078B B883                MOV      R0,#FLAG3
078D F0                  MOV      A,@R0
078E 1292                JB0      BIT1
0790 E495                JMP      DUNE
0792 4302      BIT1:     ORL      A,#$02
0794 A0                  MOV      @R0,A
```

```
0795 FC        DUNE:   MOV     A,R4
0796 53FD              ANL     A,#$FD
0798 AC                MOV     R4,A
0799 F400              CALL    MIMIC
079B FD                MOV     A,R5
079C A8                MOV     R0,A
079D B0FF              MOV     @R0,#$FF
079F 1D                INC     R5

07A0 FB                MOV     A,R3
07A1 12A7              JB0     SETB1
07A3 4301              ORL     A,#$01
07A5 E4C7              JMP     FLG1

07A7 32AD      SETB1:  JB1     SETB2
07A9 4302              ORL     A,#$02
07AB E4C7              JMP     FLG1

07AD 52B3      SETB2:  JB2     SETB3
07AF 4304              ORL     A,#$04
07B1 E4C7              JMP     FLG1

07B3 72B9      SETB3:  JB3     SETB4
07B5 4308              ORL     A,#$08
07B7 E4C7              JMP     FLG1

07B9 92BF      SETB4:  JB4     SETB5
07BB 4310              ORL     A,#$10
07BD E4C7              JMP     FLG1

07BF B2C5      SETB5:  JB5     SETB6
07C1 4320              ORL     A,#$20
07C3 E4C7              JMP     FLG1

07C5 4340      SETB6:  ORL     A,#$40
07C7 AB        FLG1:   MOV     R3,A

07C8 A5                CLR     F1
07C9 B5                CPL     F1
07CA E42F              JMP     OUT3
```

AVOCET SYSTEMS 8048 CROSS-ASSEMBLER - VERSION 1.62

SOURCE FILE NAME: SPCL11A.ASM

```
07CC B900      COLLORG:MOV     R1,#$00
07CE 81                MOVX    A,@R1
07CF A9                MOV     R1,A
07D0 D33A              XRL     A,#$3A
07D2 96EF              JNZ     CHAR
07D4 FC                MOV     A,R4
07D5 5327              ANL     A,#$27
07D7 AC                MOV     R4,A
07D8 BE30              MOV     R6,#$30
07DA F9                MOV     A,R1
07DB A8                MOV     R0,A
07DC C5                SEL     RB0
07DD FA                MOV     A,R2
07DE 32E3              JB1     MESEND
```

```
07E0 D5                 SEL     RB1
07E1 E423               JMP     PRTR
07E3 53FD     MESEND:   ANL     A,#$FD
07E5 AA                 MOV     R2,A
07E6 D5                 SEL     RB1
07E7 B983               MOV     R1,#FLAG3
07E9 F1                 MOV     A,@R1
07EA 4301               ORL     A,#$01
07EC A1                 MOV     @R1,A


07ED E423               JMP     PRTR


07EF FE       CHAR:     MOV     A,R6
07F0 A8                 MOV     R0,A
07F1 F0                 MOV     A,@R0
07F2 D9                 XRL     A,R1
07F3 C6F9               JZ      DATEQL
07F5 FC                 MOV     A,R4
07F6 4380               ORL     A,#$80
07F8 AC                 MOV     R4,A
07F9 FC       DATEQL:   MOV     A,R4
07FA 4340               ORL     A,#$40
07FC AC                 MOV     R4,A
07FD E45D               JMP     OUT4
```

AVOCET SYSTEMS 8048 CROSS-ASSEMBLER - VER

SOURCE FILE NAME: SPCL11A.ASM

```
0900                    ORG     $900
0900 B8FF     KEYPAD:   MOV     R0,#$FF
0902 B904               MOV     R1,#$04
0904 23C7               MOV     A,#$C7
0906 39                 OUTL    P1,A
0907 23E7               MOV     A,#$E7
0909 39                 OUTL    P1,A
090A 23C7               MOV     A,#$C7
090C 39                 OUTL    P1,A
090D 09       RDSW:     IN      A,P1
090E 437F               ORL     A,#$7F
0910 58                 ANL     A,R0
0911 E916               DJNZ    R1,RESTT
0913 A8                 MOV     R0,A
0914 2420               JMP     MTR
0916 77       RESTT:    RR      A
0917 A8                 MOV     R0,A
0918 2387               MOV     A,#$87
091A 39                 OUTL    P1,A
091B 23C7               MOV     A,#$C7
091D 39                 OUTL    P1,A
091E 240D               JMP     RDSW
0920 F8       MTR:      MOV     A,R0
0921 53D0               ANL     A,#$D0
0923 A8                 MOV     R0,A
0924 B981               MOV     R1,#KEY
0926 F1                 MOV     A,@R1
```

```
0927 123D                JB0     TWOKEY
0929 F8                  MOV     A,R0
092A D300                XRL     A,#$00
092C C64D                JZ      ZIPPO
```

AVOCET SYSTEMS 8048 CROSS-ASSEMBLER - VERSION

SOURCE FILE NAME: SPCL11A.ASM

```
092E 4301                ORL     A,#$01
0930 A1                  MOV     @R1,A
0931 B982                MOV     R1,#KEEPER
0933 F8                  MOV     A,R0
0934 A1                  MOV     @R1,A
0935 B8FF                MOV     R0,#$FF
0937 B908                MOV     R1,#$08
0939 34BA                CALL    DLY1
093B 2400                JMP     KEYPAD

093D 53FE       TWOKEY:  ANL     A,#$FE
093F A1                  MOV     @R1,A
0940 B982                MOV     R1,#KEEPER
0942 F1                  MOV     A,@R1
0943 D8                  XRL     A,R0
0944 964D                JNZ     ZIPPO


0946 F8                  MOV     A,R0
0947 9291                JB4     CLR
0949 D280                JB6     FWD
094B F264                JB7     REV

094D B981       ZIPPO:   MOV     R1,#KEY
094F F1                  MOV     A,@R1
0950 F25D                JB7     MOTOFF

0952 FD                  MOV     A,R5
0953 D300                XRL     A,#$00
0955 C65D                JZ      MOTOFF

0957 0A                  IN      A,P2
0958 4350                ORL     A,#$50
095A 3A                  OUTL    P2,A
095B 2463                JMP     OUTCH

095D 0A         MOTOFF:  IN      A,P2
095E 53BF                ANL     A,#$BF
0960 4310                ORL     A,#$10
0962 3A                  OUTL    P2,A

0963 83         OUTCH:   RET

0964 FA         REV:     MOV     A,R2
0965 1269                JB0     SET
0967 5400                CALL    TOGGLE
0969 CE         SET:     DEC     R6
096A FE                  MOV     A,R6
096B 966F                JNZ     LDMT
[illegible]              MOV     R6,#$19
```

AVOCET SYSTEMS 8048 CROSS-ASSEMBLER - VERSION 1.62

SOURCE FILE NAME: SPCL11A.ASM

```
096F BB01        LDMT:   MOV     R3,#$01
0971 B881                MOV     R0,#KEY
0973 F0                  MOV     A,@R0
0974 4302                ORL     A,#$02
0976 A0                  MOV     @R0,A
0977 7400                CALL    MOTOR

0979 B881                MOV     R0,#KEY
097B F0                  MOV     A,@R0
097C 53FD                ANL     A,#$FD
097E A0                  MOV     @R0,A

097F 83                  RET

0980 FA          FWD:    MOV     A,R2
0981 1285                JB0     J2
0983 2487                JMP     BINCNT
0985 5400        J2:     CALL    TOGGLE
0987 1E          BINCNT: INC     R6
0988 FE                  MOV     A,R6
0989 D31A                XRL     A,#$1A
098B 966F                JNZ     LDMT
098D BE01                MOV     R6,#$01
098F 246F                JMP     LDMT

0991 FA          CLR:    MOV     A,R2
0992 4342                ORL     A,#$42
0994 AA                  MOV     R2,A
0995 BF00                MOV     R7,#$00
0997 B919                MOV     R1,#$19
0999 B841                MOV     R0,#$41
099B B000        J3:     MOV     @R0,#$00
099D 18                  INC     R0
099E E99B                DJNZ    R1,J3
09A0 238F                MOV     A,#$8F
09A2 39                  OUTL    P1,A

09A3 B881                MOV     R0,#KEY
09A5 F0                  MOV     A,@R0
09A6 F25D                JB7     MOTOFF

09A8 FD                  MOV     A,R5
09A9 D300                XRL     A,#$00
09AB 96B5                JNZ     BRAKON
09AD 0A                  IN      A,P2
09AE 4390                ORL     A,#$90
09B0 53BF                ANL     A,#$BF
09B2 3A                  OUTL    P2,A
09B3 24B9                JMP     J4

09B5 0A          BRAKON: IN      A,P2
```

AVOCET SYSTEMS 8048 CROSS-ASSEMBLER - VERSIUN 1.62

SOURCE FILE NAME: SPCL11A.ASM

```
09B6 43D0                ORL     A,#$D0
09B8 3A                  OUTL    P2,A
09B9 83          J4:     RET


09BA 00          DLY1:   NOP
09BB E8BA                DJNZ    R0,DLY1
09BD E9BA                DJNZ    R1,DLY1
09BF 83                  RET


0A00                     ORG     $A00
0A00 0A          TOGGLE: IN      A,P2
0A01 B860                MOV     R0,#TOGPTR
0A03 A0                  MOV     @R0,A
0A04 53BF                ANL     A,#$BF
0A06 A0                  MOV     @R0,A
0A07 3A                  OUTL    P2,A
0A08 B8FF                MOV     R0,#$FF
0A0A B9FF        TGL1:   MOV     R1,#$FF
0A0C E90C        JTGL:   DJNZ    R1,JTGL
0A0E E80A                DJNZ    R0,TGL1
0A10 B860                MOV     R0,#TOGPTR
0A12 F0                  MOV     A,@R0
0A13 5320                ANL     A,#$20
0A15 C624                JZ      TGLE
0A17 F0                  MOV     A,@R0
0A18 539F                ANL     A,#$9F
0A1A 3A                  OUTL    P2,A
0A1B B860                MOV     R0,#TOGPTR
0A1D A0                  MOV     @R0,A
0A1E FA                  MOV     A,R2
0A1F 53FE                ANL     A,#$FE
0A21 AA                  MOV     R2,A
0A22 442F                JMP     TDELAY
0A24 B860        TGLE:   MOV     R0,#TOGPTR
0A26 F0                  MOV     A,@R0
0A27 4320                ORL     A,#$20
0A29 3A                  OUTL    P2,A
0A2A A0                  MOV     @R0,A
0A2B FA                  MOV     A,R2
0A2C 4301                ORL     A,#$01
```

```
AVOCET SYSTEMS 8048 CROSS-ASSEMBLER -  VERSION 1.62

SOURCE FILE NAME: SPCL11A.ASM


 0A2E AA                    MOV      R2,A
 0A2F B8FF        TDELAY:   MOV      R0,#$FF
 0A31 B9FF        TDEL:     MOV      R1,#$FF
 0A33 E933        TDE:      DJNZ     R1,TDE
 0A35 E831                  DJNZ     R0,TDEL
 0A37 B860                  MOV      R0,#TOGPTR
 0A39 F0                    MOV      A,@R0
 0A3A 4340                  ORL      A,#$40
 0A3C 3A                    OUTL     P2,A
 0A3D 83                    RET

 0B00                       ORG      $B00
 0B00 0A          MOTOR:    IN       A,P2
 0B01 4340                  ORL      A,#$40
 0B03 53EF                  ANL      A,#$EF
 0B05 3A                    OUTL     P2,A
 0B06 260A        TST3:     JNT0     TST4
 0B08 6406                  JMP      TST3
 0B0A 360E        TST4:     JT0      DCR
 0B0C 640A                  JMP      TST4
 0B0E EB06        DCR:      DJNZ     R3,TST3
 0B10 3610        TST7:     JT0      TST7
 0B12 2616        TST6:     JNT0     TST8
 0B14 6412                  JMP      TST6
 0B16 B981        TST8:     MOV      R1,#KEY
 0B18 F1                    MOV      A,@R1
 0B19 322B                  JB1      NOMAS

 0B1B 0A                    IN       A,P2
 0B1C 4310                  ORL      A,#$10
 0B1E 3A                    OUTL     P2,A

 0B1F F1                    MOV      A,@R1
 0B20 F227                  JB7      ALLOFF

 0B22 FD                    MOV      A,R5
 0B23 D300                  XRL      A,#$00
 0B25 962B                  JNZ      NOMAS
 0B27 0A          ALLOFF:   IN       A,P2
 0B28 53BF                  ANL      A,#$BF
 0B2A 3A                    OUTL     P2,A
 0B2B 83          NOMAS:    RET
AVOCET SYSTEMS 8048 CROSS-ASSEMBLER -  VERSION 1.62

SOURCE FILE NAME: SPCL11A.ASM
 0B2C FC          MTRADJ:   MOV      A,R4
 0B2D DE                    XRL      A,R6
 0B2E C66A                  JZ       NOMOVE
 0B30 BF00                  MOV      R7,#$00
 0B32 B900                  MOV      R1,#$00
 0B34 FE                    MOV      A,R6
 0B35 A8                    MOV      R0,A
 0B36 18          GOFWD:    INC      R0
```

```
0B37 F8                 MOV     A,R0
0B38 D31A               XRL     A,#$1A
0B3A 963E               JNZ     OVHILL
0B3C B801               MOV     R0,#$01
0B3E F8         OVHILL: MOV     A,R0
0B3F 19                 INC     R1
0B40 DC                 XRL     A,R4
0B41 9636               JNZ     GOFWD
0B43 F9                 MOV     A,R1
0B44 AB                 MOV     R3,A
0B45 B900               MOV     R1,#$00
0B47 FE                 MOV     A,R6
0B48 A8                 MOV     R0,A
0B49 C8         GOBKD:  DEC     R0
0B4A F8                 MOV     A,R0
0B4B D300               XRL     A,#$00
0B4D 9651               JNZ     UNCOLA
0B4F B819               MOV     R0,#$19
0B51 F8         UNCOLA: MOV     A,R0
0B52 19                 INC     R1
0B53 DC                 XRL     A,R4
0B54 9649               JNZ     GOBKD
0B56 F9                 MOV     A,R1
0B57 AF                 MOV     R7,A
0B58 37                 CPL     A
0B59 17                 INC     A
0B5A 6B                 ADD     A,R3
0B5B F25F               JB7     CALLT
0B5D 646B               JMP     CALLT1
0B5F FA         CALLT:  MOV     A,R2
0B60 1264               JB0     BYPS
0B62 6466               JMP     EXCUS
0B64 5400       BYPS:   CALL    TOGGLE
0B66 FC         EXCUS:  MOV     A,R4
0B67 AE                 MOV     R6,A
0B68 7400               CALL    MOTOR
0B6A 83         NOMOVE: RET
0B6B FA         CALLT1: MOV     A,R2
0B6C 1270               JB0     SETIT
0B6E 5400               CALL    TOGGLE
0B70 FF         SETIT:  MOV     A,R7
```

AVOCET SYSTEMS 8048 CROSS-ASSEMBLER - VERSION 1.02

SOURCE FILE NAME: SPCL11A.ASM

```
0B71 AB                 MOV     R3,A
0B72 6466               JMP     EXCUS


0B74 B821       SPECTBL:MOV     R0,#$21
```

```
0B76 B97E                MOV     R1,#BYTES
0B78 F1                  MOV     A,@R1
0B79 AB                  MOV     R3,A
0B7A CB                  DEC     R3
0B7B CB                  DEC     R3
0B7C B962                MOV     R1,#HDPTR1
0B7E F1                  MOV     A,@R1
0B7F A9                  MOV     R1,A
0B80 F0                  MOV     A,@R0
0B81 EB86                DJNZ    R3,ANUTHR
0B83 A1                  MOV     @R1,A
0B84 648C                JMP     BINGO
0B86 47          ANUTHR: SWAP    A
0B87 AB                  MOV     R3,A
0B88 18                  INC     R0
0B89 F0                  MOV     A,@R0
0B8A 4B                  ORL     A,R3
0B8B A1                  MOV     @R1,A
0B8C B962        BINGO:  MOV     R1,#HDPTR1
0B8E 11                  INC     @R1
0B8F 83                  RET
0000                     END
AVOCET SYSTEMS 8048 CROSS-ASSEMBLER -  VERSION 1.62

SOURCE FILE NAME: SPCL11A.ASM
---- SYMBOL TABLE ----

A        0001     CNTBF    00D0     FIVER    0005     MTR      0920
ACC1     0096     CNTBF1   00D1     FLAG3    0083     MTRADJ   0B2C
ACCUM    0061     CNTBF2   00D2     FLAGS    007C     MULT     0077
ACTSUM   0089     COLLORG  07CC     FLG1     07C7     MXWTDF   009C
ALLOFF   0B27     CONSEC   00F0     FWD      0980     NMBUF1   00E1
ALRITE   0048     COOL     021B     GOBKD    0B49     NMBUF2   00E3
ANUTHR   0B86     CR       0776     GOFWD    083B     NMDBUF   00E0
APPTR    0064     CRDSRT   00F1     HDPTR    0063     NMDCNT   0084
B        0002     CUSTODY  0085     HDPTR1   0062     NOCOLON  0763
BINCNT   0987     D        0004     HOP14    0748     NOMAS    0B2B
BINGO    0B8C     DATEQL   07F9     HOP8     0210     NOMOVE   086A
BIT1     0792     DATSUM   0086     HOP9     0205     OUT3     072F
BLUF     00FD     DCR      0B0E     INTRPT   0708     OUT4     075D
BLUF1    00FE     DIRCTR   0078     J2       0985     OUTCH    0963
BLUF2    00FF     DLY1     09BA     J3       099B     OVHILL   083E
BRAKON   09B5     DLY2     0757     J4       09B9     PAPE     0080
BUFF1    00BF     DOIT     0738     JTGL     0A0C     PRTR     0723
BYPS     0B64     DUNE     0795     KEEPER   0082     PTREQ    003C
BYTES    007E     DWTDIF   00B1     KEY      0081     R1REG    0079
C        0003     ECHO     0065     KEYPAD   0900     R2REG    00FC
CALLT    085F     EMPBIN   00FA     LDMT     096F     R3REG    00FB
CALLT1   0B6B     END1     0042     LF       0786     RDSW     090D
CHAR     07EF     EOJREG   0097     MDFV     0200     RESTT    0916
CLR      0991     ERMESS   0230     MESEND   07E3     REV      0964
CNT      008A     EXCUS    0B66     MIMIC    0700     SET      0969
CNT1     008B     FINE     0718     MOTOFF   095D     SETB1    07A7
CNT2     008C     FINSUM   0087     MOTOR    0800     SETB2    07AD
```

What is claimed is:

1. The method of distributing successive groups of sheets of material serially to a first plurality of storage bins according to a predetermined desired distribution pattern for each group, comprising:

monitoring the quantity of sheets delivered to each of said bins to develop first signals representative thereof;

in response to said first signals, storing in a plurality of signal-storage registers a corresponding plurality of values representative of the quantity of said sheets delivered to corresponding respective sheet-storage bins;

generating second signals representative of said desired distribution patterns;

applying said second signals to control said distribution of sheets to said bins according to said distribution patterns;

prior to distributing said sheets of each of said groups to said bins, checking said values then in said storage registers to identify a set of bins appropriate to receive said each group of sheets and to produce third signals indicative of the location of said set of bins; and controlling said distributing in response to said third signals to effect delivery of each of said groups of sheets to a corresponding appropriate set of bins.

2. The method of claim 1, wherein different sheets of some groups have different numbers of superimposed panels, and said method comprises producing fourth signals indicative of the total number of panels in the sheets delivered to each bin and producing fifth signals indicative of when said total number of panels exceeds a predetermined reference value for any of said bins.

3. The method of claim 2, comprising determining whether another plurality of bins are available to receive additional sheets when said fifth signal is produced, and if so, thereafter switching the distribution of sheets from said first plurality of bins to said other plurality of bins.

4. The method of claim 3, comprising producing a sixth signal in the event that said determining shows that another plurality of bins is not available.

5. The apparatus of claim 4, wherein said bin-switching means comprises sheet-detecting means for detecting the entrance of each sheet into said collator to produce a sheet-entry indicating signal, and means responsive to said sheet-entry indicating signal for producing a further signal indicating whether the immediately succeeding sheet will over-fill a bin of said collator.

6. The apparatus of claim 5, wherein said bin-switching means comprises means responsive to said further signal for determining whether said bin-switching means should be actuated to prevent over-filling of said collator.

7. In sheet-distributing apparatus comprising a pluurality of bins for receiving and storing sheets of material some or all of which may be folded one or more times, and means for feeding said sheets to said bins, the improvement comprising:

sheet-sensing means for sensing the number of superimposed panels in each of said sheets prior to feeding them to a first set of said bins and for producing signals representative of the effective total thickness of the sheets fed to each of said bins; and bin-switching means responsive to said signals for switching said feeding of said sheets from said first set of bins to a second set of said bins when one of said bins of said first set has become substantially filled with said sheets.

8. The apparatus of claim 7, wherein said second set of bins is completely exclusive of said first set of bins.

9. The apparatus of claim 8, wherein said first set of bins comprises less than one-half the total number of bins of said apparatus and said other set of bins is exclusive of said first set of bins and equal thereto in number.

10. The apparatus of claim 9, wherein said sheets of material fed to said bins comprise a train of separate integral sheets different ones of which have different numbers of overlapping panels.

11. The apparatus of claim 7, wherein said sheets fed to said bins comprises a train of separate integral sheets differing ones of which have different numbers of overlapping panels; said means for sensing the number of said panels for each sheet comprises means for producing first signals indicating the number of overlapping panels in each of said sheets; and said bin-switching means comprises means for assigning different values to said sheets depending on the number of said overlapping panels therein, with greater values assigned to sheets having greater numbers of panels and means for producing a bin-switching signal when the sum of said values for sheets supplied to any of said first set of bins reaches a predetermined level.

12. The apparatus of claim 7, wherein the total number of said bins is at least twice the number of bins in said first set, and said bin-switching means is responsive to said sheet-sensing means to switch said feeding of said sheets from said first set of bins to a second set exclusive of said first set and equal in number to said first set.

13. In a combination sheet folder and sheet collator for automatically conveying a series of sheets of material into and through a folder and thence into the bins of a collator, wherein said sheets entering said folder differ in lateral size and are folded differently by said folder to produce different numbers of superimposed panels in the sheets exiting from said folder depending upon the lateral size of the sheet prior to its folding:

apparatus for signalling when a bin in said collator has been filled with said sheets to a predetermined degree, comprising first means for producing first signals indicative of the lateral size of each sheet prior to its folding;

second means responsive to said first signals for producing second signals having values representative of the number of superimposed panels to be formed in each sheet by said folder, said weighted value for each sheet increasing with the number of said panels to be formed in said each sheet;

third means responsive to said second signals for producing third signals indicative of when the sum of said values for sheets delivered to any one of said bins attains a predetermined reference value corresponding to said predetermined degree of fullness of said one bin.

14. The system of claim 13, comprising fourth means responsive to said third signals for determining whether there is another bin of said collator which is not filled to said predetermined degree, and for switching delivery of said sheets away from said one bin to another bin.

15. The system of claim 13, comprising collator control means for presenting a first set of N bins to receive distribution of said sheets from said folders, means responsive to said third signals for detecting the existence of another set of N different bins in said collator which are not filled to said predetermined degree, and means responsive to said third signals for switching the distribution of said sheets from said first set of N bins to said other set of N bins.

* * * * *